US007866923B2

(12) United States Patent
Knudson et al.

(10) Patent No.: US 7,866,923 B2
(45) **Date of Patent: *Jan. 11, 2011**

(54) CONTINUOUS CHAMBER MASS CONFINEMENT CELLS AND METHODS OF USE THEREOF

(75) Inventors: Edward Alan Knudson, Annandale, MN (US); John Fitzgerald Dolan, Golden Valley, MN (US); Robert J Race, Eagan, MN (US); Timothy Paul Bendell, Cologne, MN (US); Vishal Nanasaheb Lokhande, Minneapolis, MN (US); Daniel Darst, Zimmerman, MN (US); Eric Jason Krause, Big Lake, MN (US)

(73) Assignee: New Technology Resources, Inc., Edina, MN (US)

( * ) Notice: Subject to any disclaimer, the term of this patent is extended or adjusted under 35 U.S.C. 154(b) by 302 days.

This patent is subject to a terminal disclaimer.

(21) Appl. No.: 11/463,816

(22) Filed: Aug. 10, 2006

(65) Prior Publication Data

US 2007/0036616 A1 Feb. 15, 2007

Related U.S. Application Data

(60) Provisional application No. 60/707,032, filed on Aug. 10, 2005, provisional application No. 60/741,737, filed on Dec. 2, 2005, provisional application No. 60/777,617, filed on Feb. 28, 2006.

(51) Int. Cl.
*E02D 29/02* (2006.01)

(52) U.S. Cl. ..... 405/284; 405/262

(58) Field of Classification Search ..... 405/262, 405/284–286

See application file for complete search history.

(56) References Cited

U.S. PATENT DOCUMENTS

| | | | |
|---|---|---|---|
| 1,340,680 | A | 5/1920 | Zimmerman |
| 2,741,777 | A | 4/1956 | Loye |
| 4,048,682 | A | 9/1977 | Smith |
| D255,787 | S | 7/1980 | Morehead, Jr. |
| 4,552,484 | A | 11/1985 | Nuttle |
| 4,778,309 | A | 10/1988 | Bach et al. |
| 5,044,834 | A | 9/1991 | Janopaul, Jr. |
| RE34,314 | E | 7/1993 | Forsberg |
| 5,230,195 | A | 7/1993 | Sease |
| 5,294,216 | A | 3/1994 | Sievert |
| 5,449,543 | A | 9/1995 | Bach |
| 5,471,808 | A | 12/1995 | De Pierie et al. |

(Continued)

FOREIGN PATENT DOCUMENTS

| | | |
|---|---|---|
| CN | 1119233 | 3/1996 |

(Continued)

*Primary Examiner*—Frederick L Lagman
(74) *Attorney, Agent, or Firm*—Fredrikson & Byron, P.A.

(57) ABSTRACT

The present invention relates to mass confinement cells that may be used in retaining walls and earth retention systems that has a natural earthen appearance or other aesthetic design and is resistant to damage and wear caused by the environment. The mass confinement cells are generally light-weight and include a continuous chamber that at least partially aligns with confinement cells positioned above and below, thereby allowing the intermingling of fill material between adjacent cells. The mass confinement cells are capable of accepting and retaining any type of filling material. The filling material provides weight, stability and security to a retaining wall constructed of such mass confinement cells.

47 Claims, 57 Drawing Sheets

U.S. PATENT DOCUMENTS

| | | | | |
|---|---|---|---|---|
| 5,501,040 | A | 3/1996 | White-Wexler et al. | |
| 5,586,408 | A | 12/1996 | Bergevin | |
| 5,615,529 | A | 4/1997 | Johnson et al. | |
| 5,658,098 | A | 8/1997 | Woolbright | |
| 5,688,079 | A | 11/1997 | Bolduc et al. | |
| 5,771,650 | A | 6/1998 | Williams et al. | |
| 5,832,687 | A | 11/1998 | Willemsen | |
| 5,927,506 | A | 7/1999 | Young et al. | |
| 5,927,906 | A | 7/1999 | Bach et al. | |
| 6,024,626 | A | 2/2000 | Mendelsohn | |
| 6,062,772 | A | 5/2000 | Perkins | |
| D429,004 | S | 8/2000 | Strand et al. | |
| 6,231,272 | B1 * | 5/2001 | Bishop | 405/286 |
| 6,287,054 | B1 * | 9/2001 | Egan et al. | 405/262 |
| 6,296,924 | B1 | 10/2001 | Bach | |
| 6,336,291 | B1 | 1/2002 | Skuba | |
| 6,527,483 | B1 | 3/2003 | Agee | |
| 6,571,529 | B2 | 6/2003 | Knudson et al. | |
| 6,623,213 | B1 | 9/2003 | Maydew | |
| 6,663,323 | B1 | 12/2003 | Boys | |
| 6,817,154 | B2 | 11/2004 | Dolan et al. | |
| 6,918,503 | B1 | 7/2005 | Molander | |
| 7,000,347 | B2 | 2/2006 | Roskin | |
| 7,198,435 | B2 * | 4/2007 | Dolan et al. | 405/284 |
| 2004/0222222 | A1 | 11/2004 | Parnall et al. | |
| 2005/0102950 | A1 | 5/2005 | Knudson et al. | |

FOREIGN PATENT DOCUMENTS

| | | |
|---|---|---|
| CN | 1381654 | 6/1996 |
| CN | 1220334 | 11/2002 |
| EP | 0708208 | 4/1996 |
| FR | 2641296 | 7/1990 |
| JP | 2003313974 | 11/2003 |

* cited by examiner 12
16
22
24
56
58
60

CONTINUOUS CHAMBER MASS CONFINEMENT CELLS AND METHODS OF USE THEREOF

CROSS-REFERENCE TO RELATED APPLICATION

This application claims priority to U.S. Provisional Application Ser. No. 60/707,032, filed on Aug. 10, 2005, U.S. Provisional Application No. 60/741,737 filed on Dec. 2, 2005, and U.S. Provisional Application No. 60/777,617 filed on Feb. 28, 2006. The contents of the three previously mentioned applications are incorporated by reference herein.

FIELD OF THE INVENTION

The present invention relates to environment resistant landscaping products, such as mass confinement cells for retaining wall and earth retention applications, that in various embodiments provide a natural earthen appearance, such as rock, stone, sand, soil, clay, wood, trees and foliage, water, or any other natural earthen appearance. The mass confinement cells may also include a fascia having a natural earthen appearance or other aesthetically appealing design that is resistant to damage and wear caused by the environment. The mass confinement cells are generally light-weight and include a frame adjoined to one or more chamber enclosing members, thereby forming a continuous chamber. The continuous chamber of each cell are designed to at least partially align with confinement cells positioned above and below, thereby allowing the intermingling of fill material between adjacent cells. The mass confinement cells are capable of accepting and retaining any type of filling material that generally provides weight, stability and security to a retaining wall constructed of such mass confinement cells.

BACKGROUND OF THE INVENTION

The use of retaining walls to protect and beatify property in all types of environmental settings is a common practice in the landscaping, construction and environmental protection fields. Walls constructed from various materials are used to outline sections of property for particular uses, such as gardens or flower beds, fencing in property lines, reduction of erosion, stabilizing construction sites in potentially unstable or rough terrain and to simply beautify areas of a property.

Numerous methods and materials exist for the construction of retaining walls. Such methods include the use of natural stone, poured in place concrete, masonry, landscape timbers or railroad ties. In recent years, segmental concrete retaining wall units, sometimes known as dry-cast block, which are dry stacked (i.e., built without the use of mortar), have become a widely accepted product for the construction of retaining walls. Examples of such units are described in U.S. Pat. No. RE 34,314 (Forsberg) and in U.S. Pat. No. 5,294,216 (Sievert).

However, many of the materials utilized in the construction of retaining walls are susceptible to deterioration, heavy, cumbersome and/or not very aesthetically appealing. The ability of these retaining walls to withstand sunlight, wind, water, general erosion and other environmental elements is a problem with most retaining wall products.

One particular concern is the utilization of erosion protection materials in water shorelines. Leaving the shoreline natural can lead to erosion, cause an unmanageable and unusable shoreline, create high maintenance, and potentially destroy an aesthetically pleasing property. Many materials utilized in retention of shorelines are subject to immediate deterioration and/or are not as aesthetically appealing as one would desire. Furthermore, many materials utilized on shoreline structures are difficult to maintain due to the awkward location in the water and also the prevalent growth and presence of organic materials that can get caught and flourish in such a structure. For example, many lakeshore or ocean side properties utilize riprap as a retention device for prevention of erosion. Riprap is a configuration of very heavy, large to medium size stones placed along the shoreline. One problem with waterfront properties that use a continuous wall of typical riprap is the shoreline will retain some organic material, will accumulate additional organic material brought in by the water and/or will allow vegetation to grow within the openings between stones. This usually leads to an unmanageable and aesthetically displeasing shoreline or higher maintenance. Furthermore, the riprap is never uniform in color and size and therefore does not provide the most aesthetically pleasing shoreline or complete coverage of the shoreline. The lack of uniform shoreline coverage allows for some erosion, collection of unwanted materials and the potential growth of undesirable vegetation.

Another problem with materials normally utilized in the construction of retaining walls, such as poured in place concrete, masonry, landscape timbers, railroad ties or dry-cast blocks (e.g. blocks produced by Keystone® Inc. or Anchor® Retaining Wall Systems, Inc.) is that regulations in most states and counties prohibit their use in or near bodies of water because of the potential chemical diffusion into the body of water and/or the crumbling or deterioration of the material into the body of water over time. Many of these retaining wall materials diffuse chemicals, dissolve, crumble, break apart and/or float into the body of water of which they are lining, thereby causing problems with the shoreline and pollution of the water. For example, the average life of various types of dry-cast block in water environments is approximately a couple of years. A need exists for a retaining wall, which would be resistant to such deterioration.

An additional concern that exists in the construction of retaining walls is the weight of the materials. Concrete blocks (e.g. wet or dry cast), large or medium size stones or timbers can be heavy and cumbersome to move into the wall location and maneuver when constructing retaining walls and earth retention systems. Many locations for which retaining walls are constructed are positioned in awkward terrain. Therefore, heavy building materials are difficult to move into such locations and furthermore are difficult to position when constructing the retaining wall, thereby adding additional cost and labor for installation. However, the heavy materials can be beneficial once the wall is constructed to provide stability and security to the structure. Therefore, what is needed are easy to install light-weight units used for the construction of retaining walls and earth retention systems, which can be weighted once placed into position thus retaining the units in position and stabilizing the completed retaining wall.

SUMMARY OF THE INVENTION

Embodiments of the present invention relate to retaining wall products including mass confinement cells that are resistant to damage and wear caused by the environment. The mass confinement cells generally include a frame adjoined to one or more enclosing members to form a continuous chamber, which allows the flow of fill material to adjacent confinement cells below and above. The deterioration resistant mass confinement cell is generally a hollowed frame or shell that includes a deterioration resistant material that is light-weight and is configured to interlock with adjacent confinement cells, thereby forming a continuous chamber system capable of accepting and retaining any type of filling material. The filling material provides weight, density, structure and stability to the mass confinement cells and also ultimately provides stability and security to the retaining wall constructed of such cells.

Various embodiments of the deterioration resistant mass confinement cells of the present invention comprise a frame adjoined with one or more chamber enclosing members to form a mass confinement cell having a continuous flow chamber. The frame in various embodiments of the present invention may include two or more panels that are hingedly adjoined to allow the panels to position in a flattened configuration, thereby providing transportation and storage efficiencies. In various embodiments at least two of the panels extend from the front of the cell to the back of the cell at angles (e.g. less than 90°), thereby allowing for the back of the cell to be shorter in length than the front of the cell. This configuration allows for curving of walls or revetments when constructing a wall. The continuous flow chamber of these mass confinement cells generally forms a series of integrated channels when placed in a wall or earth retention structure, thereby allowing the flow of fill material between adjacent confinement cells.

The cells of the present invention may further include one or more anchoring devices for securing each cell to adjacent cells or securing them into position in the retaining wall. In various embodiments of the present invention one or more of the panels include one or more locking pegs or peg extensions for interconnecting the stacked confinement cells. The locking pegs or peg extensions assist in positioning and/or adjoining adjacent cells and facilitating the flow of fill material to the adjacent cells. Additionally, the locking pegs or peg extensions assist in retaining the fill material within the adjoined confinement cells and also may lock the adjacent cells to each other. As previously suggested, the continuous chambers are adapted for receiving and retaining fill materials, such as sand, dirt, gravel, pea rock, class V, concrete or any other similar material, which provides the permanent weighting and stability of each retaining wall cell.

In additional embodiments of the present invention, the cells may comprise a frame including two or more separated panels that are fixedly adjoined by a securing mechanism, such as a "peg and socket system". For example, a front panel, side panels and/or back panel may be separate panels that are secured together to form the confinement cells of the present invention. These embodiments provide the benefits of providing two or more substantially flat panels and/or nestable panels that may be assembled to form each cell. Also, such a process may open other beneficial manufacturing techniques to form such panels, such as extrusion, thermoforming and vacuum forming. Such embodiments will also generally provide benefits related to transportation and storage.

In yet other embodiments of the present invention, the mass confinement cells include a frame operably adjoined to a load cell and fascia. The load cell of these embodiments generally includes a cylinder that is intended to bear the majority of the load of the fill material, thereby protecting the fascia and front panel of the frame or front chamber enclosing member. Similar to the previous embodiments there are transportation and storage benefits in these embodiments in that the various components nest or may be transported in a flat configuration.

Embodiments of the deterioration resistant mass confinement cells of the present invention may be used in constructing retaining walls and earth retention systems on a number of property terrains, such as along waterfront properties or along gradual or steep embankments. The deterioration resistant confinement cells are particularly useful for terrains near water or underwater due to their resistance to degradation. However, the deterioration resistant cells could also be used for land applications for those that want a light-weight retaining wall product that can be filled on-site to add weight and stability and also does not require heavy equipment for moving and installing. Therefore, the deterioration resistant mass confinement cells could be utilized to construct any form of wall, earth retention system or fence structure.

One unique feature of the present invention is the light-weight characteristic of each confinement cell before it is filled and the stable and weighted characteristic after it is filled. As previously mentioned, embodiments of the present invention may be filled with any type of fill material located at the site, such as rocks (e.g. crushed rock and pea rock), sand, gravel, soil, concrete or similar materials. The filling characteristic of the deterioration resistant confinement cells means that when the cells are not filled they are very light-weight. This light-weight feature provides individuals constructing such walls the advantage of easily moving large numbers of the confinement cells to the site of construction with relative ease. Furthermore, the lightweight characteristic of such cells allows for easy maneuvering of the cells into final position when constructing a retaining wall or revetment, but still allows for the stability as found in heavy concrete products when these same confinement cells are filled. These characteristics are met by each mass confinement cell being made of a lightweight material, such as plastic (e.g. high density polyethylene), and by it also being configured to receive a heavy fill material once it has been placed in its final position on the retaining wall.

Individuals would be more inclined to install products made of a deterioration resistant material, rather than cement block, timbers, dry cement process (or dry-cast) block (e.g. Keystone® or Anchor® block) and the like, because of their installation ease attributed to the light-weight properties and enhanced longevity. The weight of most regular retaining wall block is approximately 12-120 lbs, whereas embodiments of the present invention are approximately 2-20 lbs. Of course, weight may vary depending on the size and materials utilized in manufacturing embodiments of the present invention.

Embodiments of the present invention are also superior to other retaining wall products due to the precise nature of the materials and manufacturing processes. Such processes generally exhibit minimal to no difference in unit dimensions and feature characteristics, thereby allowing for precision in product specifications and building structures with such units. Examples of possible manufacturing methods include but are not limited to injection-molding, structural foam molding (e.g. low pressure multi-nozzle structural foam), extrusion, roto-molding, thermoforming, vacuum forming and blow-molding. However, it is noted that any high volume application for production may be utilized in manufacturing the present invention.

The individual units of the present invention are light-weight, aesthetically pleasing, easy to install, prevent shoreline and other terrain erosion and compliment preexisting retaining wall products. Various embodiments of mass confinement cells of the present invention are also waterproof or absorption resistant, can withstand ice damage due to their flexible nature and are easily replaced or repaired in case of damage. Furthermore, the confinement cells of the present invention are rugged and require very low maintenance. Additionally, embodiments of the present invention are easily transportable, storable and installable due to their lightweight and possible stacking and/or nesting features.

As previously suggested, embodiments of the present invention are also resistant to deterioration, such as wear, discoloration, crumbling and breaking. Therefore, the deterioration resistant mass confinement cells do not have to be replaced as often and/or increase the lifespan of the retaining wall or earth retention system. Due to these characteristics, the cells of the present invention generally have a much greater lifespan than the life of a regular dry-cast concrete type block or timber. The increased lifespan of the confinement cells translates to fewer or no occurrences of replacement of individual cells or the potential complete reconstruction of the entire wall. Furthermore, retaining wall materials, such as concrete block formed by the dry cast process, (e.g. Keystone® blocks) and timbers are typically not used in water applications because they dissolve, crumble and/or break down over time and exposure. The durability and deterioration resistant characteristics of the present invention reduce and prevent the structural degradation of this product, thereby making it beneficial for all applications that come in contact with water.

Another advantage of embodiments of the present invention relates to the high cost of waterfront property and people's inclination to improve their property to keep it well-maintained and aesthetically pleasing. As previously mentioned riprap, is commonly stacked along property shorelines to prevent erosion. The trouble with this shoreline preservation application is that rip rap is generally incredibly heavy, thereby making it difficult to install. Furthermore, rip rap will leave many crevices for organic material to reside and, since it is close to water, the crevices are prominent areas for the growth of vegetation.

In addition, many waterfront properties suffer water damage when water levels rise above the shoreline. The mass confinement cells of the present invention are a solution to water retention and erosion problems in such areas of threatening high or rising water levels. Furthermore, the mass confinement cells pose a solution in locations where there is a flood plane or areas that are washed out by any type of water movement. Sandbags have been a solution to such problems, but are not a permanent or aesthetically pleasing solution. The retaining wall cells can replace sand bags in an area for which a more permanent and aesthetically pleasing alternative is desired.

As previously suggested, the deterioration resistant mass confinement cells can be produced in any type of shape, configuration, color and design. In addition each confinement cell may include any design or color located anywhere on one or more panels or walls of the confinement cell.

In summary, the utilization of conventional type materials for retaining walls, such as concrete blocks (wet or dry cast), timbers, rip rap and other wall or revetment construction materials, have caused problems related to their inherent weight, deterioration tendencies and aesthetic deficiencies. Therefore, the present invention provides an aesthetically pleasing, durable and easy to use product for all persons intending to construct a retaining wall or earth retention system.

DETAILED DESCRIPTION OF THE INVENTION

The embodiments of the present invention described below are not intended to be exhaustive or to limit the invention to the precise forms disclosed in the following detailed description. Rather, the embodiments are chosen and described so that others skilled in the art can appreciate and understand the principles and practices of the present invention.

Figure 1:
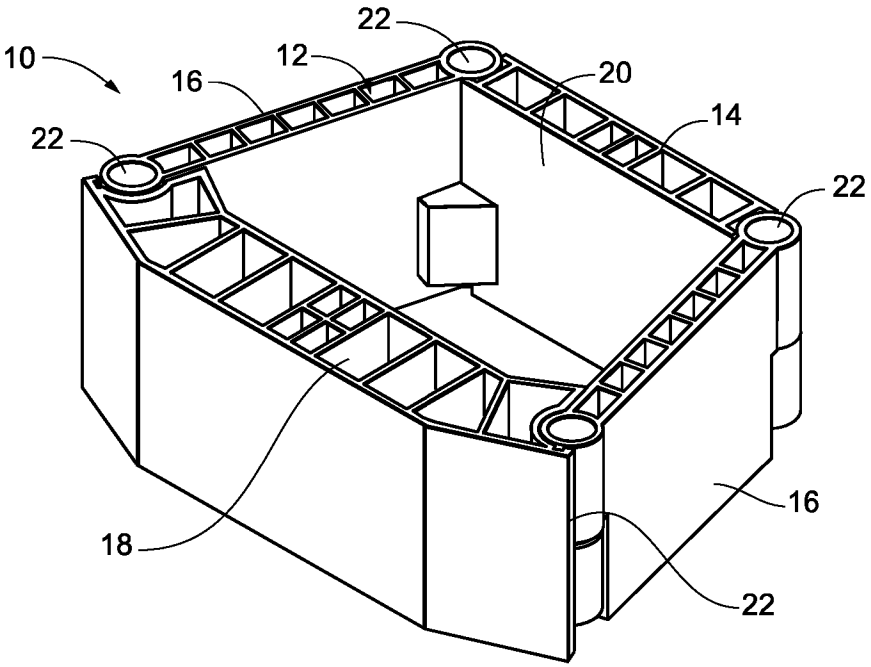
FIG. 1 is a front perspective view of one embodiment of a deterioration resistant mass confinement cell.
Figure 2:
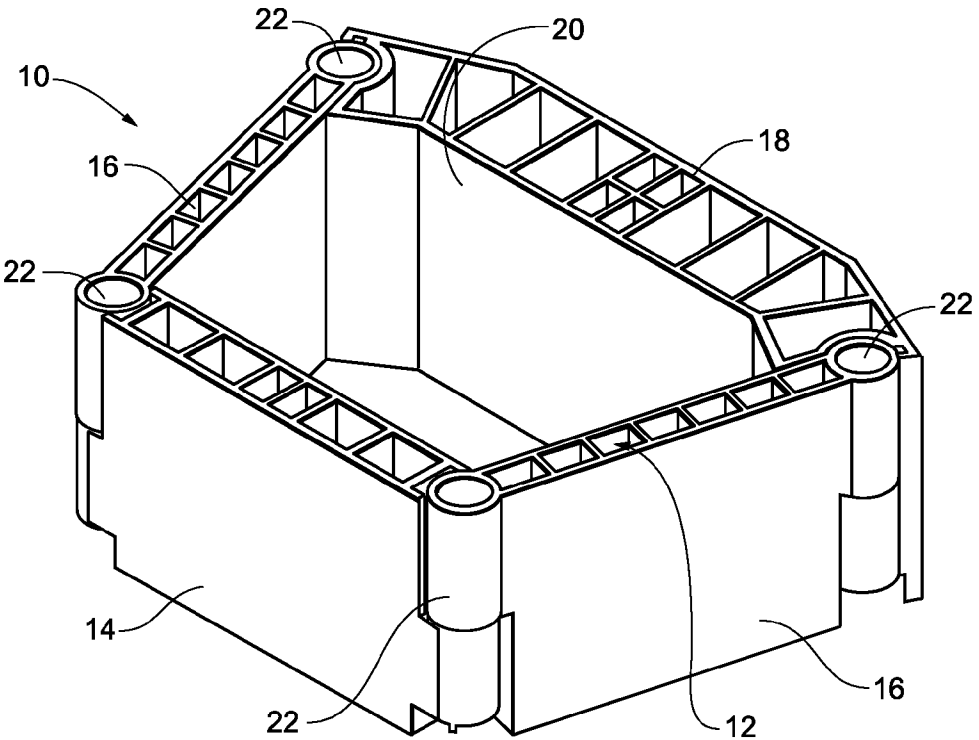
FIG. 2 is a back perspective view of an embodiment of a deterioration mass confinement cell.

FIGS. 1 and 2 depict one embodiment of the deterioration resistant mass confinement cell 10 comprising a frame 12, including a back panel 14 and one or more side panels 16, and a chamber enclosing member 18. In this embodiment of the present invention the enclosing member 18 is a front panel that forms the confinement cell 10 when joined with the frame 12. The side panels 16 of this embodiment operably join the enclosing member 18 to the frame 12 to form the confinement cell 10 having a continuous flow chamber 20. The continuous flow chamber 20 is positioned within the frame 12 and enclosing member 18.

It is noted that various embodiments of the mass confinement cell 10 of the present invention include no top panel or a partial top panel and no bottom panel or a partial bottom panel. The assembly of a retaining wall with a plurality of such confinement cells 10, which include an open top and bottom, allows for the flow and/or commingling of fill material from adjacent cells positioned above and/or below through each cell's 10 continuous flow chamber 20. In various embodiments, the bottom panel may include one or more apertures to allow for at least a partial alignment of openings, thereby allowing the flow and commingling of fill material from one confinement cell to cells positioned above and/or below.

Various embodiments of the present invention (e.g. as depicted in FIGS. 1 and 2) are a mass confinement cell that includes a frame 12 and enclosing member 18 having a panel design. Generally, the mass confinement cell 10 of such embodiments include a frame 12 and/or enclosing member 18 having two or more panels that are operably connected with one or more securing mechanisms 22 to join the two or more panels, thereby forming the frame 12 and/or enclosing member 18. In other embodiments, the mass confinement cells 10 require securing mechanisms 22 to join three or more panels to form the frame 12 and/or enclosing member 18. Also, in still other embodiments, the mass confinement cells 10 of the present invention require securing mechanisms 22 to join four or more separated panels to form the frame 12 and/or enclosing member 18. In many of these embodiments, the frame 12 and/or enclosing member 18 include side panels 16 that are operably joined to a front panel 12 and/or back panel 14. In such embodiments, the side panels 16, front panel 12 and back panel 14 may be adjoined with two or more securing mechanisms 22 to form a continuous flow chamber 18 within the mass confinement cell 10.

Figure 3A:
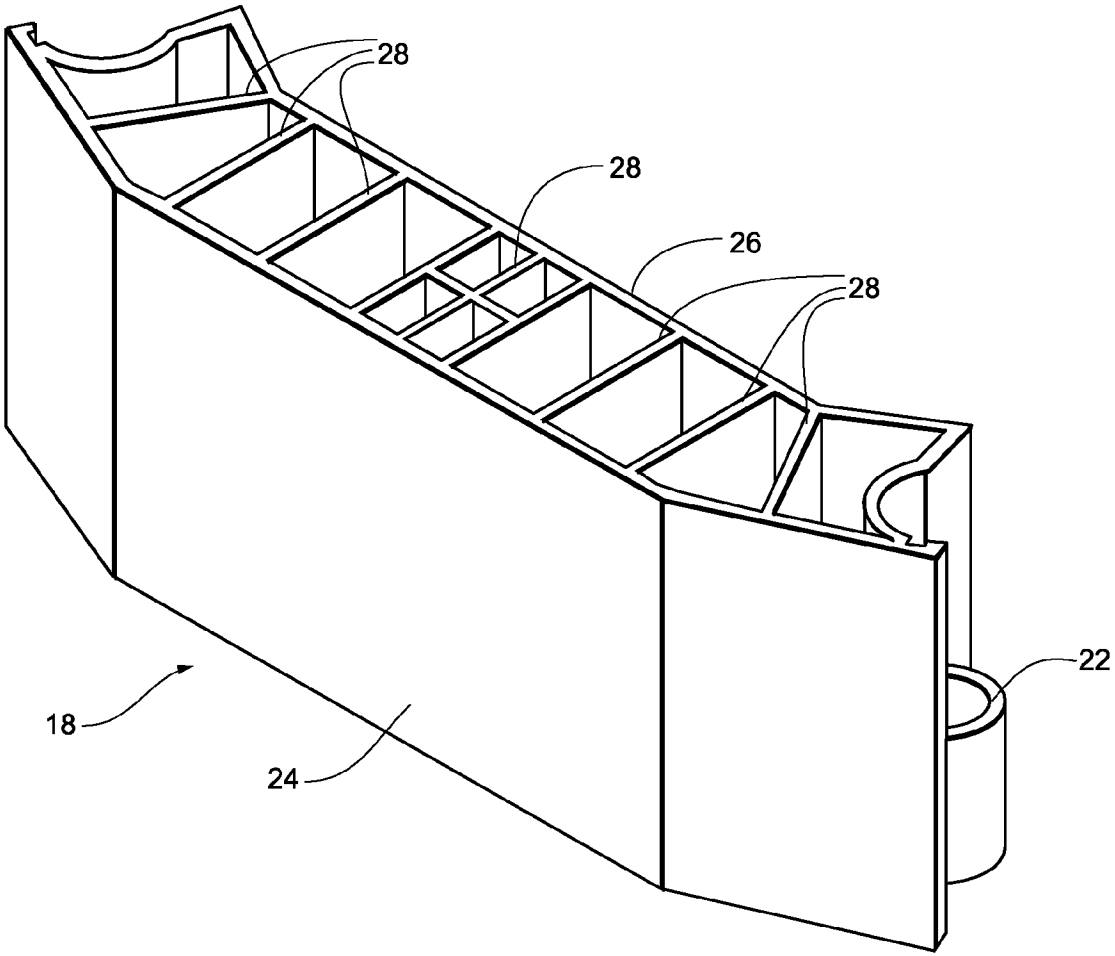
FIG. 3*a* is a front perspective view of an embodiment of a front panel of a deterioration resistant mass confinement cell.
Figure 3B:
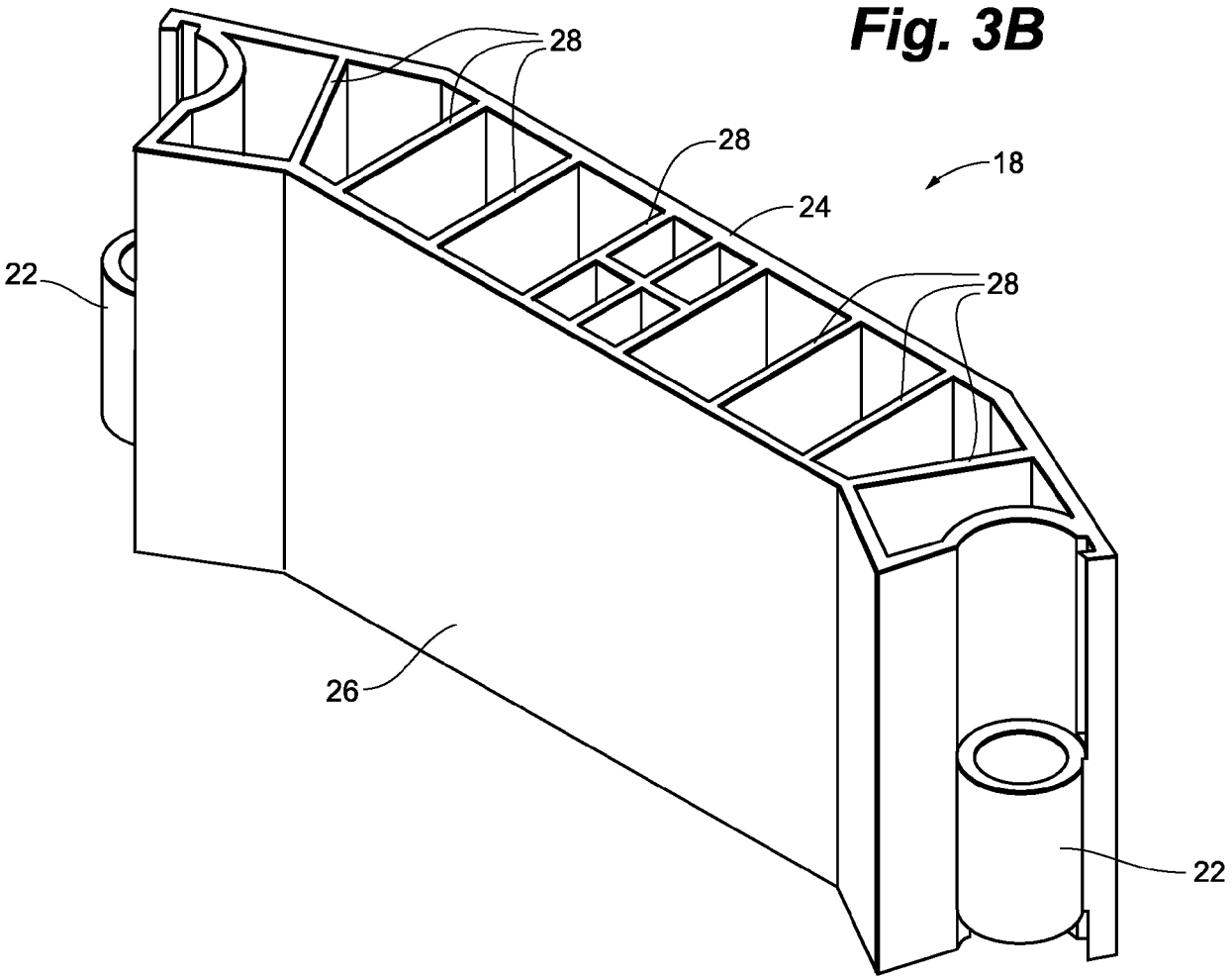
FIG. 3*b* is a back perspective view of an embodiment of a front panel of a deterioration resistant mass confinement cell.

In various embodiment of the present invention, a front panel 24 of the cell 10 may be flat, rounded or beveled. For example, FIGS. 3*a* and 3*b* depicts a chamber enclosing member 18 of the cell 10 as depicted in FIGS. 1 and 2 having a front panel 24. The front panel 24 of this embodiment may include a beveled front having one or more bends, slants or creases in the front panel 12. FIGS. 3*a* and 3*b* depict a beveled front that takes on a tri-panel appearance. It is noted that the front panel 24 may also be rounded, substantially flat or includes positions of relief rather than beveled to provide a more natural appearance.

The enclosing member 18 of this embodiment further includes the front panel 24 and a back surface 26 that are separated by one or more ribs 28 to adjoin and provide support and stability to the front panel 24 and back surface 26. Alternatively, a corrugated or waved ribbing system (not shown) may separate the front panel 24 and back surface 26 rather than straight ribs to provide pressure absorption means to remove the pressure of the fill material on the front panel 24. The enclosing member 18 of this embodiment further includes at least part of one or more securing mechanisms 22. As will be explained further below, the front panel 24 may display an earthen appearance or other color and design that may be molded into the surface or applied to the surface.

Figure 4A:
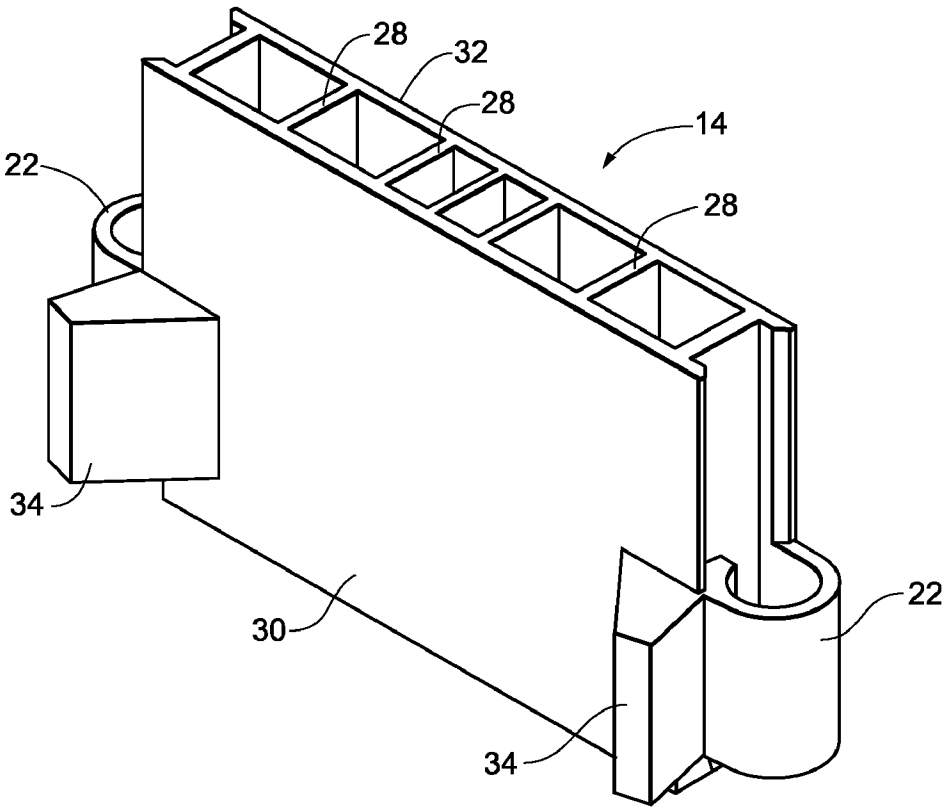
FIG. 4*a* is a front perspective view of an embodiment of a back panel of a deterioration resistant mass confinement cell.
Figure 4B:
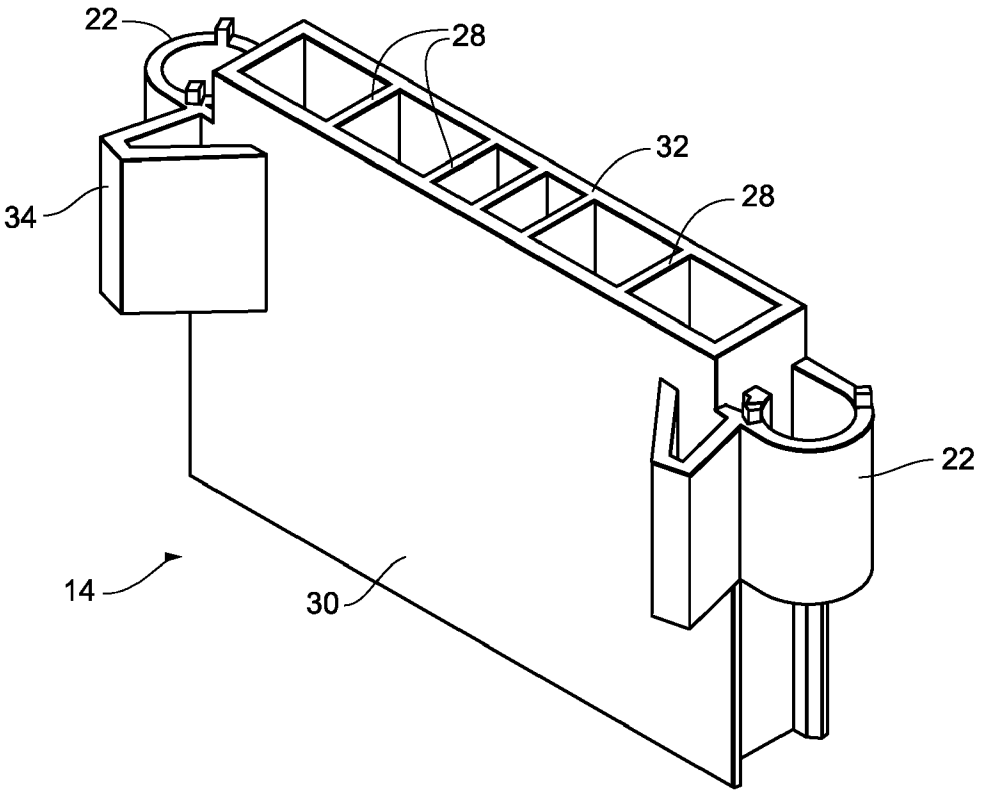
FIG. 4*b* is a front perspective view of an embodiment of a back panel of a deterioration resistant mass confinement cell.

FIGS. 4*a* and 4*b* depict one embodiment of a back panel 14 that includes an inside surface 30 and an outer surface 32 adjoined and separated by ribs 28. The back panel 14 of this embodiment is the back panel of FIGS. 1 and 2. The back panel 14 of this embodiment may also include one or more side panel stoppers 34. The side panel stoppers 34 assist in locating the side panels 16 in position for adjoining the enclosing member 18 to the side panels 16 during assembly of the confinement cell 10. FIGS. 4*a* and 4*b* further depict the sockets of one or more securing mechanisms 22 that are intended to receive pins or pegs that are intended adjoin the back panel 14 to the side panels 16 of this embodiment.

Figure 5:
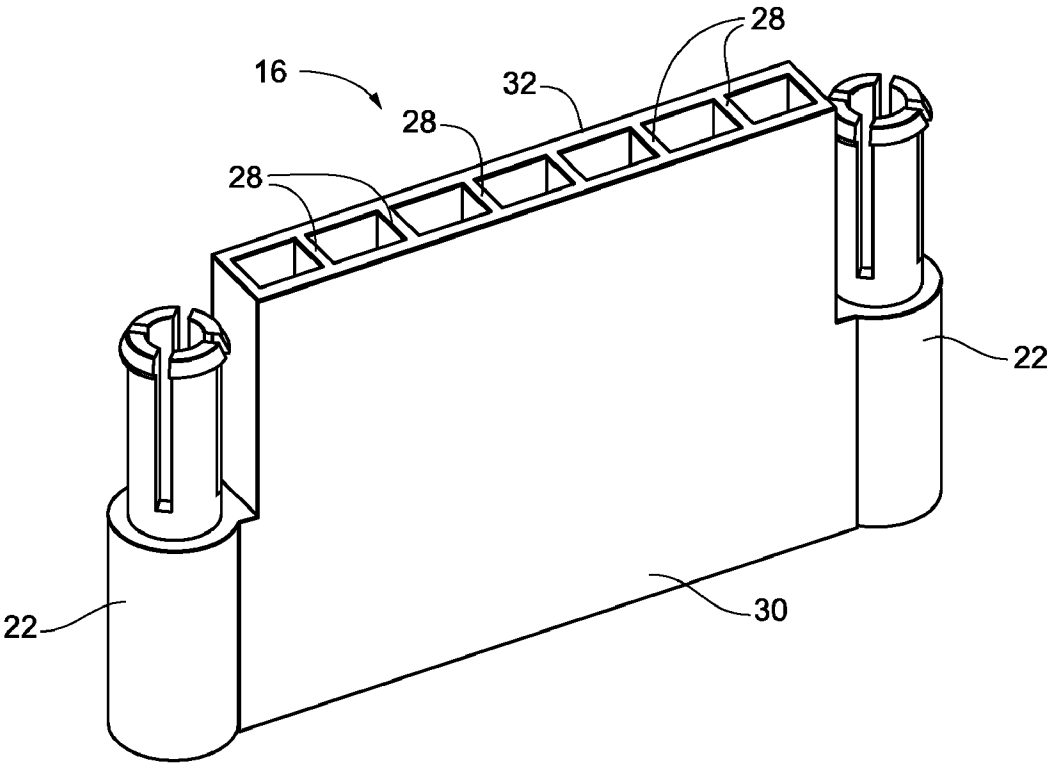
FIG. 5 is a perspective view of an embodiment of a side panel of a deterioration resistant mass confinement cell.

FIG. 5 depicts one embodiment of a side panel 16 of the mass confinement cell 10 illustrated in FIGS. 1 and 2. This side panel 16 includes and inner surface 30 and an outer surface 32, which are adjoined and separated by ribs 28. The side panel 16 of this embodiment also includes pegs of the securing mechanisms 22 that may be inserted into the sockets of the enclosing member 18 and back panel 14. It is noted that the pegs and sockets of the securing mechanisms 22 can be interchanged on any of the panel structures.

Figure 6:
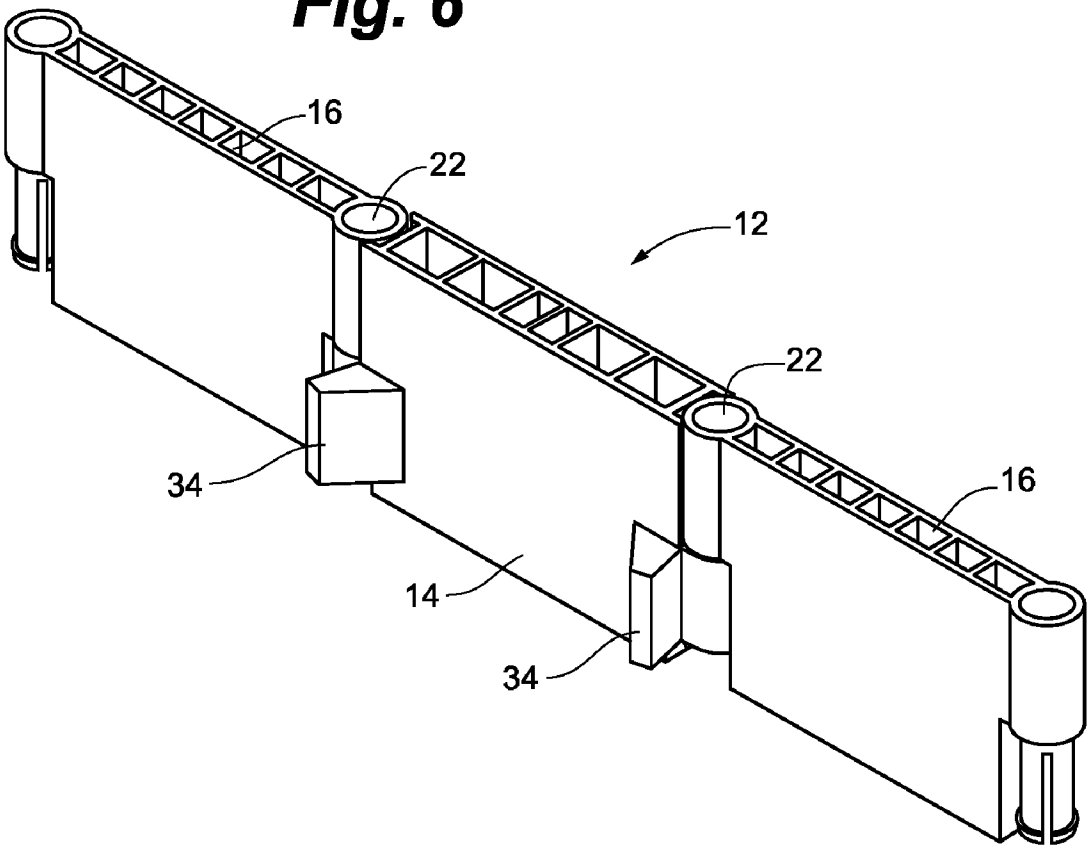
FIG. 6 is a perspective view of one embodiment of an adjoined back panel and side panels of a deterioration resistant mass confinement cell positioned in a flat configuration.
Figure 7:
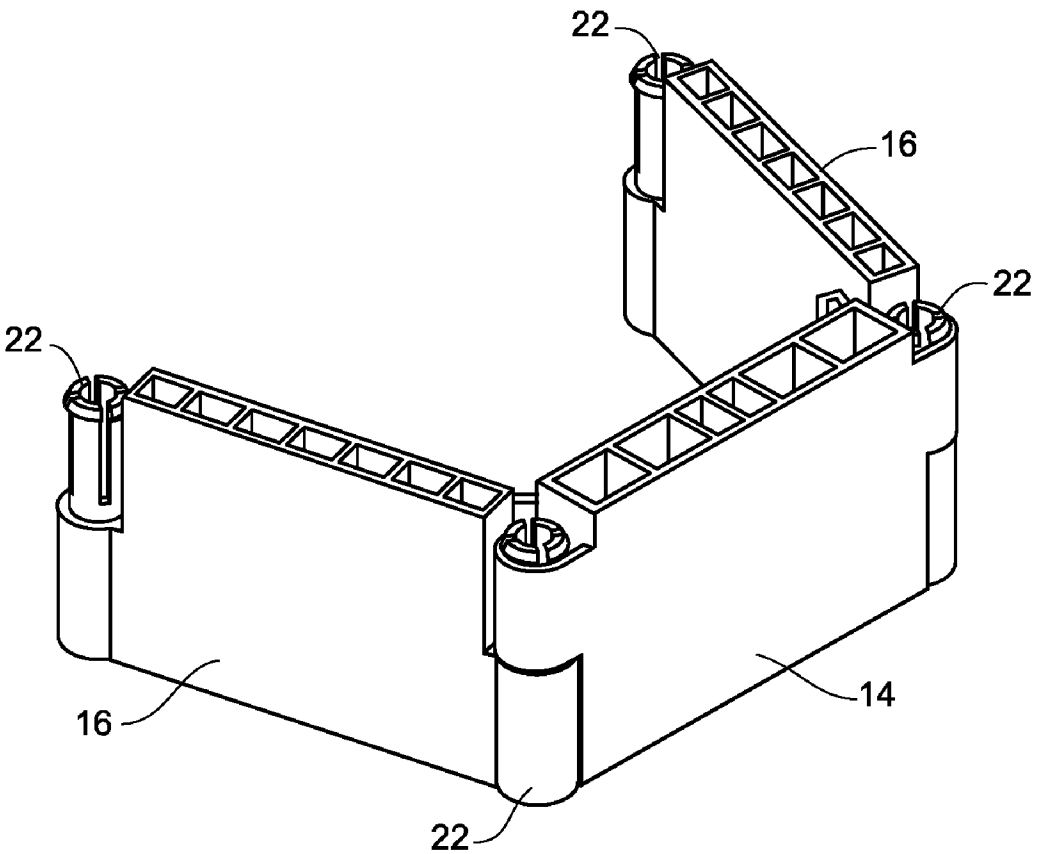
FIG. 7 is a front perspective view of one embodiment of an adjoined back panel and side panels of a deterioration resistant mass confinement cell positioned in a folded assembly configuration.
Figure 8:
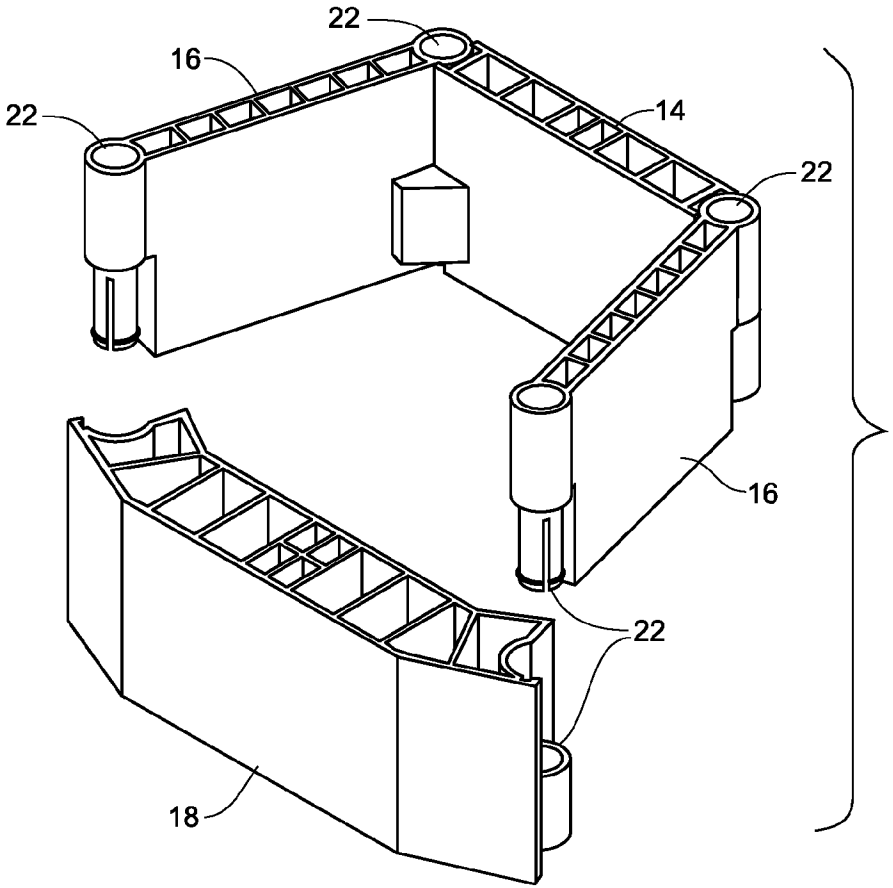
FIG. 8 is an exploded view of one embodiment of a deterioration resistant mass confinement cell.

FIG. 6 depicts one embodiment of a frame 12 of the present invention wherein the side panels 16 are adjoined to a back panel 14. In this embodiment, the side panels 16 and back panel 14 may be secured together with the securing mechanisms 22 so as to allow for the side panels and back panel to at least partially swivel on the securing mechanisms 22. Such a configuration provides advantages in storage and transportation in that the side panels 16 and back panel 14 can be placed in a flattened configuration as depicted in FIG. 6 and then angled upon assembly as depicted in FIG. 7. It is noted that in various embodiments the front panel 12 may also be secured to one of the side panels 16 and placed in the flattened configuration for storage and transportation or may be a separate component that is adjoined upon assembly as is depicted in FIG. 8. Alternatively, a stabilizing partition (not shown) may be adjoined to a side panel 16 when the block 10 is in a flat configuration. Upon assembly, the stabilizing partition may be adjoined to the other side panel 16 to form the chamber 18. Once the chamber is formed the chamber enclosing member 18 may be secured to the side panels 16 to form this embodiment of the confinement cell. Such embodiments allow for the chamber enclosing member 12 to be changed later in time while maintaining the integrity of the wall and maintenance of the fill material within the confinement cell during the replacement process.

The mass confinement cell embodiments depicted in FIGS. 1-9*c* and the other embodiments of the present invention are especially advantageous for mega-cell products of sizes equal to or greater than one foot in height, two feet wide and one foot deep (e.g. at least about 1.5 feet in height, 3 feet wide and 1.5 feet deep or 1 foot in height, 2 feet wide and 1.5 feet deep). Such large confinement cells allow for easy storage and transportation of such mega-cells by allowing them to flatten, thereby decreasing the space needed for large numbers of cells.

Figure 9A:
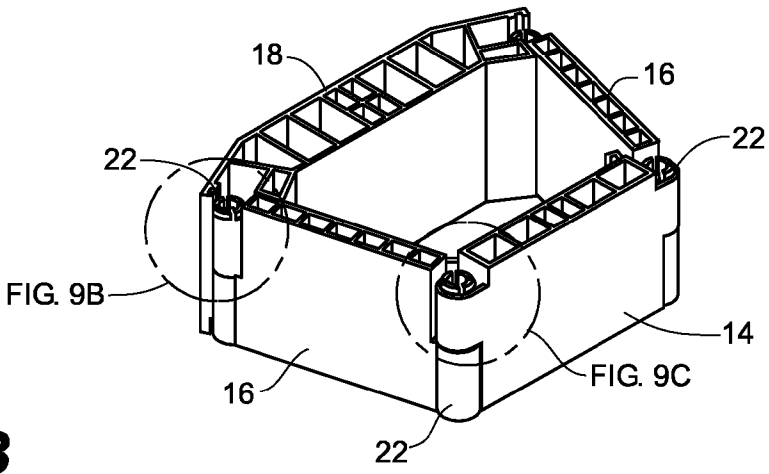
FIG. 9*a* is a perspective view of an embodiment of a deterioration resistant mass confinement cell including a peg and socket securing mechanism.
Figure 9C:
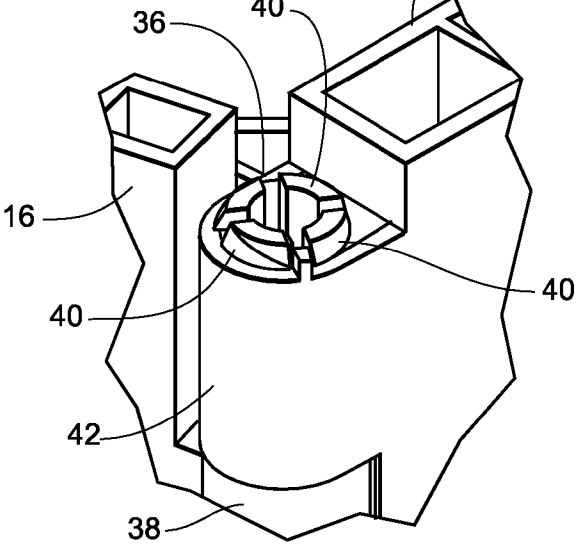
FIG. 9*c* is a perspective view of the Detail B peg and socket securing mechanism of FIG. 9*a*.
Figure 9B:
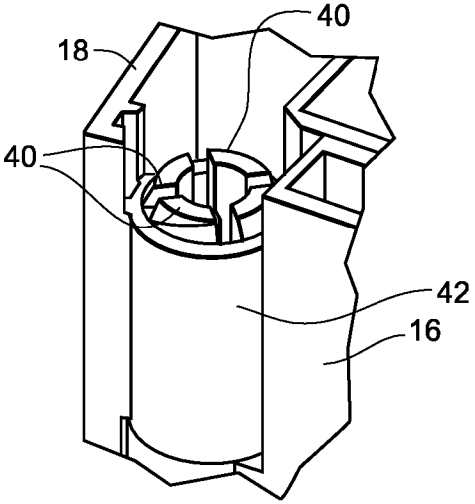
FIG. 9*b* is a perspective view of the Detail A peg and socket securing mechanism of FIG. 9*a*.

As previously mentioned, various embodiments of the mass confinement cell 10 generally include one or more securing mechanisms 22 that provide a sufficient means for securing the separated panels to each other. A sufficient means is generally one wherein the securing mechanisms 22 will not release when the force of the fill material is applied to the panels and enclosing member 14, 16, 18 of the mass confinement cell 10. FIGS. 9*a*-9*c* depict one embodiment of a securing mechanism 22 that may be utilized to form one embodiment of a mass confinement cell 10 of the present invention. FIG. 9*a* depicts the embodiment illustrated in FIGS. 1 and 2, wherein the confinement cell 10 includes an enclosing member 18 and back panel 14 adjoined to two side panels 16 with securing mechanisms 22. FIGS. 9*b* and 9*c* depict one embodiment of a securing mechanism 22 utilized to adjoin the panels of the confinement cell 10 of the present invention. In this embodiment, the securing mechanism 22 includes a peg and socket system including a peg 36 having a base 38 and two or more elongated keys 40 extending upward from the base 38. In some embodiments, the keys 40 may include a beveled top that allows for the keys 40 to be inserted into a socket 42 and lock the panels into place when completely inserted.

Other embodiments of securing mechanisms that may be utilized in the present invention include the peg and socket systems (threaded, integrated and non-integrated), T-hook and T-slot, locking snaps, hinges and other mechanisms that would adjoin and secure the panels into the confinement cell configuration. Examples of some securing mechanisms are disclosed or suggested in U.S. application Ser. No. 11/126,546 filed on May 11, 2005, and U.S. Provisional Application Ser. No. 60/707,032, filed on Aug. 10, 2005, the contents of which are incorporated by reference herein.

Figure 10:
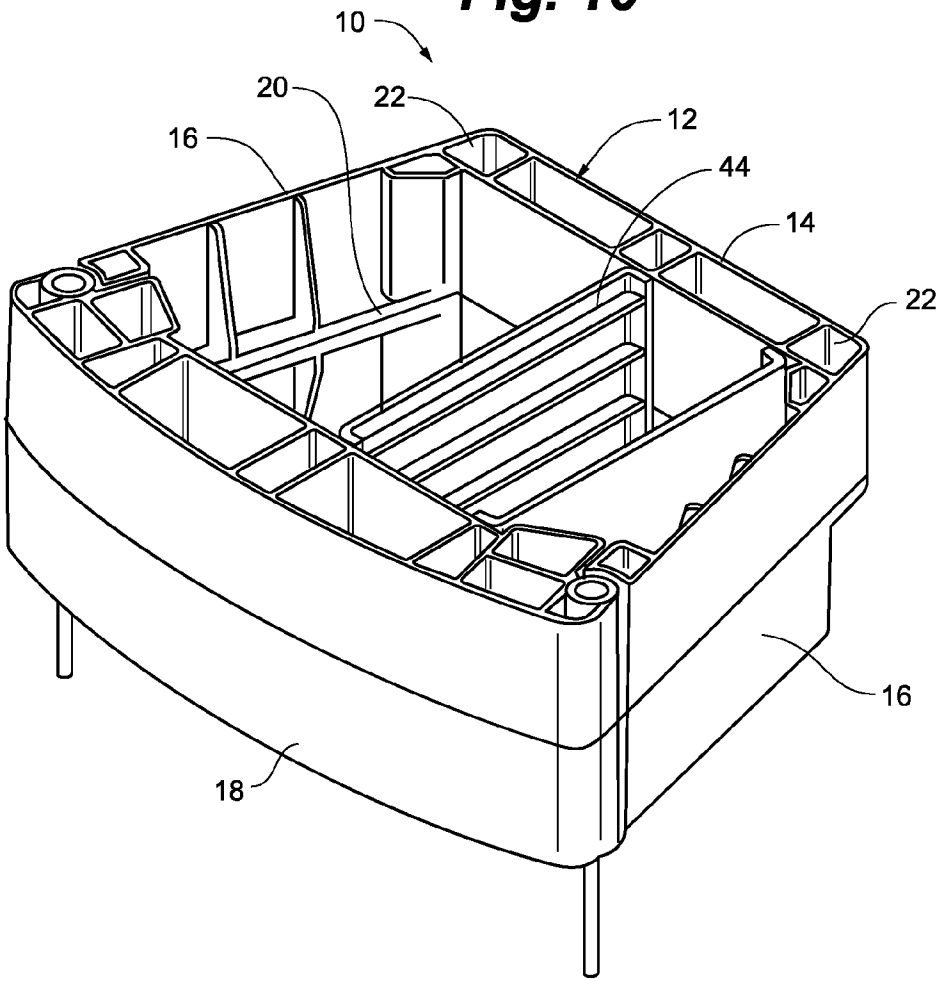
FIG. 10 is a front perspective view of an embodiment of a deterioration mass confinement cell including a peg and socket securing mechanism, stabilizing partitions and anchoring pins.

FIGS. 10 and 11 depict another embodiment of the mass confinement cell 10 of the present invention wherein the cell 10 includes a frame 12 that is adjoined to a chamber enclosing member 18 to form a filling chamber 20. Similar to the embodiments previously described, the frame 12 of this embodiment includes two side panels 16 and a back panel 14 that are hingedly adjoined so as to maneuver to either a flat or assembly position. Such embodiments allow for the back and side panels 14, 16 to be formed in a single part by processes that have manufacturing benefits, such as injection molding, structural foam molding (e.g. low pressure multi-nozzle structural foam), extrusion or thermoforming. However, it is noted that the frame may also be manufactured in other processes that require alternative materials, such as metals and alloys (e.g. steel, aluminum) concrete, ceramics, aluminum or any other material that can form a structurally stable frame. Once the single part back/side or enclosing member/side panel 14, 16 or 18, 16 is provided, it may be adjoined to a molded and/or fabricated enclosing member 18 or a back panel 14 by securing the pieces together with one or more securing mechanisms 22.

The various mass confinement cell embodiments may further include one or more interior partitions 44. The interior partitions 44 may also be utilized to add additional support to the confinement cell 10 to prevent any possible crushing or expansion of the cell 10. FIG. 10 depicts one confinement cell embodiment wherein the interior partition 44 is positioned in the chamber 20 of the cell 10 and is present to define separate chambers that can accommodate filling of each individual chamber 18 with appropriate fill material, such as sand, gravel, crushed rock, pea rock, soil, cement, concrete or any other suitable material. The interior partitions 44 may be secured to the front panel 12, back panel 14 or to the two side panels 16 utilizing one or more securing mechanisms (e.g. peg and socket systems, T-hook and T-slot systems, panel slot systems and other securing means). Alternatively, the interior partitions may be secured to the opposing panels utilizing other adjoining means, such as screws, rivets, hooks, adhesives or any other materials to adequately adjoin the opposing panels.

Figure 11A:
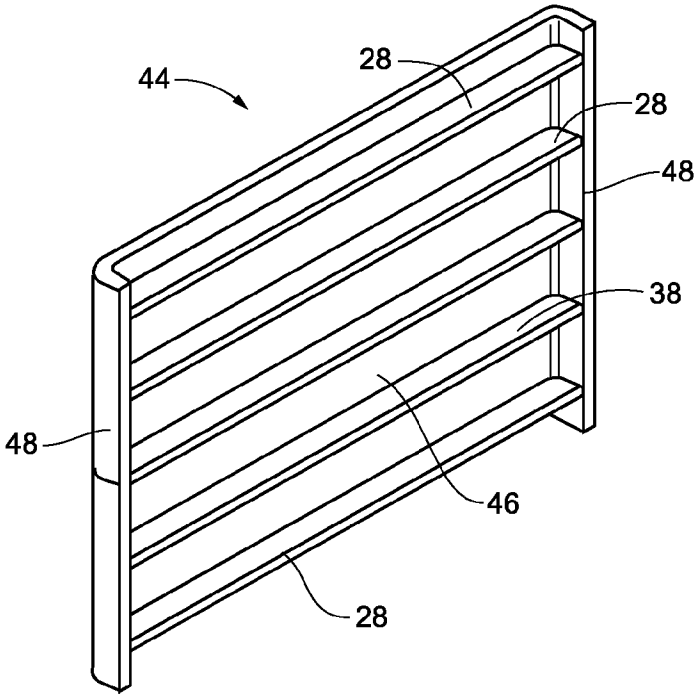
FIG. 11*a* is a front perspective view of one embodiment of a stabilizing partition.
Figure 11B:
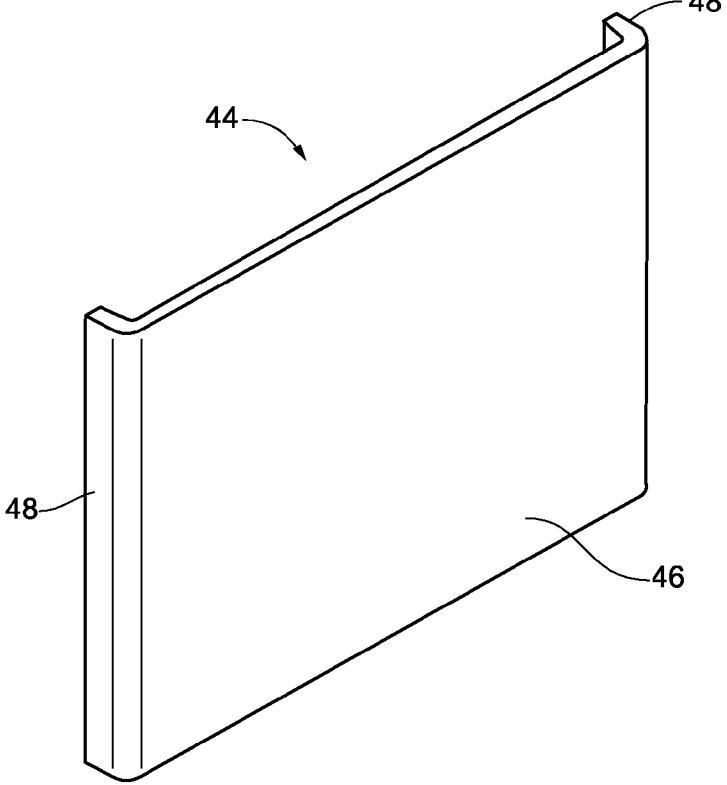
FIG. 11*b* is a back perspective view of one embodiment of a stabilizing partition.

FIGS. 11*a* and 11*b* depict interior and exterior views of one embodiment of an interior partition. The interior partition 44 of this embodiment generally includes a sheet 46 having panel attachments 48 at each end that can butt against and accommodate securing of the partition to a panel. As previously mentioned, any securing or adjoining means may be utilized to adjoin the interior partition 44 to the enclosing member 18, back panel 14 or side panels 16. To further stabilize the interior partition 44, the partition 44 may also include one or more ribs 28 that extend between the panel attachments 48 or extend from the top to the bottom of the interior partition 44 in a vertical direction.

Additionally, multiple chambers 20 and partitions 44 also allow for the mass confinement cell 10 to be cut into various shapes or into partial cells and still maintain a chamber 20 that can receive and retain fill materials. The ability to cut the retaining cells 10 and still retain the same features is particularly useful in preparing ends and awkward segments of retaining walls. In one embodiment, a confinement cell 10, as depicted in FIG. 10, may be cut to a desired width, and adjoined with a partition 44 positioned on the enclosing member 18 and back panel 14 to thereby secure the enclosing member 18 to the back panel 14 of the cell 10 at approximately the points where they were cut.

Figure 12:
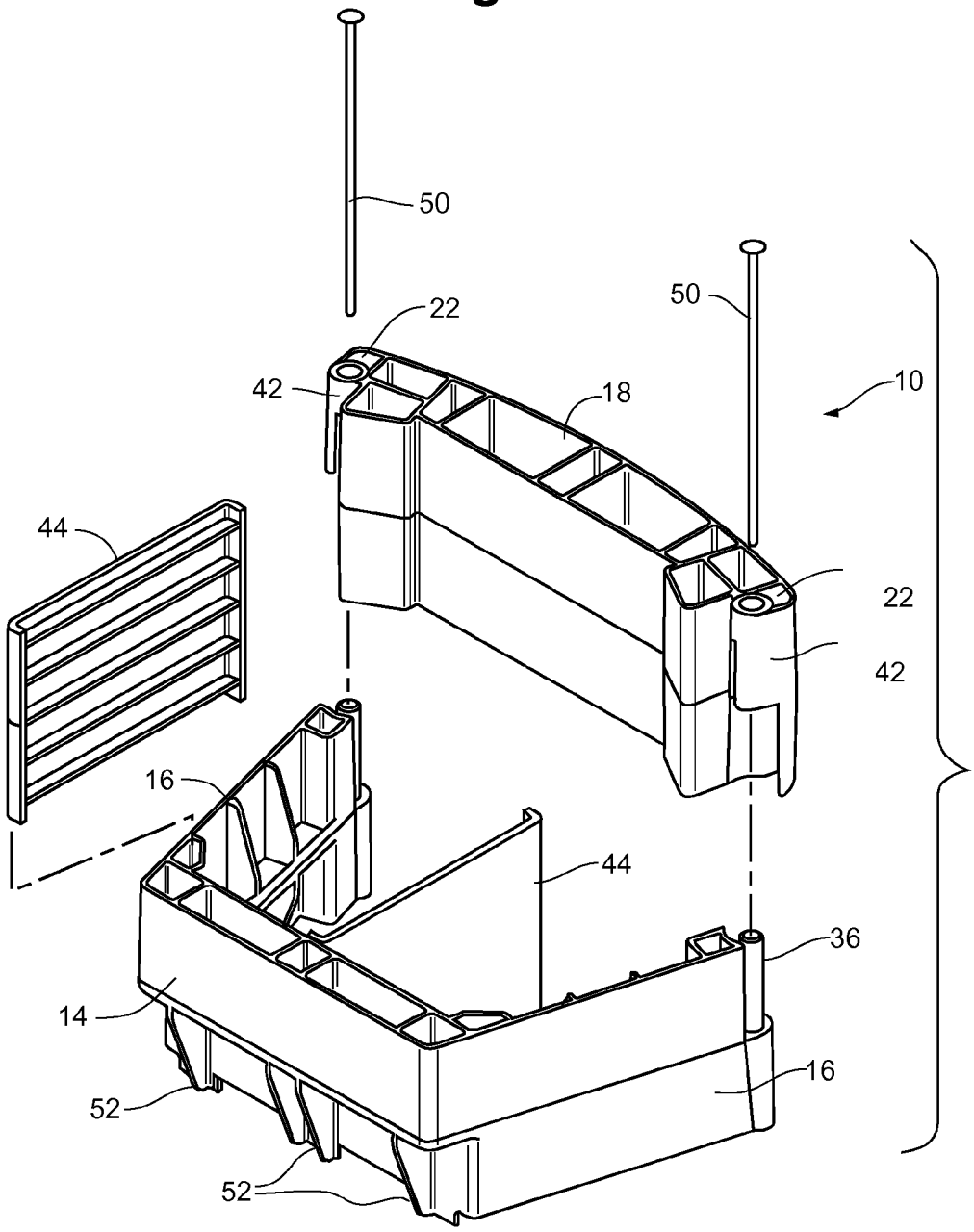
FIG. 12 is an exploded front view of one embodiment of a deterioration resistant mass confinement cell including a peg and socket securing mechanism, stabilizing partitions and anchoring pins.

FIG. 12 depicts an exploded view of the mass confinement cell of FIG. 10, thereby illustrating the assembly of this embodiment of the present invention. In this embodiment, the enclosing member includes two sockets 42 that are adapted to accept two pegs 36 that are adjoined to the two side panels 16. In some embodiments, the pegs 36 may be polygonal in shape and the socket 36 circular in shape to thereby enhance the attachment of the enclosing member 18 to the frame 12 when the pegs 36 are inserted into the sockets 36. Furthermore, one or more partitions 44 may be positioned in the cell 10 to added additional stability to the confinement cell or to provide an outer panel when cutting.

The various embodiments of the present invention may also include one or more pins 50 that may be inserted into apertures in the securing mechanism 22 or slots (not shown) positioned anywhere on the confinement cell to further secure the cell into position in a retaining wall and also may secure the confinement cell to geogrid that is positioned between the rows of cells in a wall. FIG. 12 depicts one embodiment of the pins 50 that may be utilized with the present invention.

Figure 13:
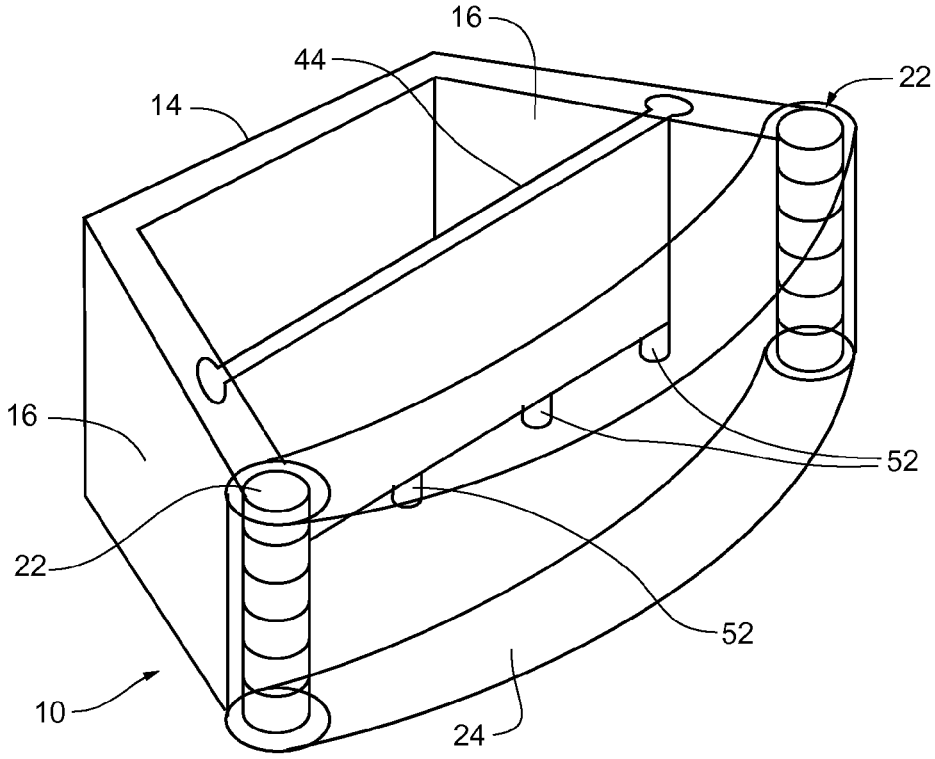
FIG. 13 is a front perspective view of one embodiment of a deterioration resistant mass confinement cell including a stabilizing partition.

The various mass confinement cell embodiments of the present invention may further include one or more positioning flanges or setting extensions 52 as depicted in FIG. 12. On a constructed wall, each retaining flange or setting extensions 52 are wall retention devices that operate to assist in placing the confinement cell in the proper position during wall assembly and also inhibits outward movement of the wall once constructed. Normally, the retaining flange or setting extensions 52 extend downward from the back of the back panel 14 and rest against the back of the mass confinement cell or cells 10 located below. In other embodiments, the flange or setting extensions 48 may also extend downward from the enclosing member or front panel 18, side panels 16 or an interior partition 44. FIG. 13 depicts one embodiment wherein the setting extensions 52 extend downward from the partition 44. The retaining flange or setting extension 52 may be a unitary piece extending downward or upward from the mass confinement cell 10 or a series of fingers extending downward or upward from the confinement cell 10. It is also noted that the setting extensions 52 may further be utilized to anchor the confinement cell into the fill material below, thereby inhibiting movement of the cell upon filling.

As previously disclosed in FIG. 13, various embodiments of the present invention may include a stabilizing partition 44 that may be utilized to further stabilize the cell structure, take pressure off of the front panel caused by the packed fill material and also provide a divider so that different fill materials may be added to the same cell 10 (e.g. a packing material toward the back of the confinement cell and a planting fill material in the front of the cell). In some embodiments, as previously mentioned, the partition 44 may include peg extensions 52 that operate as a cell positioning and securing means when constructing a retaining wall. The peg extensions 52 may be placed anywhere on the partition 44 including the ends and/or dispersed along the bottom edge of the partition 44. In construction of a wall, the peg extensions 52 may butt up against one or more partitions present in blocks positioned below, thereby holding the confinement cell 10 in position and providing an indication of proper positioning of the cell 10. It is noted that the peg extensions 48 may be included on the front panel 24, back panel 14 or side panels 16 rather than or in addition to the partition 44 so as to butt up against the front panel 24, back panel 14 or partitions 44 of the confinement cells positioned below.

In another embodiment of the present invention, as depicted in FIGS. 14-18B, the deterioration resistant mass confinement cell 10 comprises a frame 12, including a front panel 24 operably adjoined to one or more side panels 16, a chamber enclosing member 18 and a fascia 54. In various embodiments, the frame 12 is folded into an assembly configuration and the enclosing member 18 is next secured to the one or more side panels 16, thereby joining the front panel 24 and enclosing member 18 to form a confinement cell 10 having a continuous flow chamber 20. The continuous flow chamber 20 is positioned within the frame 12 and enclosing member 18.

Similar to the embodiments depicted in FIG. 1, the mass confinement cells, of this embodiment, include no top panel or a partial top panel and no bottom panel or a partial bottom panel. When a plurality of confinement cells 10 are positioned in proximity to each other in a wall structure, the open top and bottom allows for the flow and/or commingling of fill material from one cell to adjacent cells above and/or below through the continuous flow chambers 20.

The mass confinement cell 10, as depicted in FIGS. 14-18B, includes two or more side panels 16 that are operably adjoined with the front panel 24 and enclosing member 18 by one or more securing mechanisms 22, thereby forming the mass confinement cell 10. It is noted that the mass confinement cell 10 may require securing mechanisms 22 to join three or more panels, or four or more panels, to form the mass confinement cell 10 of the present invention.

In various embodiments of the present invention, the front panel 24 of the cell 10 may be flat, rounded or beveled to accommodate molding or fabrication (e.g. lamination, painting, U.V. Coating) to provide the desired earthen appearance or aesthetic design. However, in other embodiments a fascia 54 may be secured to the front panel 24 to provide the desired appearance. It is noted that in various embodiments of the present invention, the front panel 24 or fascia 54 may also be beveled, rounded, substantially flat or include positions of relief to provide a more natural appearance.

Figure 14:
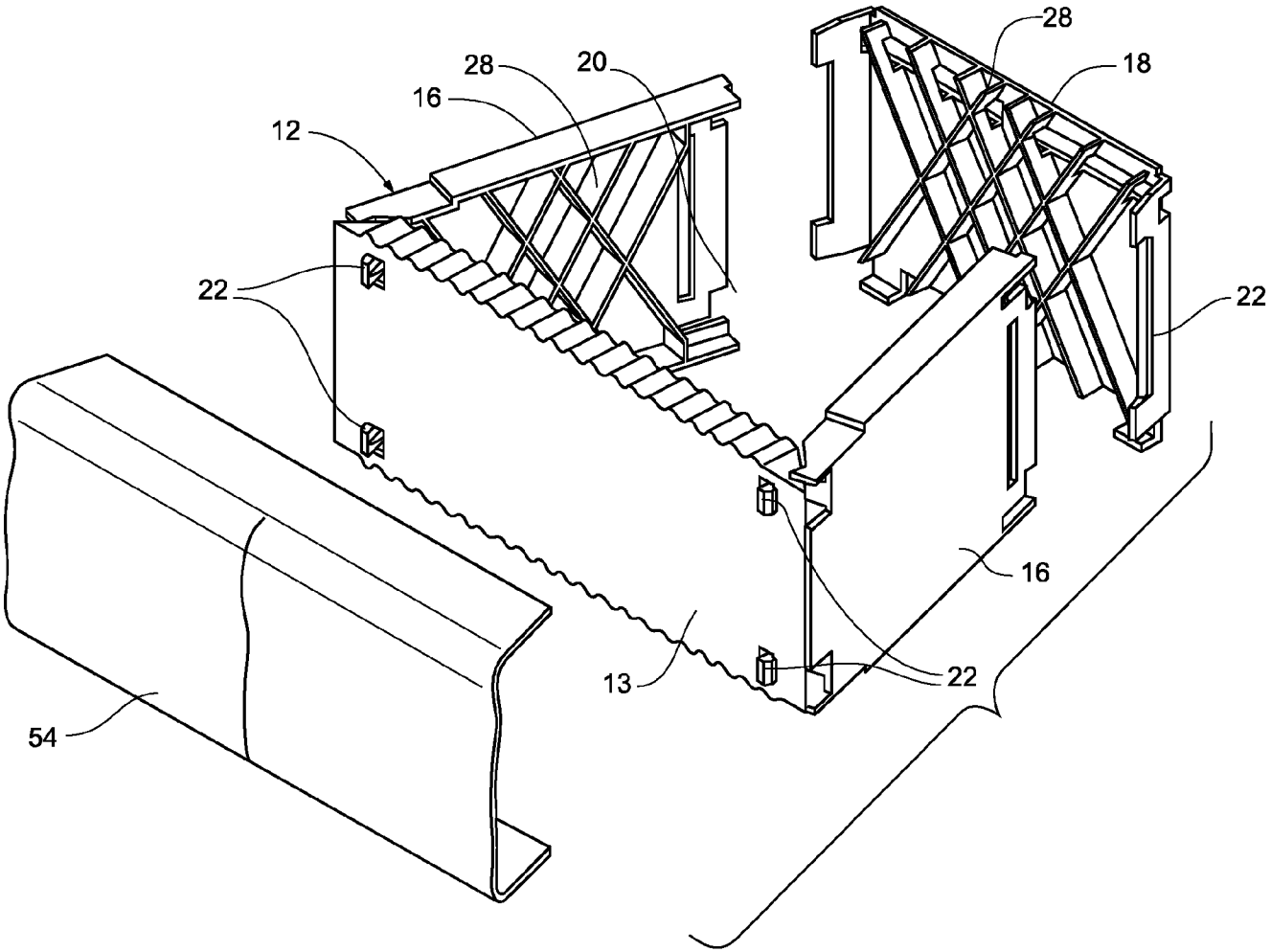
FIG. 14 is an exploded view of one embodiment of a deterioration resistant mass confinement cell including a frame, enclosing member and fascia.
Figure 15A:
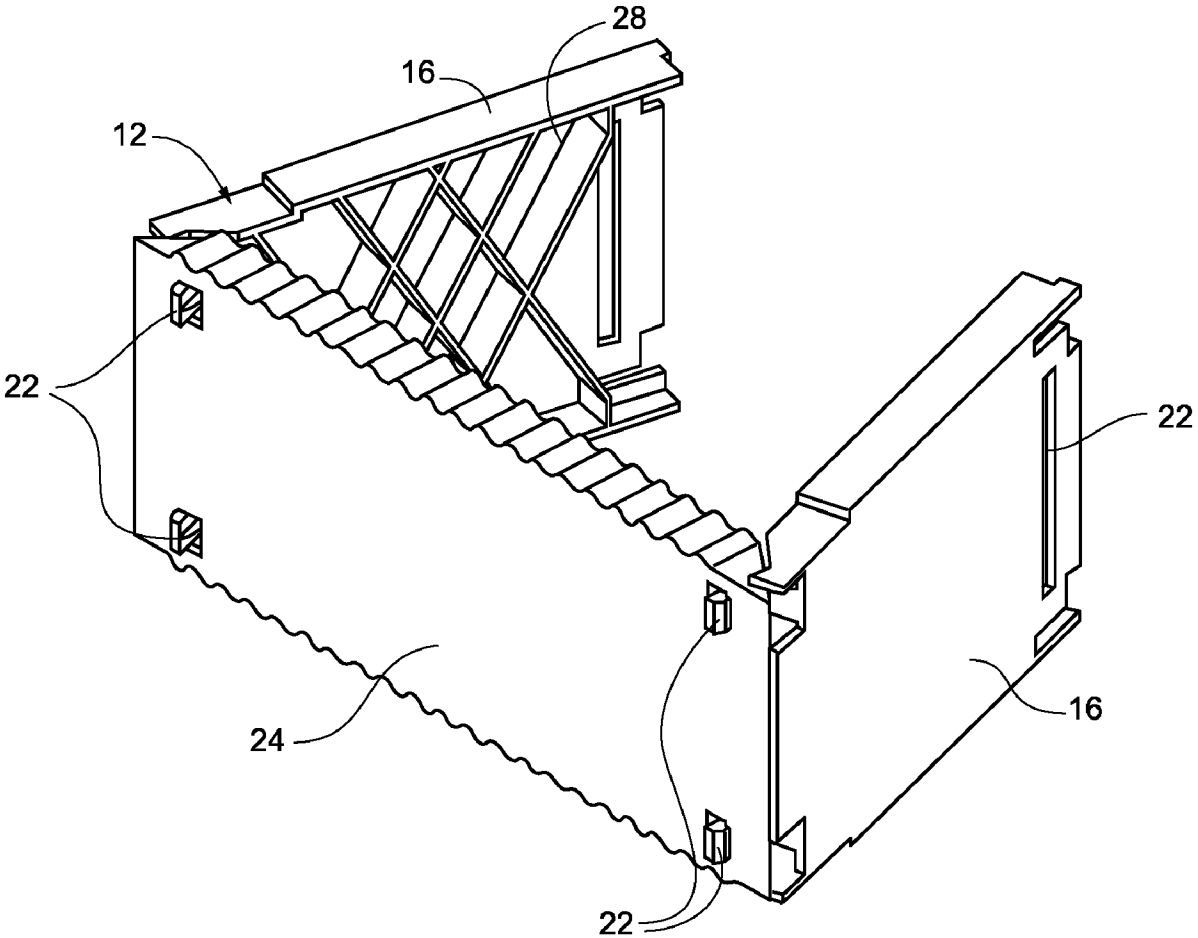
FIG. 15*a* is a front perspective view of an embodiment of the frame of the deterioration resistant mass confinement cell of FIG. 14 in a folded assembly position.
Figure 15B:
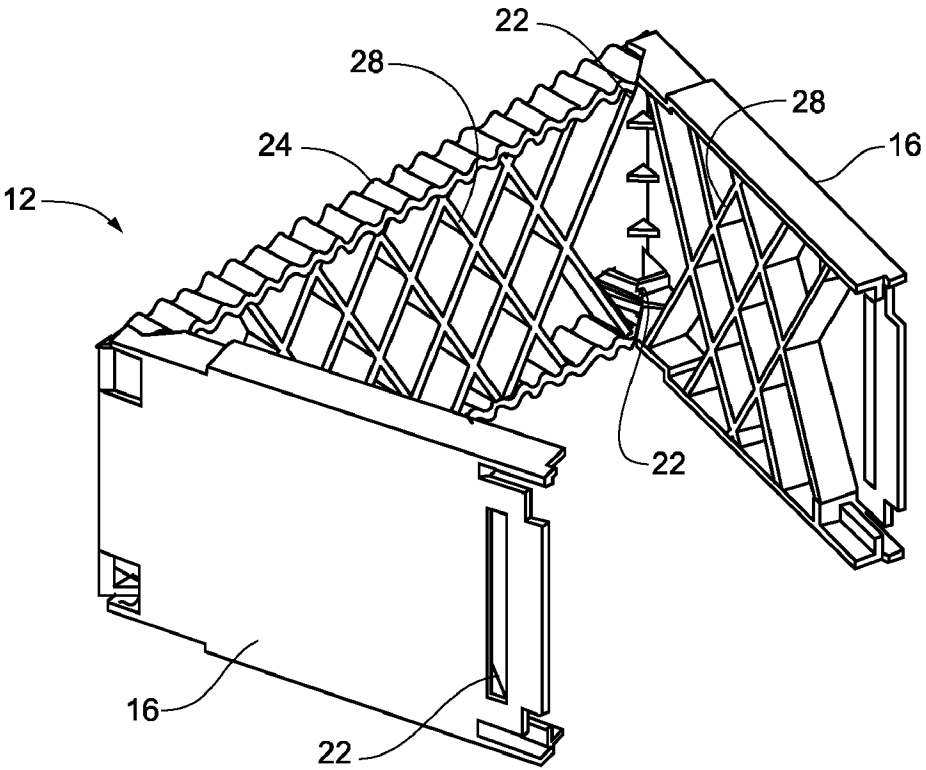
FIG. 15*b* is a back perspective view of an embodiment of the frame of the deterioration resistant mass confinement cell of FIG. 14 in a folded assembly position.
Figures 16A, 16B, 16C, 16D:
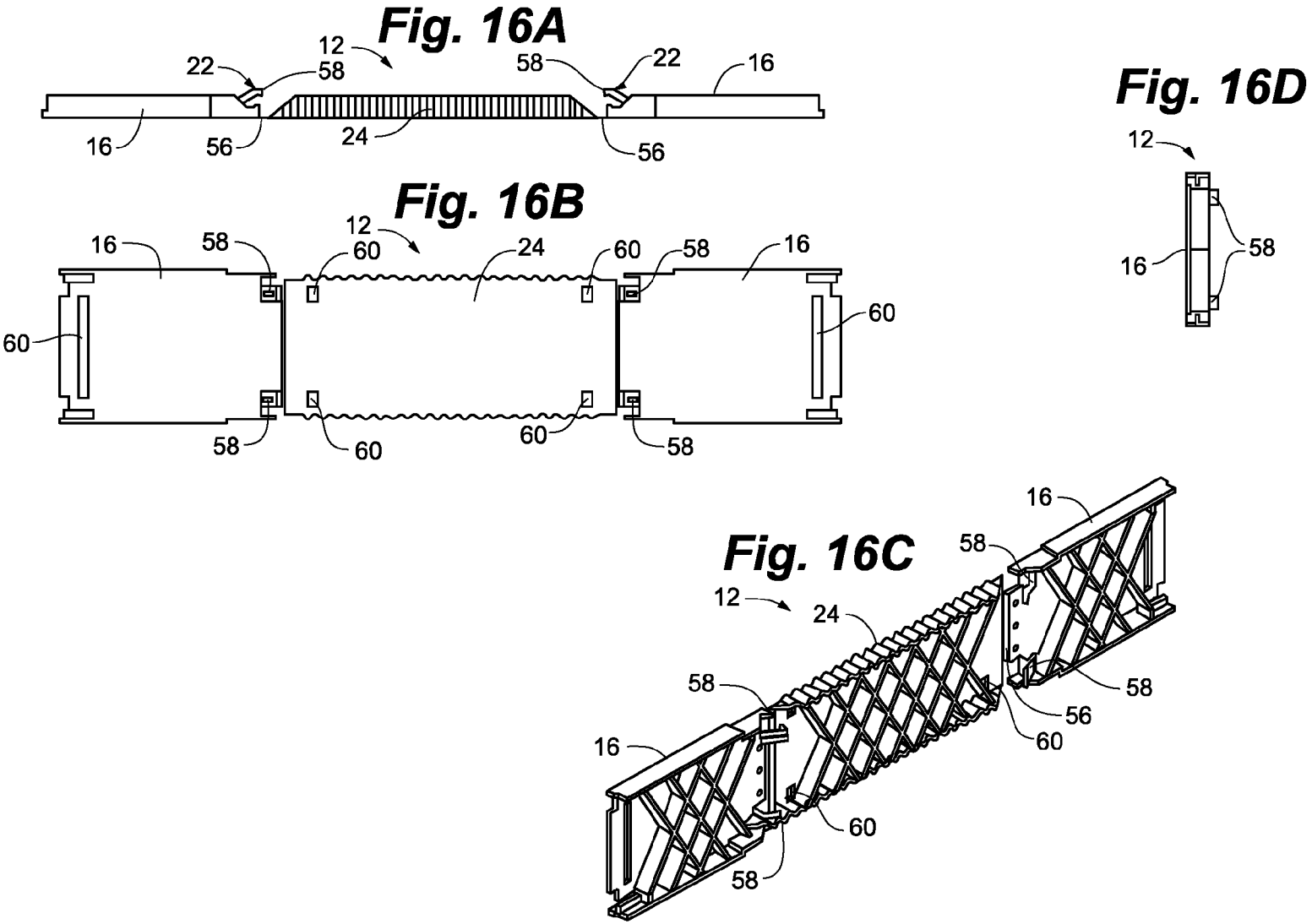
FIGS. 16A-D are top, front, back perspective and side views of an embodiment of the frame of the deterioration resistant mass confinement cell of FIG. 14 in a flat configuration.

As depicted in FIGS. 14 and 15A-B, the front panel 24, side panels 16 and enclosing member 18 of this embodiment generally include one or more ribs 28 on the back side to provide additional support and stability. It is noted that the ribs 28 may be positioned on the front side of the panels 24, 16 or enclosing member 18 to provide the enhanced support and stability. As previously mentioned, the front panel 24 further includes at least part of one or more securing mechanisms 22. As will be explained further below, the front panel 24 or fascia 54 generally will display an earthen appearance or other design that may be molded into the front or exposed surface or the appearance or design may be fabricated or applied to the surface in a secondary operation.

Similar to the embodiment of FIG. 1, the frame 12 may be transported in a flat configuration. FIGS. 16A-16D depict an embodiment of the frame 12 that is positioned in a flat configuration. In such embodiments, one or more of the side panels 16 are adjoined to the front panel 24 or back panel (not shown) with one or more securing mechanisms 22. In this embodiment, the side panels 16 are adjoined to the front panel 24 with living hinges 56, which comprise a thin flexible plastic (e.g. HDPE) that can bend into position without breaking when folding the frame 12 in assembly position to secure the enclosing member 18.

As previously mentioned, various embodiments of the mass confinement cell 10 depicted in FIG. 14 include one or more securing mechanisms 22 having snaps 58 that rigidly secure the side panels 16 to the front panel 24 when folded into assembly position. The snaps 58, in this embodiment, are attached to the side panels 16 to engage and lock the front panel 24 and side panels 16 into assembly position. These panels 24, 16 are engaged and locked by passing the snaps 58 through snap apertures 60, which are located on the front panel 24. Other securing mechanisms may be utilized in these embodiments, some of which are identified within.

Figure 17A:
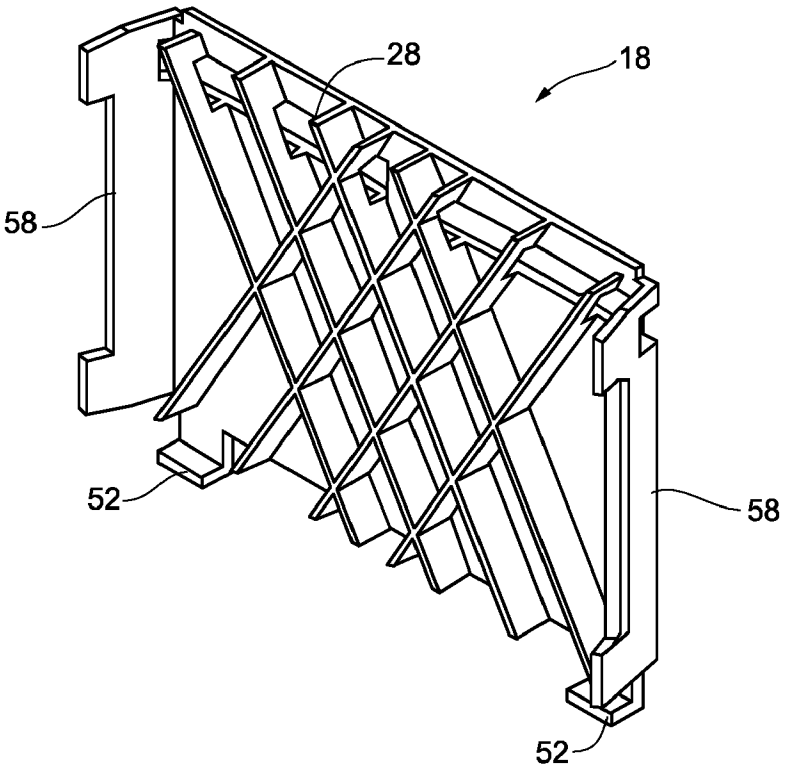
FIG. 17A is a front perspective view of an embodiment of an enclosing member of the deterioration resistant mass confinement cell of FIG. 14.
Figure 17B:
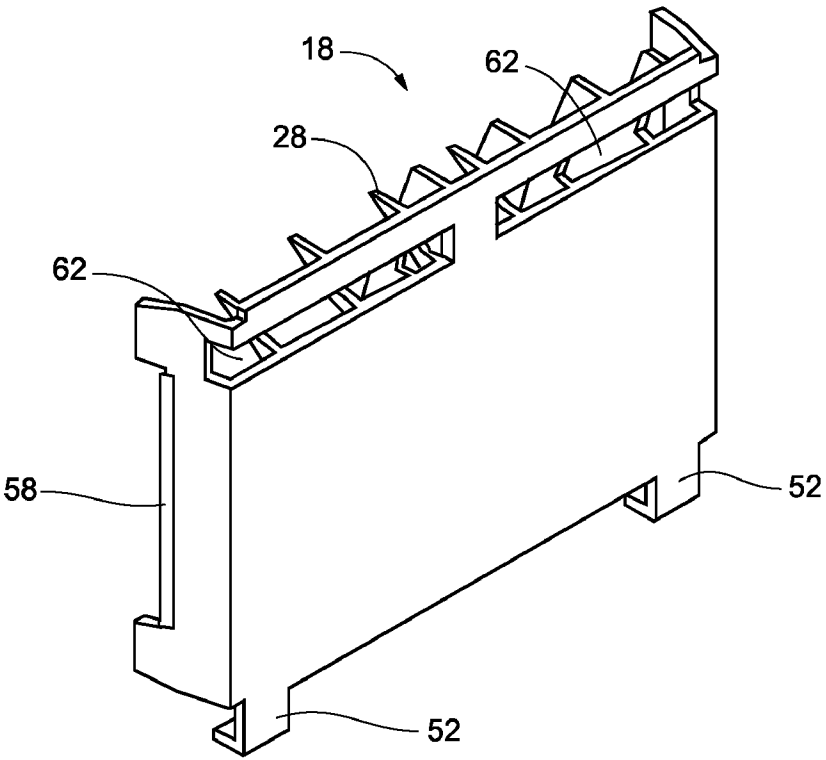
FIG. 17B is a back perspective view of an embodiment of an enclosing member of a deterioration resistant mass confinement cell of FIG. 14.

FIGS. 17A and 17B depict one embodiment of a chamber enclosing member 18 that may be secured to the frame 12 of FIGS. 16A-16D. The enclosing member 18 may include ribs 28 that can be positioned on the front or back of the enclosing member to provide additional stability. In this embodiment, the enclosing member 18 further includes a securing mechanism 22 that is a larger snap 58 that may be inserted into an aperture 60 positioned on the side panels 16 when securing the enclosing member 18 to the frame 12.

Various embodiments of the enclosing members 18 further include one or more anchoring devices that may be utilized to position and secure each cell 10 when assembling a wall and may also function to reduce or prevent overturn of the cells upon filling and compacting the fill material. One embodiment of such anchoring devices is depicted in FIG. 17B in the form of peg extensions 52. In this embodiment, the peg extensions 52 are designed to fit in one or more peg extension slots or ridges 62 positioned on the two cells 10 located below when constructing a wall, revetment or other earth retention system.

Figure 18A:
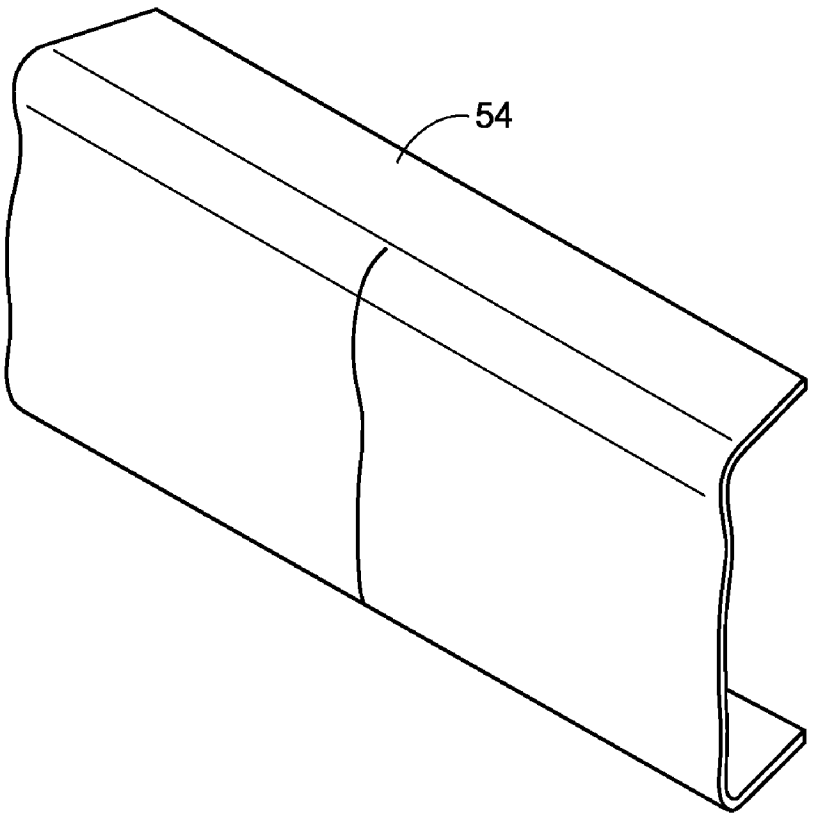
FIG. 18A is a front view of one embodiment of a fascia that may be utilized with the deterioration resistant cells of the present invention.
Figure 18B:
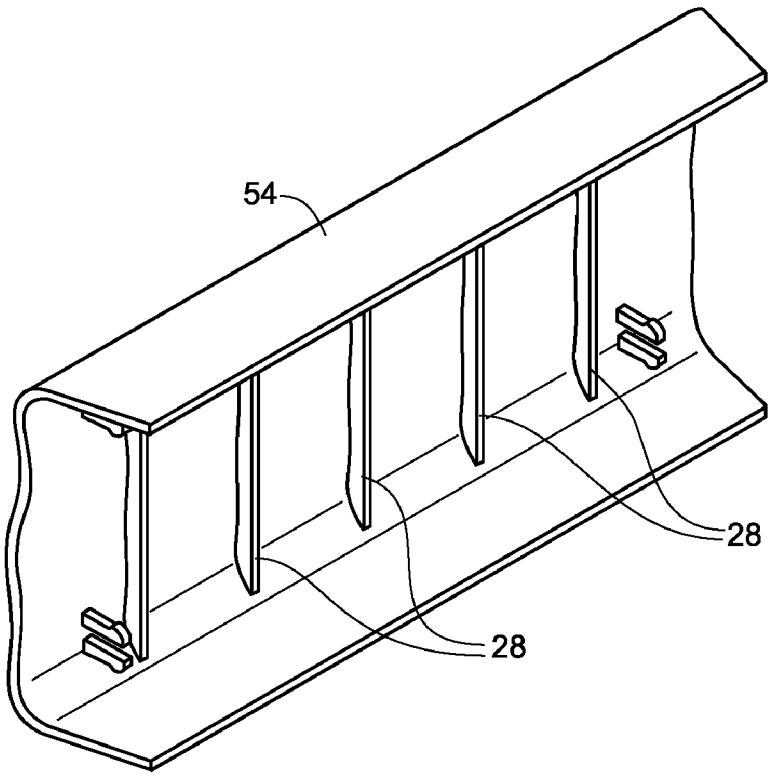
FIG. 18B is a back view of one embodiment of a fascia that may be utilized with the deterioration resistant cells of the present invention.

Embodiments of the present invention may include one or more fascia that is adjoined to the frame or enclosing member to provide the desired appearance or design. FIGS. 18A and 18B depict one embodiment of a fascia 54 that may be utilized with the confinement cells of the present invention. Further explanation of fascia design will be discussed below.

It is further noted that the mass confinement cell embodiments depicted in FIG. 14 may further include a load cell positioned within the front panel 24, side panels 16 and enclosing member 18. A further description load cell embodiments is described below.

The mass confinement cell embodiments depicted in FIG. 14 is also especially advantageous for mega-cell products of sizes equal to or greater than one foot in height, two feet wide and one foot deep (e.g. greater than one-two feet in height, two-four feet wide and one-two feet deep). Such large confinement cells allow for easy storage and transportation of such mega-cells by allowing them to flatten, thereby decreasing the space needed for large numbers of cells.

Figure 19:
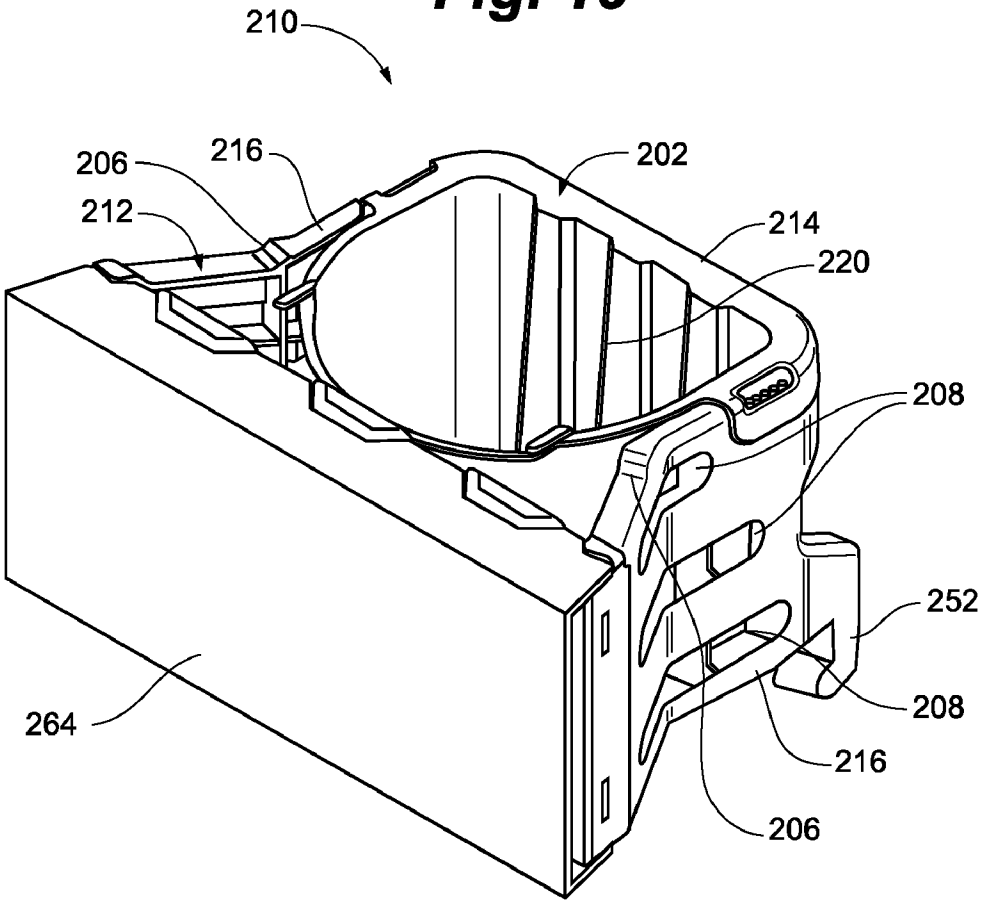
FIG. 19 is a front perspective view of one embodiment of a deterioration resistant mass confinement cell of the present invention that includes a frame, load cell and fascia.
Figure 20A:
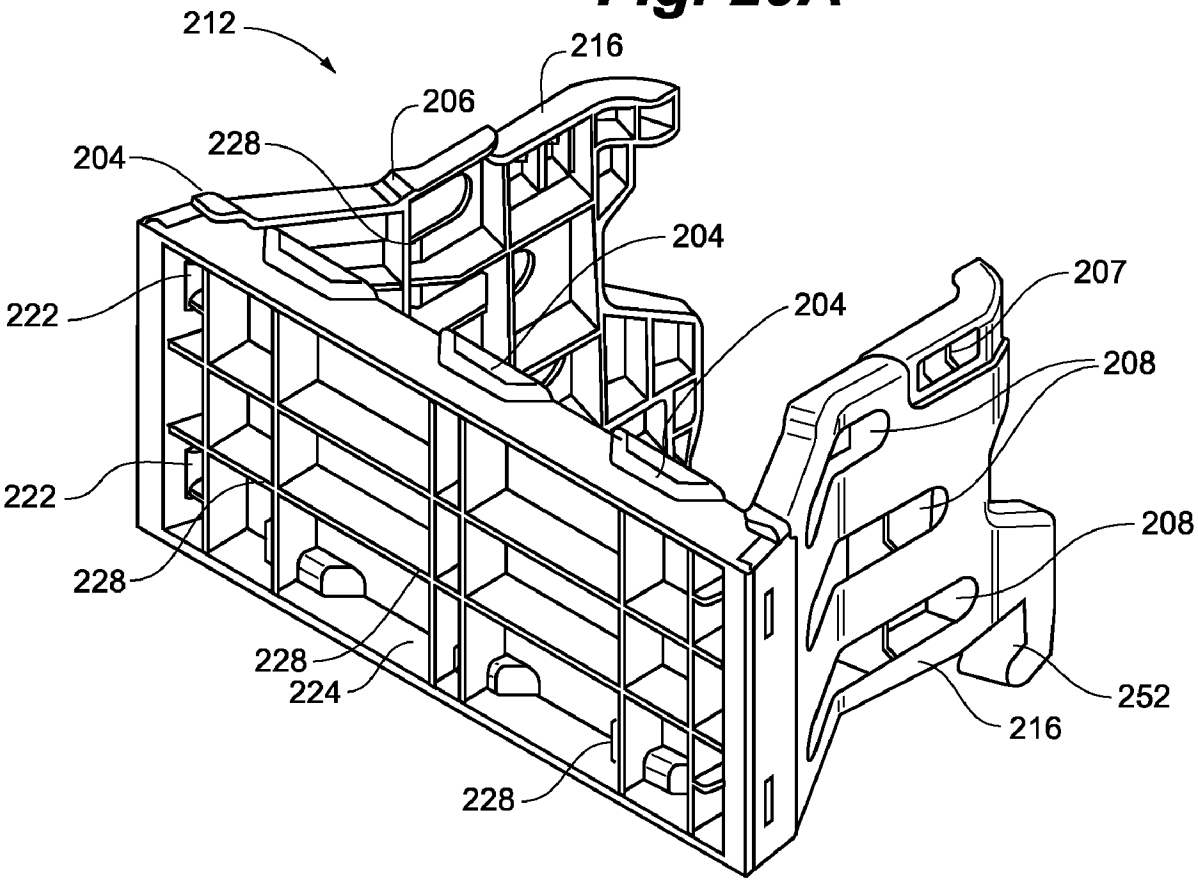
FIG. 20A is a front perspective view of an embodiment of a frame of the deterioration resistant mass confinement cell of FIG. 19.
Figure 20B:
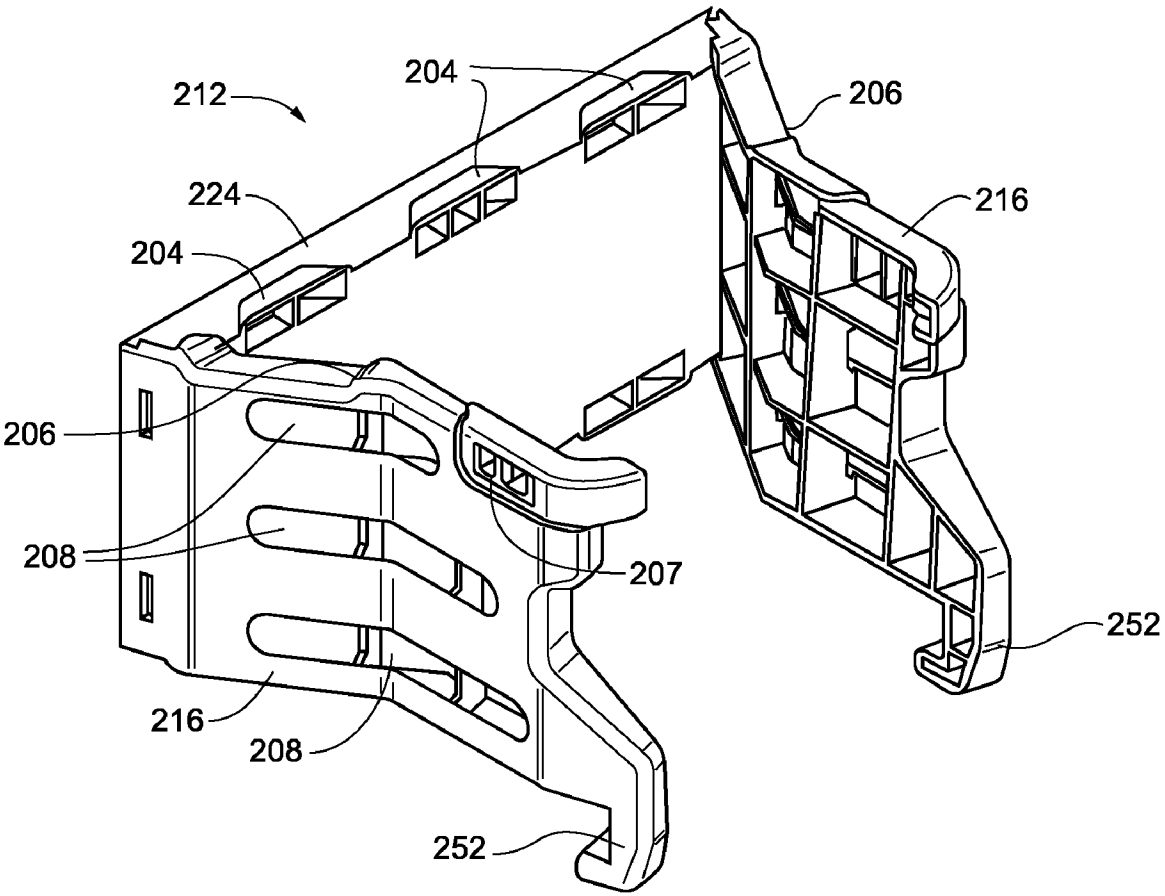
FIG. 20B is a back perspective view of an embodiment of a frame of the deterioration resistant mass confinement cell of FIG. 19.
Figure 20C:
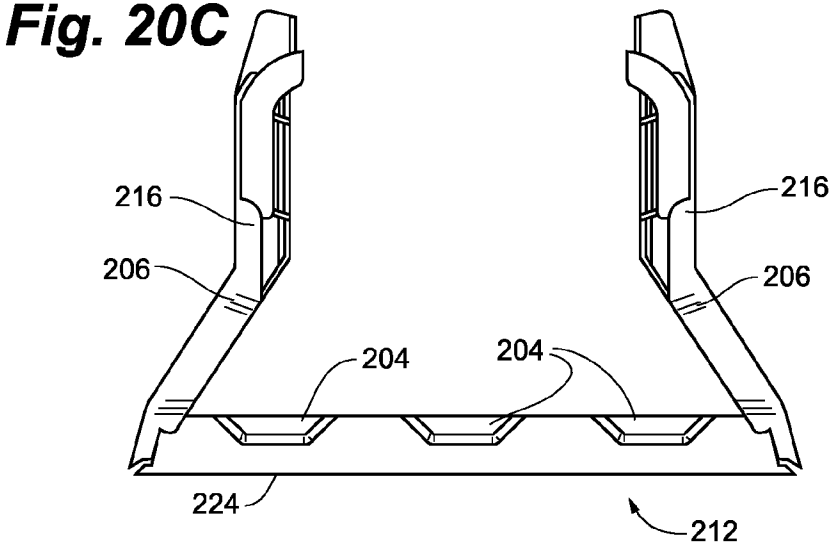
FIGS. 20C-E are top, front and side views of an embodiment of a frame of the deterioration resistant mass confinement cell of FIG. 19.
Figure 20D:
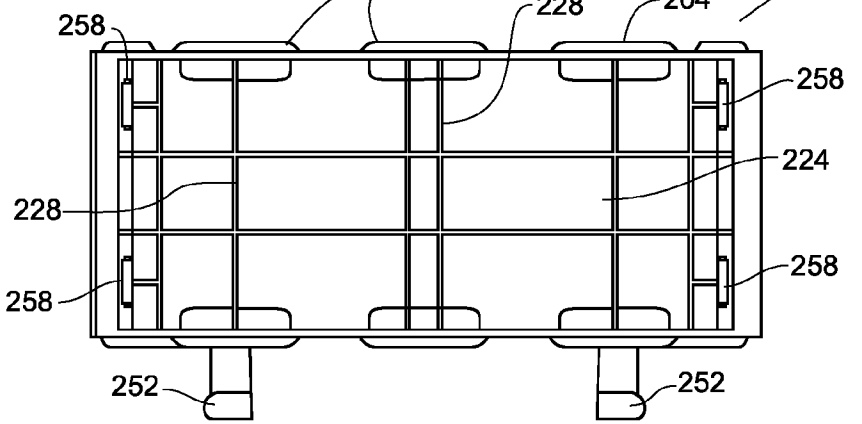
Figure 20E:
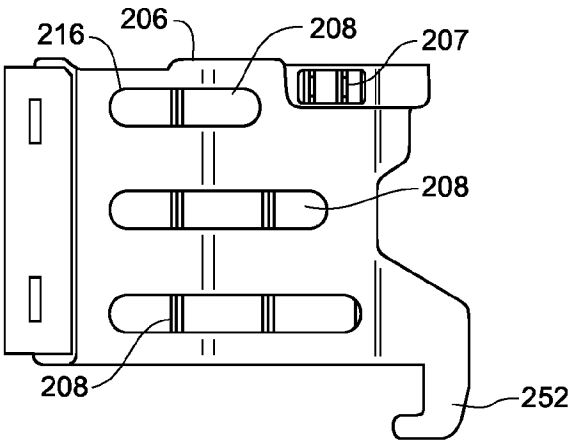

In yet another embodiment of the present invention, as depicted in FIG. 19, the deterioration resistant mass confinement cell 210 comprises a frame 212 operably adjoined to a load cell 202 and an aesthetic fascia 254. The frame 212 of this embodiment generally includes a front panel 224 operably adjoined to one or more side panels 216. The load cell 202 may include a back panel 214 and secures to one or more of the side panels 216 to join the frame 212 to the load cell 202, thereby forming a continuous flow chamber 220 in the mass confinement cell 210. The continuous flow chamber 220 is generally positioned within the frame 212 and load cell 202.

FIGS. 20A-E depict one embodiment of a frame 212 in a folded or assembly position, thereby being prepared for mass confinement cell 210 assembly. As previously suggested, the frame 212 generally includes a front panel 224 operable adjoined to one or more side panels 216 by one or more securing mechanisms 222 (e.g. living hinges, snaps, pegs and pins).

Similar to the embodiments depicted in the paragraphs above, the mass confinement cells 210 of this embodiment include no top panel or a partial top panel and no bottom panel or a partial bottom panel. When a plurality of confinement cells 210 are positioned in proximity to each other in a wall structure, the open top and bottom allows for the flow and/or commingling of fill material from one confinement cell to adjacent confinement cells above and/or below through the continuous flow chambers 220.

In various embodiments of the present invention, the front panel 224 of the confinement cell 210 may be flat, rounded or beveled by molding or by a secondary fabrication process to provide the desired earthen appearance and/or design. However, in other embodiments a fascia 254, as depicted in FIG. 19, is secured to the front panel 224 to provide the desired appearance. It is noted that the front panel 224 or fascia 254 may also be beveled, rounded, substantially flat or include positions of relief to provide a more natural earthen appearance or desirable design.

As depicted in FIGS. 20A-E, the front panel 224 and side panels 216 of the frame 212 of this embodiment may include one or more ribs 228 on its front or back side to provide support and stability to the front panel 224 and side panels 216. As previously mentioned, the front panel 224 and side panels 216 further include at least part of one or more securing mechanisms 222. As will be explained further below, the front panel 224 or fascia 254 generally will display an earthen appearance or other desirable design that may be molded into the front or exposed surface or may be fabricated and/or applied to the surface.

The front panel 224 may further include one or more load bearing members 204. These load bearing members 204 are configured to take pressure off the fascia 254 when a wall is assembled, thereby allowing for greater ease in removal and replacement when desired. The front panel 224 or fascia 254 may further include one or more side flaps (not shown) positioned on the outer edges of the front panel 224 or fascia 254. The side flaps are generally flexible, textured and colored to hide the gaps between the various cells 210 placed in a wall and to assist in the reduction of fine fill material moving through the face of the wall.

In various embodiments of the present invention, as depicted in FIGS. 20A-E, the side panels 216 further include one or more grid fasteners 206, wherein geogrid can thread over and secure when utilized between rows of confinement cells 210. In other embodiments, the grid fastener 206 may include an overhanging portion (not shown) that the grid can slide under, thereby inhibiting vertical movement of the grid once in position. The side panels 216 may further include lightening apertures 208. Such apertures 208 provide structure by allowing the fill material to flow through the apertures, thereby further locking the frame into the slope. The apertures 208 further allow for reduction of resin and thereby make the product more light-weight and cost efficient. The lightening apertures 208 may further be utilized to adjoin side caps and other accessories desired to complete a wall.

The side panels 216 may further include one or more anchoring devices that may be utilized to position each cell 210 when assembling a wall and may also function to reduce or prevent overturn of the cells upon filling and compacting of fill material. One embodiment of the anchoring devices, as depict in FIGS. 20A-E, are in the form of peg extensions 252. In this embodiment, the peg extensions 252 are designed to insert under an anchoring ridge 262 or in an anchoring aperture positioned on the two load cells 202 located below in a wall, revetment or earth retention system.

Figure 21:
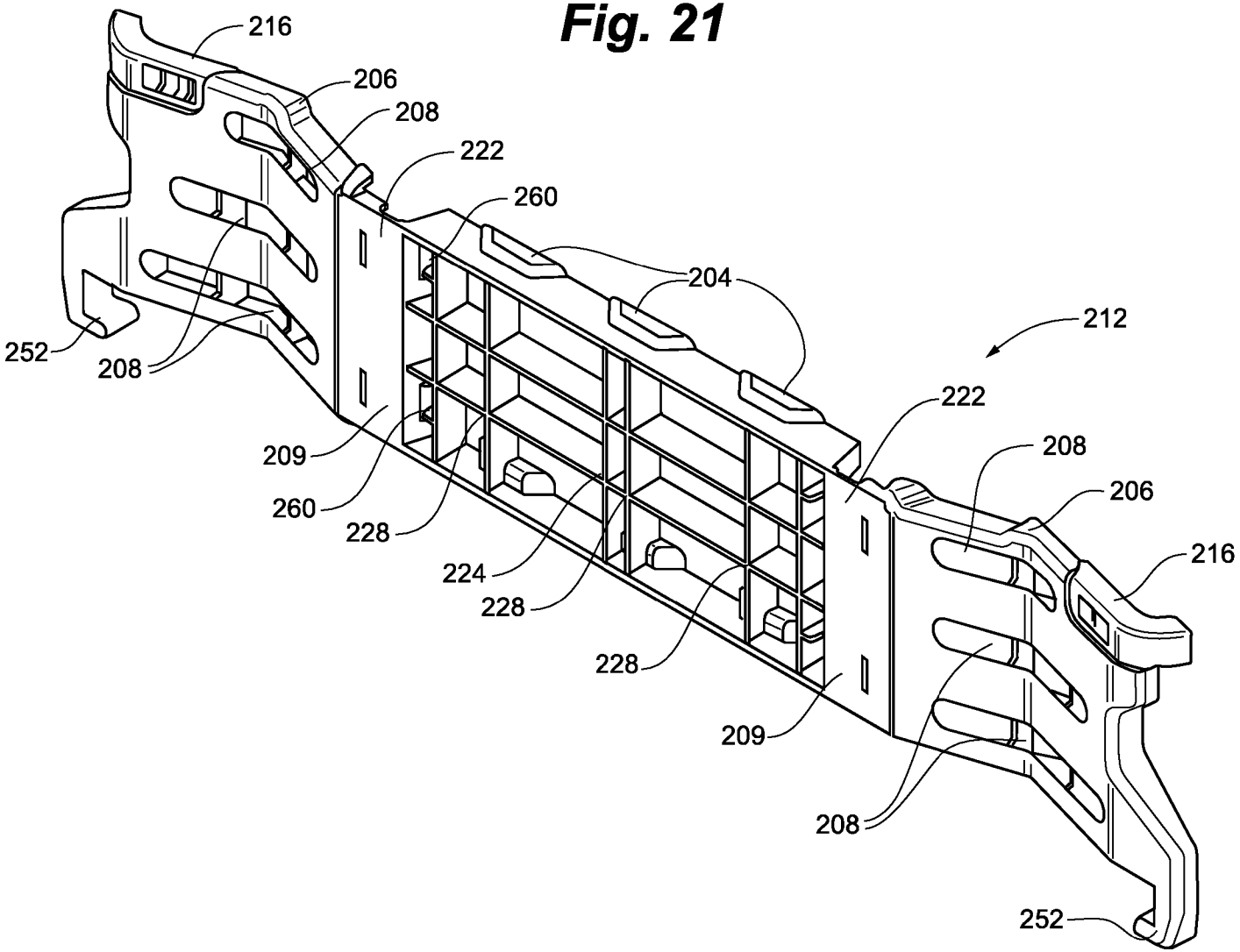
FIG. 21 is a perspective view of one embodiment of the frame of the deterioration resistant mass confinement cell of FIG. 19 positioned in a flat configuration.

Similar to the embodiment of FIGS. 1 and 14, the frame 212 of this embodiment may be transported and stored in a flat configuration. FIG. 21 depicts an embodiment of the frame 212 that is positioned in a flat configuration. In such embodiments, one or more of the side panels 216 are adjoined to the front panel 224 with one or more securing mechanisms 222. In this embodiment, the side panels 216 are adjoined to the front panel 224 with living hinges 209 and retention snaps. The living hinges 209 generally comprise a thin flexible material, such as plastic (e.g. HDPE, LDPE, polypropylene), that can bend into position without breaking when folding the frame 212 into assembly position to secure the load cell 204. Other securing members may be utilized to secure the panels of the frame (e.g. peg and sockets and mechanical hinges). It is noted that in other embodiments, the frame may be reversed, wherein the side panels are adjoined to a back panel of the confinement cell. Another embodiment may include a separate front panel or a securing mechanism to attach a fascia to the ends of the side panels or to the front of the load cell if it was desired to reverse the configuration of the confinement cell.

As previously mentioned, various embodiments of the frame 212 depicted in previously described FIGS. include one or more securing mechanisms 222 that secure the side panels 216 to the front panel 224 and/or back panel (not shown) when folded into assembly position. The securing mechanisms 222, in the embodiment depicted in FIGS. 14-21, include snaps 258 that are attached to the side panels 216 and engage and lock the front panel 224 into assembly position by passing the snaps 258 through snap apertures 260 located on the front panel 224. Other securing mechanisms 222 may be utilized in these embodiments, some of which are identified within.

Figure 22A:
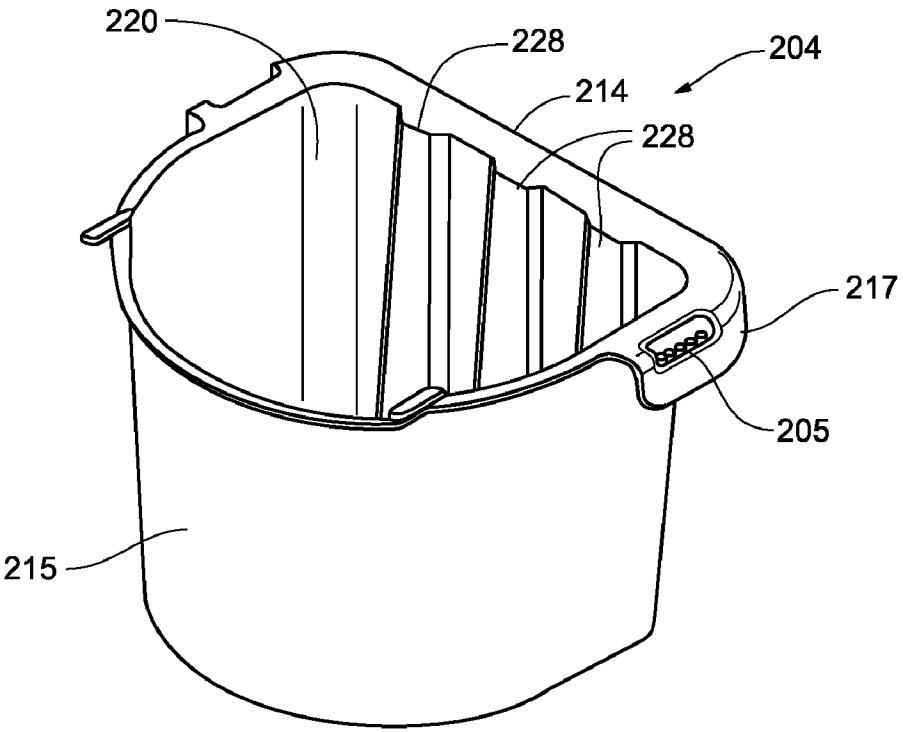
FIG. 22A is a front perspective view of an embodiment of a load cell of the deterioration resistant mass confinement cell of FIG. 19.
Figure 22B:
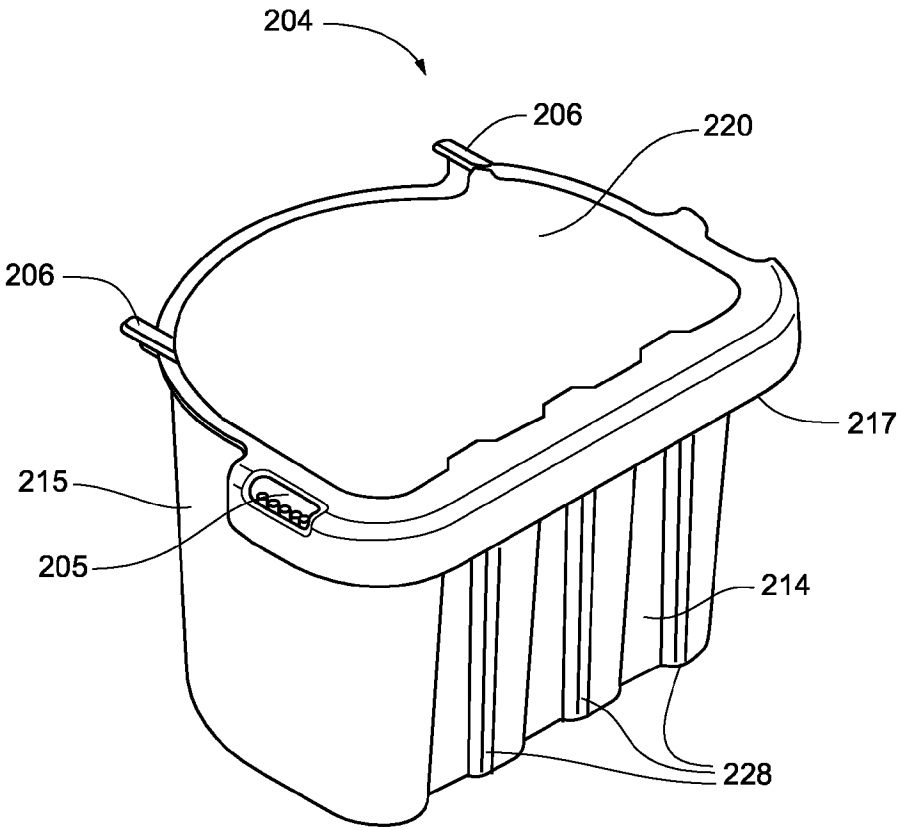
FIG. 22B is a back perspective view of an embodiment of a load cell of the deterioration resistant mass confinement cell of FIG. 19.

FIGS. 22A and 22B depict one embodiment of a load cell 204 that may be secured to the frame 212 by one or more load cell fasteners 205. Generally, the load cell 204 is a cylinder that when attached to the frame 212 forms at least a portion if not all of the continuous chamber 220 of the mass confinement cell 210. In this application a cylinder may comprise a cylinder that includes a circular or elliptical structure and may also include a structure that has one or more substantially straight sides and one or more rounded sides. In the embodiments of FIGS. 22A and 22B the load cell 204 includes a substantially straight back panel 214 integrally adjoined to a rounded front section 215. The back panel 214 further includes ribs 228 that may be position on the front and/or back of the back panel 214 to provide additional stability. The load cell 204 may further include an anchoring ridge 217 or aperture (not shown) that may be utilized to accept the anchoring devices (e.g. peg extensions) for confinement cell 210 positioning and overturn prevention or reduction.

The load cell fasteners 205 may be any fastening device or material that securely adjoins the load cell 204 to the frame 212. In one embodiment, as depicted in FIGS. 22A and 22B the load cell fastener 205 is one or more projections that extend inward from the outer edge of the anchoring ridge 217. In operation, the load cell 204 is inserted over and into the frame 212 so that the load cell fastener 205 engages with a load cell aperture 207 or ridge on the side panels 216 of the frame 212. In other embodiments there may include two or more load cell fasteners 205 or load cell apertures 207 that may be utilized as set-back devices when positioning the confinement cells 210 in the wall structure. For example, a load cell fastener 205 or load cell apertures 207 may be positioned in front of a second load cell fastener 205 or load cell apertures 207 on the load cell 204 or side panels 216 to provide a set back of the confinement cells at 3 mm and 1.25 cm. Set back positions generally allow for a wall to be constructed in a vertical configuration or angled back into the slope. The set back positions of the load cell fasteners may be at any distance desired to provide the desired wall angle. Another alternative to multiple set-back positions would be to manufacture separate load cells 204 with different attachment points for set back rather than having multiple fasteners positioned on the load cells 204 and/or side panels 216.

The load cell 204 may further include one or more grid fasteners 206 for securing and positioning geogrid when it is utilized in a wall structure. The grid fastener 206 is configured to be inserted in an aperture of the geogrid and positioned over the geogrid at connection so that the grid does not move in a vertical direction once it is applied.

Additionally, in other embodiments, the load cell 204 may be split in two or more sections, wherein one section nests with the other section. The two nested sections allows for the compression of the sections together to make a smaller load cell that may be utilized when secured to a cut frame for partial confinement cells. In such embodiments, the two sections would further include a fastening device to fixedly secure the two sections together when the proper size is achieved, thereby preventing movement of the two sections of the load cell.

Figure 23A:
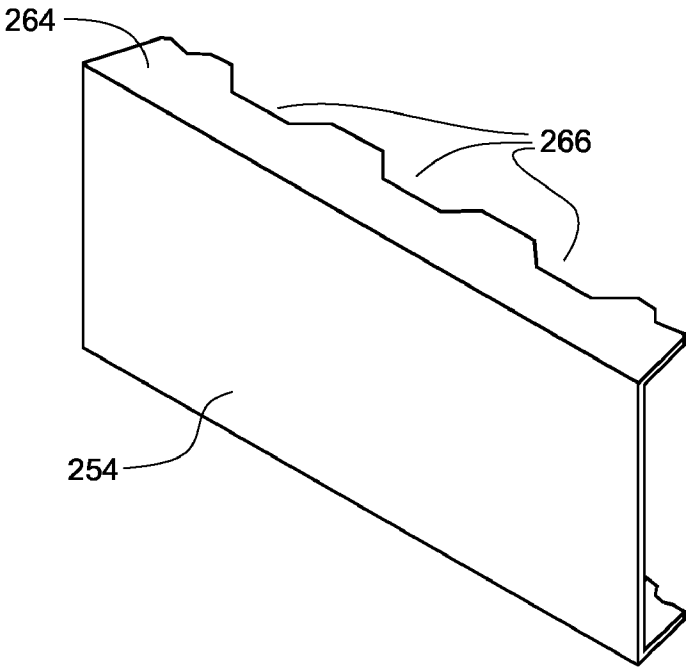
FIG. 23A is a front view of one embodiment of a fascia that may be utilized with the deterioration resistant cells of the present invention.
Figure 23B:
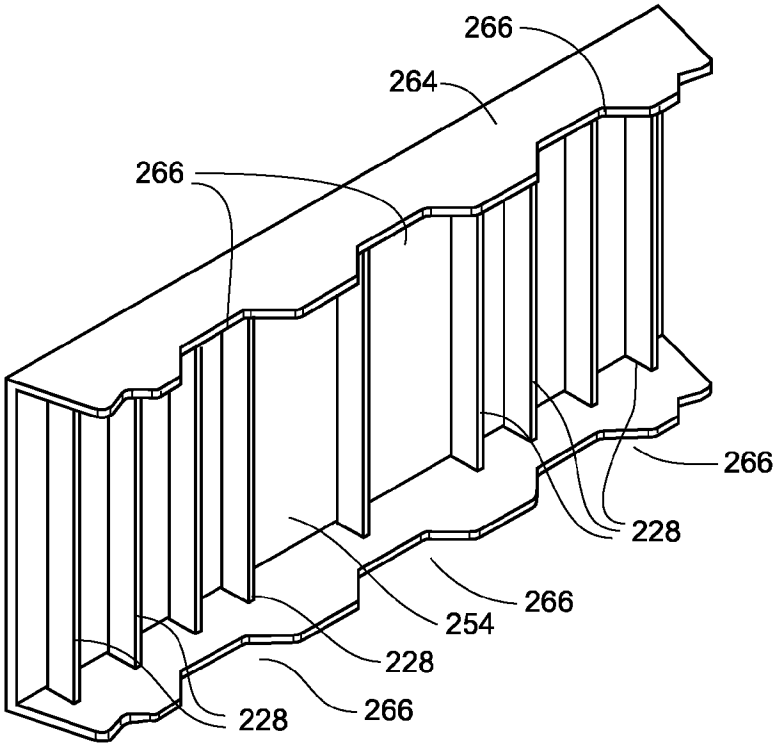
FIG. 23B is a back view of one embodiment of a fascia that may be utilized with the deterioration resistant cells of the present invention.

Various embodiments of the present invention may also include a fascia with the desired aesthetic appearance, rather than having the aesthetic appearance (e.g. texture and color) molded into the front face of the front panel 12. FIGS. 23A and 23B depict a front and back view of one embodiment of a fascia 254 that may be utilized with the confinement cells of the FIGS. described herein. Further explanation of fascia design and manufacture will be discussed below. The fascia 254 in various embodiments of the present invention may include a plurality of ribs 228 to add stability and structure to the fascia 254. It is noted that the top panel of the fascia 264 may include one or more indentations 266 to accommodate and alternate between the load bearing members 204 upon administering the fascia 254 to the front panel 224.

Figure 24A:
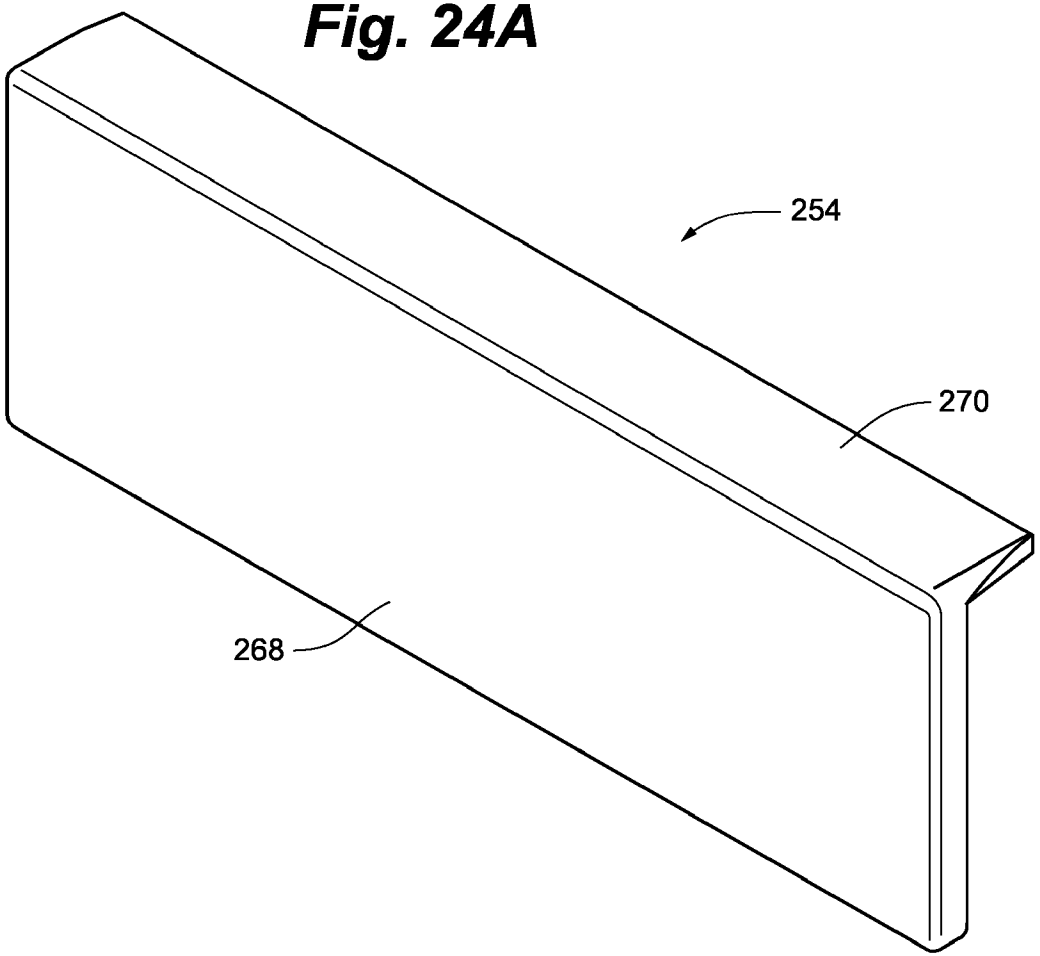
FIG. 24A is a front view of one embodiment of a fascia that may be utilized with the deterioration resistant cells of the present invention.
Figure 24B:
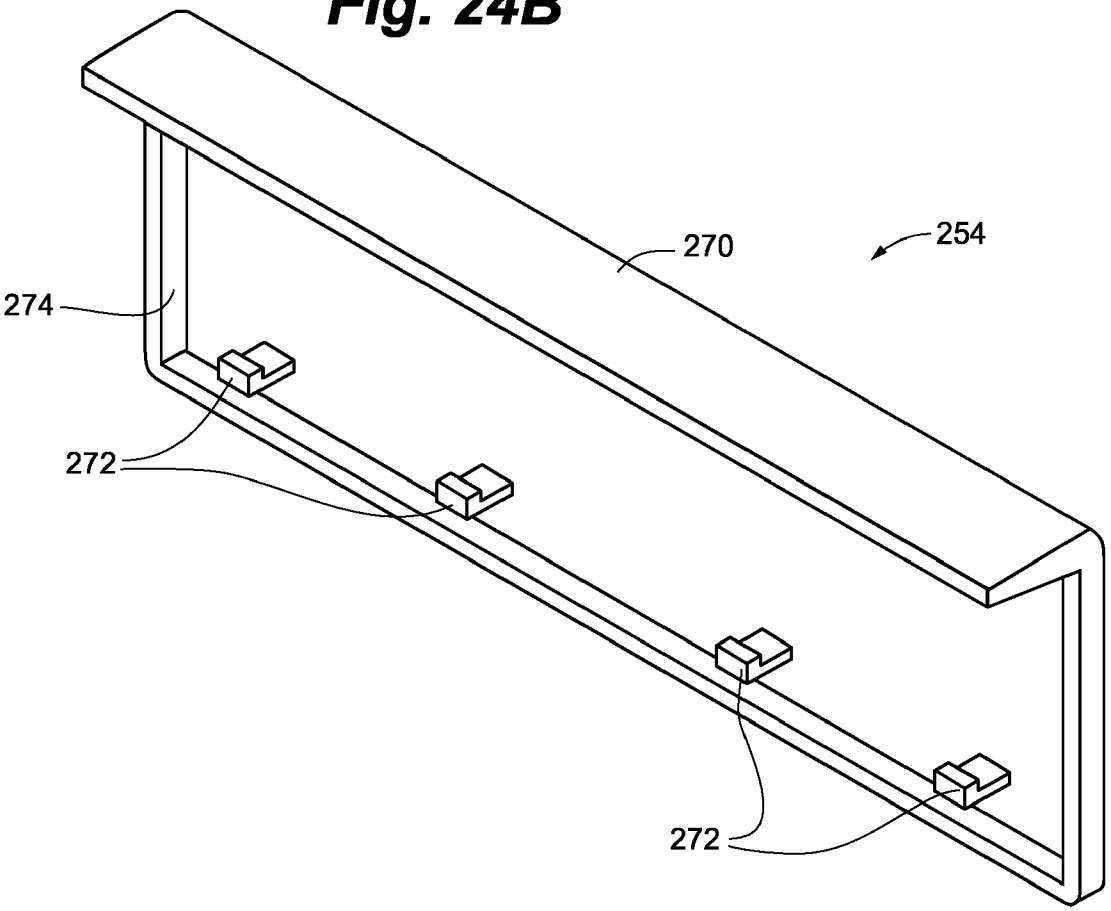
FIG. 24B is a back view of one embodiment of a fascia that may be utilized with the deterioration resistant cells of the present invention.
Figure 25A:
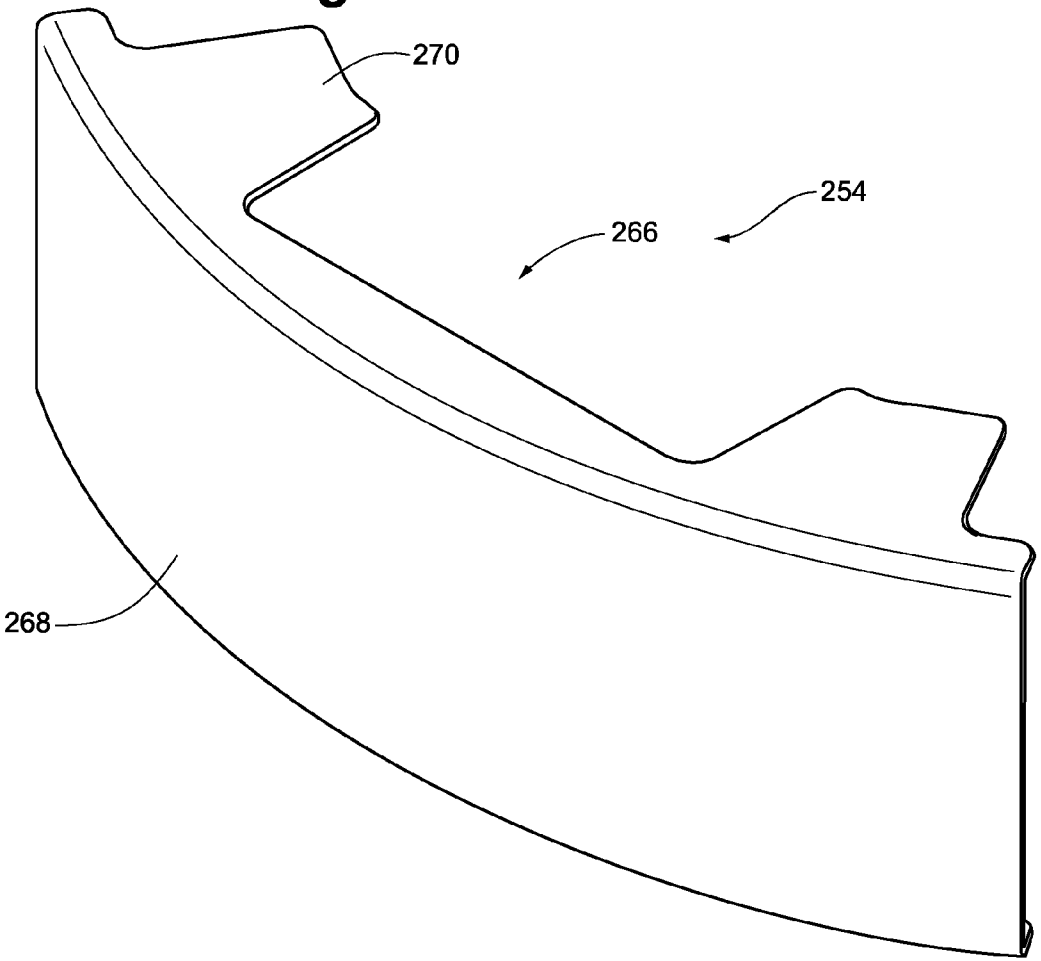
FIG. 25A is a front view of one embodiment of a fascia that may be utilized with the deterioration resistant cells of the present invention.
Figure 25B:
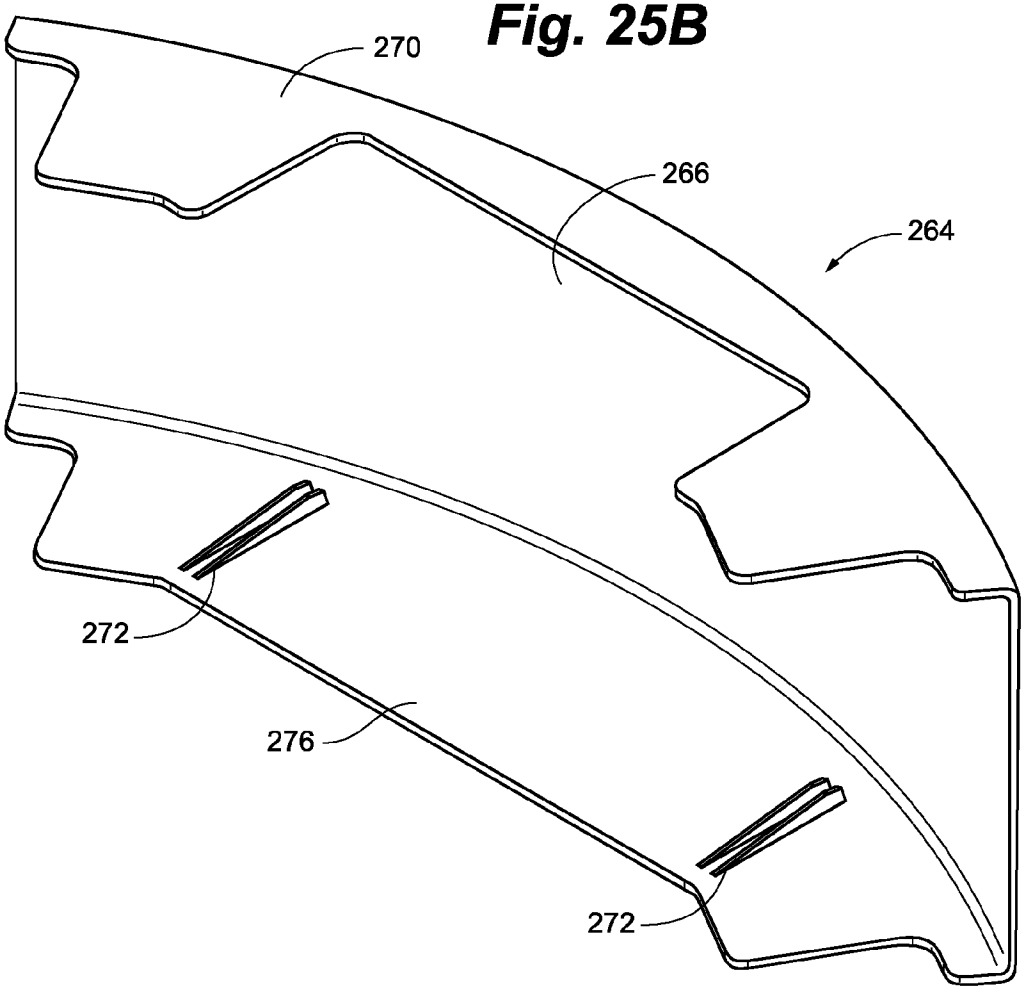
FIG. 25B is a back view of one embodiment of a fascia that may be utilized with the deterioration resistant cells of the present invention.

FIGS. 24A and 24B depict another embodiment of a fascia 254 that may be utilized with any embodiment of the present invention. Generally, the fascia 254 includes a front panel 268, a partial top panel 270 and one or more fascia fasteners 272. The fascia 254 may also optionally include wrap around sides 274, that wrap around the side panels and bottom panel upon assembly. Each of these panels may be textured and include color and/or other additives (e.g. U.V. inhibitor) to provide an earthen appearance, crystalline appearance or any other aesthetic design. Additionally, such fascia may be prepared utilizing any of the techniques discussed below or those known in the art for forming the desired appearance. FIGS. 25A and 25B depict another embodiment of a fascia 254 of the present invention, wherein the fascia 254 also includes a partial bottom panel 276. In all of the embodiments of the present invention that include a fascia 254, the fascia 254 may be permanently fixed to the frame 212 or may be removable so as to be replaced when damaged or a change is desired.

In various embodiments of the mass confinement cells 10 of the present invention, the surface visible to the observer, such as the front panel 224 or fascia 254 of the mass confinement cell 10, 210 will generally include a molded and/or fabricated texture and/or pattern in the deterioration resistant material. In various embodiments of the present invention the exposed surface of the landscaping product, such as the front panel 224 or fascia 254, will have a natural earthen appearance simulating the texture and color of natural earthen surfaces. For example in some embodiments, the exposed surface of the front panel 224 or the surface of the fascia 254 may be textured and colored to have the appearance of rock, natural stone, sand, soil, clay, wood, trees and foliage, water, or any other natural earthen appearance. In other embodiments, the front panel 224 or fascia 254 will have a crystalline appearance or will have another aesthetically appealing design. Additionally, in other embodiments, the exposed surface of the landscaping product, such as the front panel 224 or fascia 254, may further include one or more designs (e.g. symbols, company names, logos, images) that may be positioned in the natural earthen appearance texture and color, crystalline texture and color or other design (e.g. a company logo embedded in a stone color and texture). Also, in other embodiments of the present invention, the front panel 224 or fascia 254 may further include a design, such as the appearance of multiple bricks, stones, or blocks. This allows for the installation of larger mass confinement cells (e.g. mega-cells) in a wall that appears to include a multitude of bricks, stones, blocks, timbers and the like.

In various embodiments of the present invention the texture and/or front surface of the front panel 24, 224, 324 or fascia 54, 254, 354 is produced by imaging an actual natural surface, such as natural stone, brick or wood and producing a mold that mimics that particular image. The imaging of the natural surface can be performed by processes such as casting the natural surface or by digital scanning the natural surface. When casting the natural surface a mirror image of the surface can be produced by preparing a solidifying material, such as silicone, and casting it over the natural surface. Once the solidifying material sets the newly casted mold is removed and an opposite image or negative of the natural surface is produced. Once the casted mirror image is produced, a mold or a mold insert manufactured from a suitable mold material, such as aluminum, steel or a ceramic, can be produced for mass manufacture. In various embodiments of the present invention ceramic molds are produced to provide the desired detail found in the natural surface which then can be transferred to a more durable steel or aluminum mold for mass manufacture. One source for such molds formed of ceramic materials is Arrow Pattern and Foundry Company, 9725 South Industrial Drive, Bridgeview Ill. Alternatively, a mold may be prepared by digitally scanning the natural surface, such that the surface of a stone, brick or piece of wood. Once scanned, a mold can be produced from a suitable mold material for mass manufacture of the front panels or fascias having a front surface supporting the scanned image.

Figure 26:
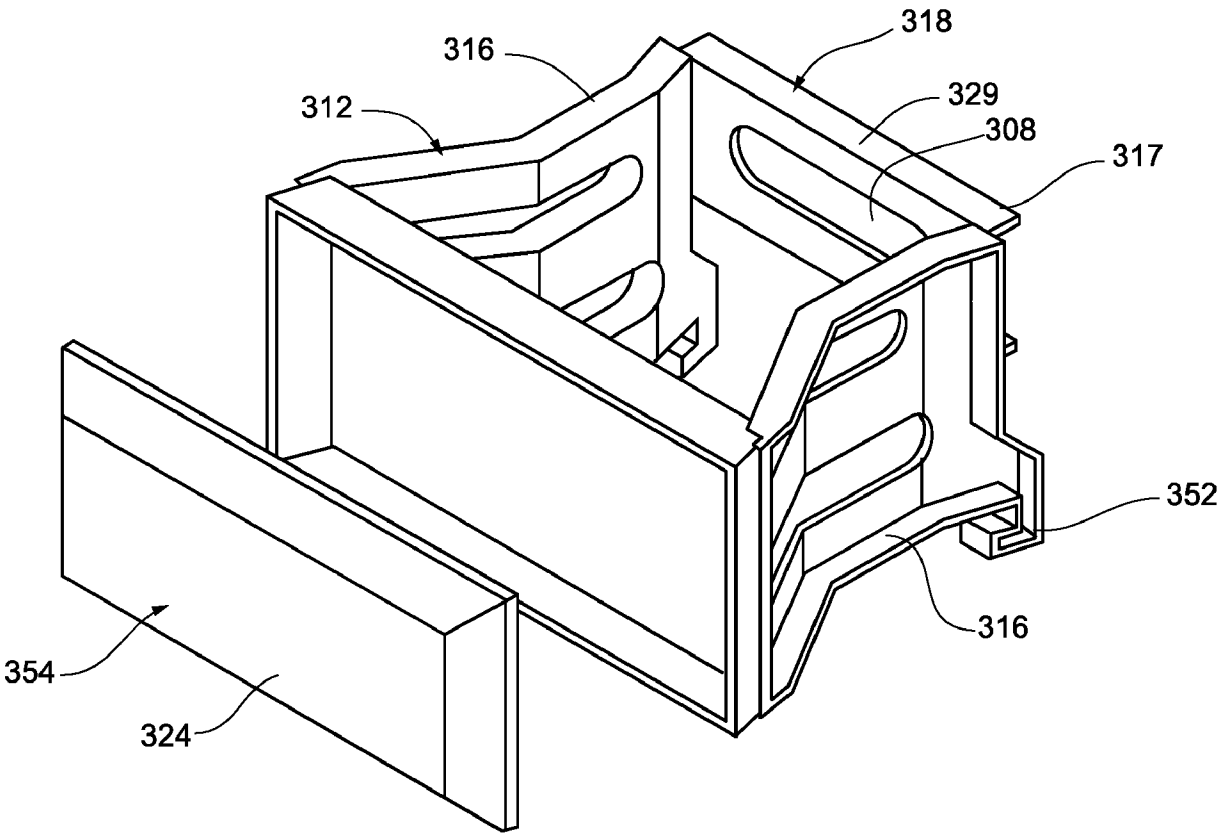
FIG. 26 is an exploded view of one embodiment of a deterioration resistant mass confinement cell including a frame, enclosing bar and fascia.
Figure 26A:
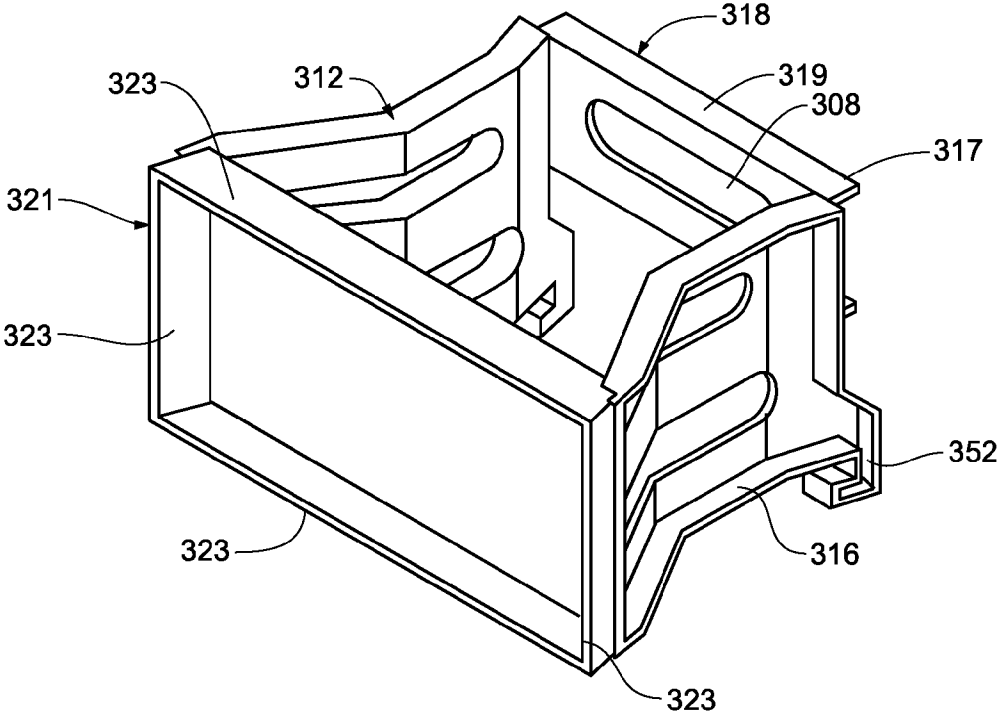
FIG. 26A is a front perspective view of an embodiment of the frame adjoined to the enclosing bar of the deterioration resistant mass confinement cell of FIG. 26 in a folded assembly position.

FIG. 26 depicts another embodiment of the mass confinement cell 310 of the present invention wherein the enclosing member 318 includes one or more enclosing bars 319 that are adjoined to the side panels 316 of the frame 312 to form the chamber 320. FIG. 26A depicts one embodiment of the frame 312 and enclosing member 318 wherein the enclosing bars 319 of the enclosing member 318 further include an anchoring ridge 317 for setting and securing the setting extensions 352 of each of the cells positioned above. The enclosing bars 319 may further include a lightening aperture 308 positioned in the interior of a single bar 319 or the enclosing member 318 may comprise two or more bars 319 (not shown) wherein a gap is present between the two or more bars. The enclosing member 318 of the embodiment of FIG. 26 may be adjoined to the frame 312 with one or more securing mechanisms that adequately secures the member 318 to the frame 312. For example the enclosing member 318 may be adjoined to the frame 312 by one or more snaps positioned on the enclosing member 318 engaging one or more snap apertures positioned on the frame 318. A similar snap and snap aperture securing mechanism is depicted in FIGS. 14-17B.

Figure 26B:
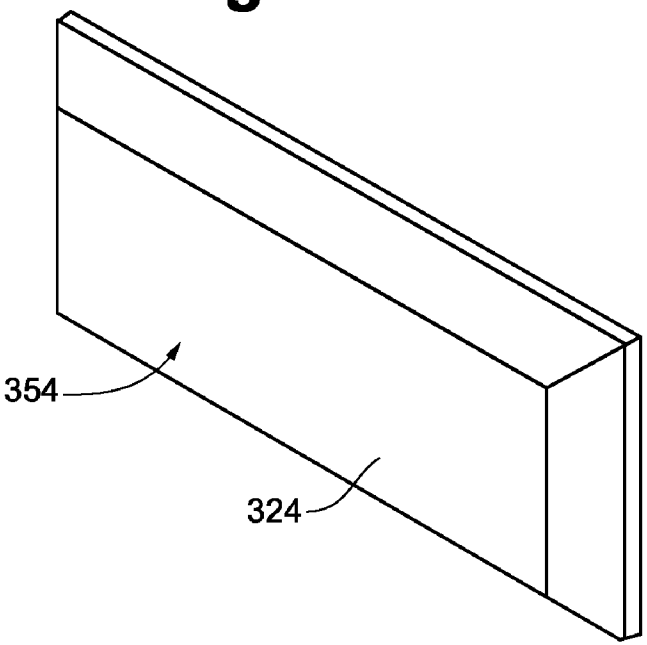
FIG. 26B is a front view of one embodiment of a fascia that may be utilized with the deterioration resistant cells of the present invention, such as the cell of FIG. 26.

The cell embodiment depicted in FIG. 26 further includes a fascia 354 as shown in 26B. The fascia 354 may include a front panel 324 having an earthen texture and color (e.g. stone, wood, rock) or any other aesthetic design molded, fabricated or applied to the visible surface. It is noted that in other embodiments of the present invention the front panel having an earthen texture and color or other aesthetic design may be integral with the frame rather than part of an attachable fascia. In various embodiments, the fascia may overlap the frame as depicted in the FIGS above or may nest within a fascia frame 321 as depicted in FIG. 26. As depicted in FIG. 26B the fascia frame 321 includes a ridge 323 that surrounds a nested fascia 354 and functions similar to a picture frame. The fascia frame 321 may be any color and in some embodiments may have the color and appearance of grout. In other embodiments of the present invention, a confinement cell may include more than one fascia frame wherein multiple fascias may be nested in each separate frame. In various embodiments the multiple fascia frames may provide the appearance of multiple stones positioned in a single mass confinement cell.

Figure 27A:
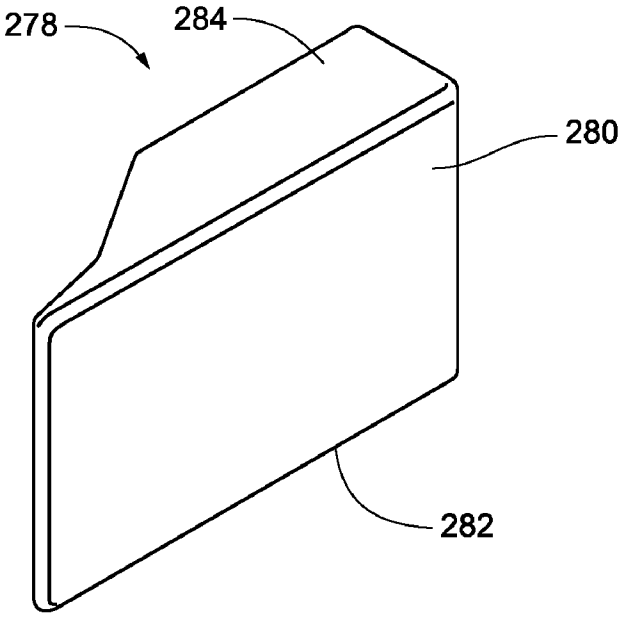
FIG. 27A is a front view of one embodiment of an end cap that may be utilized with the deterioration resistant cells of the present invention.
Figure 27B:
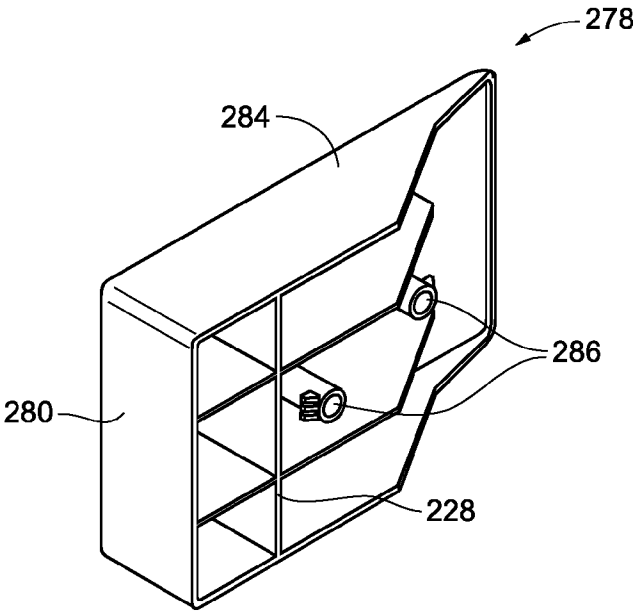
FIG. 27B is a back view of one embodiment of an end cap that may be utilized with the deterioration resistant cells of the present invention.

The mass confinement cell 10, 210, 310 of the various embodiments of the present invention may further be fitted with an end cap 278 to finish the end of a wall, provide an end finish for a sharp turn (e.g. 90° turn) in the wall or to accommodate a partial confinement cell when a confinement cell must be cut for fitting. A front and back view of one embodiment of an end cap 278 is depicted in FIGS. 27A and 27B. In most embodiments, the end cap 278 will include a back surface 280 and side surface 282 that is textured and colored similar to the front panel 224 or fascia 254 of the mass confinement cell 210. Additionally, the top surface 284 of the end cap 278 may include a texture and color similar to the front panel 224 or fascia 254 of the mass confinement cell 210. In one embodiment, as depicted in FIG. 27B, the end cap 278 includes one or more securing pegs 286 that may be inserted into the lightening apertures 208 of the side panels 216. The end cap 278 may also include ribs 228 to provide stability to the structure.

Figure 28:
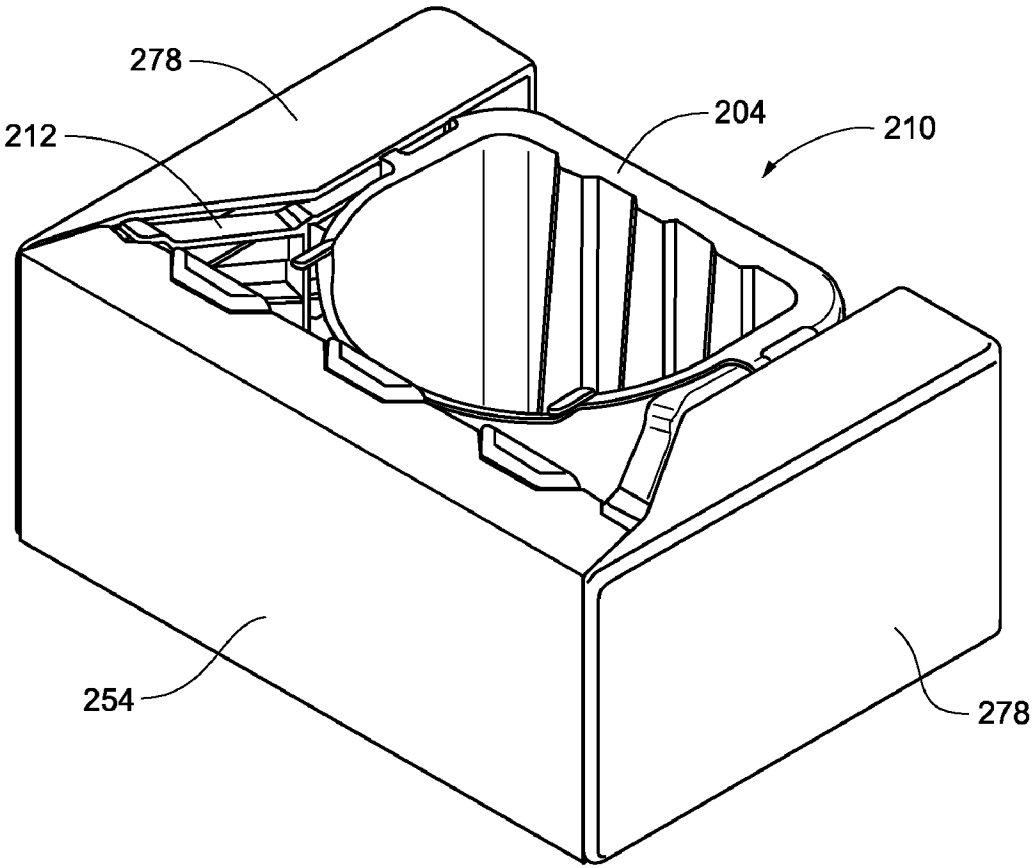
FIG. 28 is a front perspective view of one embodiment of a deterioration resistant mass confinement cell of the present invention that includes a frame, load cell, fascia and end caps.
Figure 29:
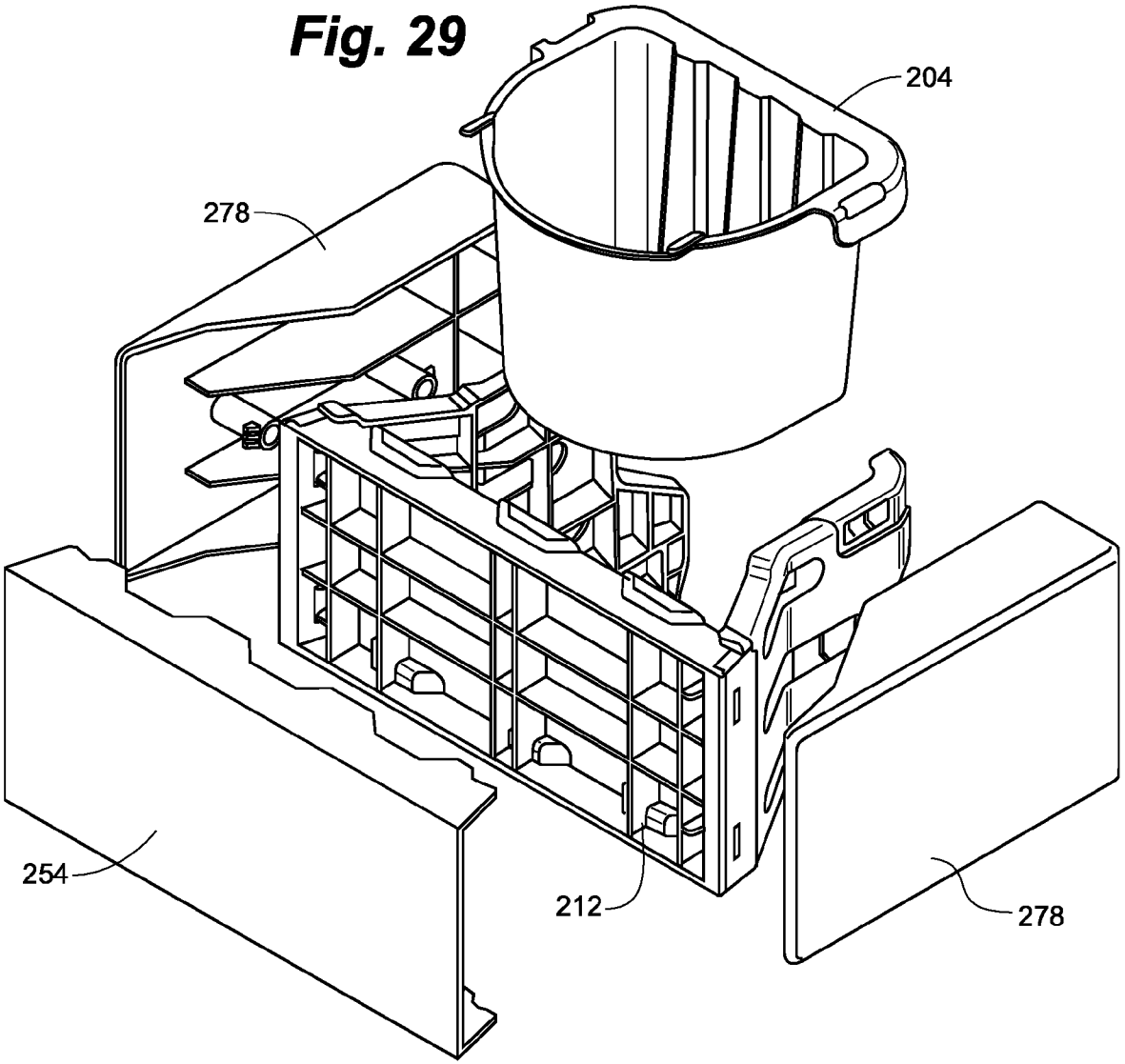
FIG. 29 is an exploded view of the deterioration resistant mass confinement cell of FIG. 28.
Figure 30:
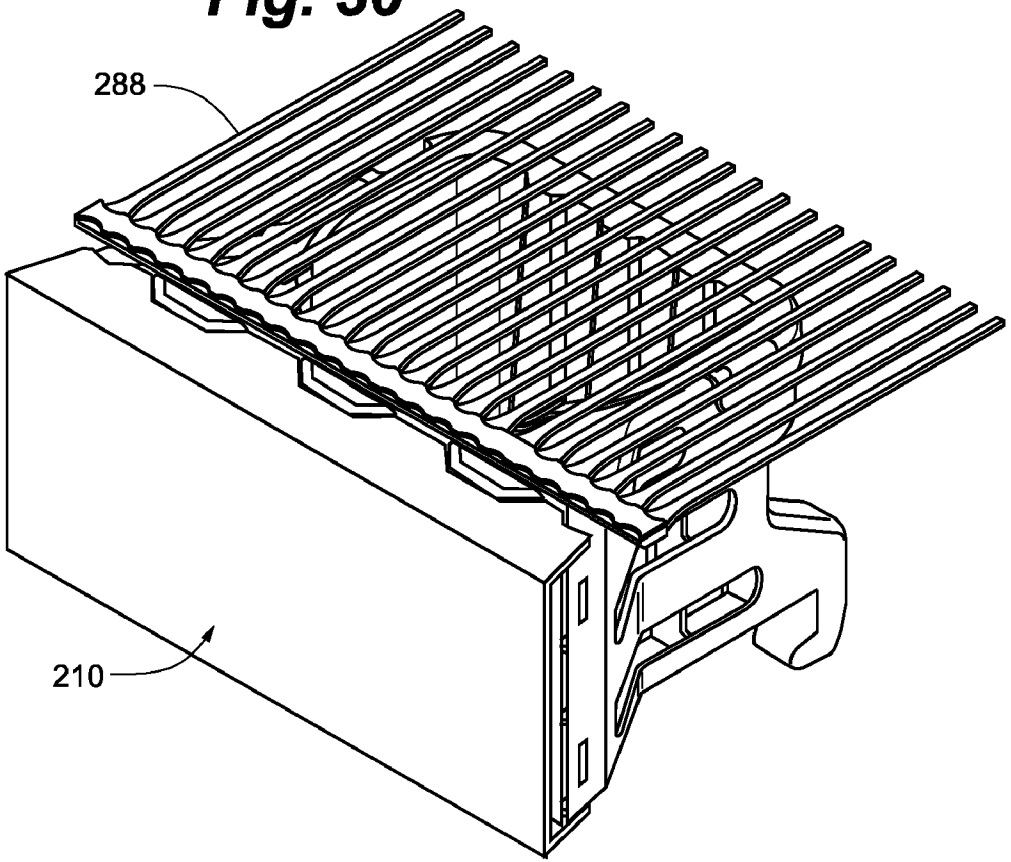
FIG. 30 is a front perspective view of the deterioration resistant mass confinement cell of FIG. 26 that further includes an adjoined geogrid.
Figure 31:
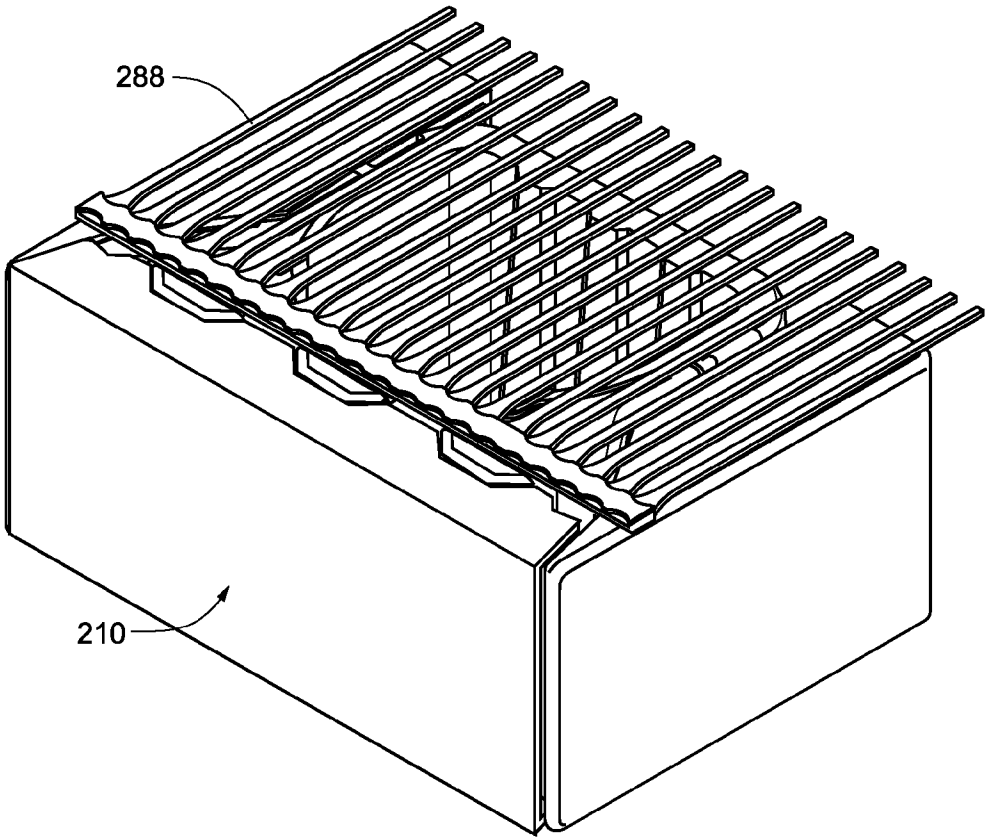
FIG. 31 is a front perspective view of the deterioration resistant mass confinement cell of FIG. 28 that further includes an adjoined geogrid.

FIG. 28 depicts one embodiment of a fully assembled mass confinement cell 210 that includes end caps 278. FIG. 29 depicts an exploded view of the components of the mass confinement cell 210 depicted in FIG. 28 including a frame 212, load cell 204, fascia 254 and two endcaps 278. FIGS. 30 and 31 depict two embodiments of the confinement cell 210 of the present invention accommodating the securing of each cell 210 with geogrid 288.

The mass confinement cell embodiments depicted in previously disclosed FIGS. and the embodiments of the present invention are also especially advantageous for mega-cell products of sizes equal to or greater than one foot in height, two feet wide and one foot deep (e.g. greater than 2 feet in height, four feet wide and two feet deep) and multi-cell products (e.g. products that appear like multiple individual units that are approximately 3-36 in height, 2-4 feet wide and 9 inches to 4 feet deep) that are advantageous for the mass consumer market. Such large confinement cells and multi-unit cells allow for easy storage and transportation of such mega-cells and multi-cells by allowing them to flatten, thereby decreasing the space needed for large numbers of cells. In some embodiments of the confinement cells 210 of the present invention, a plurality of load cells 204 may be adjoined together and secured to the larger frame to reduce the flow forces of the fill materials in the larger walls. The load cells of the multi-cell embodiments may be adjoined with tabs that may be separated to curve the wall when desired. Furthermore, the multi-cell embodiments of the present invention may be utilized to install large sections of wall with few components and still provide the appearance of a multitude of individual cells.

In many embodiments of the present invention, the appearance of the front panel 24, 224, 324, partial top panel (not shown), fascia 54, 254, 354 or any other portion of the mass confinement cell 10, 210, 310 that is intended to be seen, generally includes an earthen appearance or other aesthetically pleasing design and color. This may be accomplished in a number of ways including but not limited to thermal molding, lamination and/or coating (e.g. U.V. activated coating or polymer adhesion painting). For example, in some embodiments of the present invention the texture and color of the confinement cell 10, 210, 310 may be formed by thermal molding one or more resins that include colors and other additives in a mold that has a desired texture. Such a process may be performed by any process known in the art, such as thermoforming, extrusion, injection molding, structural foam molding (e.g. low pressure multi-nozzle structural foam), vacuum molding or any combination thereof For example, one or more polymers, such as HDPE, polypropylene or a polyester (e.g. Polyethylene terephthalate (PET), polycarbonate), that includes one or more colors, fillers, and/or additives (e.g. U.V. inhibitors) may be injected into a mold that includes a desired shape and texture to form a front panel 24, 224, 324, fascia 54, 254, 354 or other visible part of the mass confinement cell 10, 210, 310. One example, of such a desirable material that may be utilized to produce one or more components of the present invention by thermal molding is a bulk molding compound (BMC) or thermoset that includes one or more polyester resins, glass fibers and other additives and is manufactured and/or molded by Bulk Molding Compounds, Inc. 1600 Powis Court West, Chicago Ill. 60185 and Kenro Incorporated, a Carlisle Company, 200 Industrial Drive, Fredonia, Wis. 53021. In various embodiments, the texture may also be imprinted on the mass confinement cell 10, 210 310 in a secondary process after formation of one or more components of the confinement cell 10, 210, 310 by rolling a die that imprints the texture on the surface of the polymeric front panel 24, 224, fascia 54, 254, 354 or other portion of the cell 10, 210, 310.

In other embodiments of the present invention, the earthen appearance or other design can be achieved through a lamination process. In various embodiments, a sheet of polymeric material including the desired color and additives (e.g. UV inhibitor, natural or synthetic stone particles . . . ) is laminated over the portions of the mass confinement cell 10, 210, 310 that are intended to have the earthen appearance or other design. In various embodiments of the present invention a sheet of polymeric material may include natural or synthetic particles (e.g. granite, marble, aluminum trihydrate, aluminum oxide, calcium oxide . . . ). Generally, in the lamination process, the front panel 24, 224, 324 or fascia 54, 254, 354 may have a sheet of polymeric material heat welded or adhered to the front surface plastic of the front panel 24, 224, 324 or fascia 54, 254, 354. Such a lamination step may happen in a secondary step after formation of the front panel 24, 224, 324 or fascia 54, 254, 354. Alternatively, the lamination plastic sheet may be inserted into the front side of a mold and formed over the resin that is administered into the mold (e.g. in-mold decoration). For example, a sheet of polymeric material may be placed in the front end of an injection molding mold and subsequently thermoformed or vacuum formed to the front surface of the mold prior to filling the mold with resin when manufacturing the front panel 24, 224, 324 or fascia 54, 254, 354. Next, melted resin is shot into the injection mold, thereby integrating the laminated sheet into the face and optionally top of the front panel 24, 224, 324 or fascia 54, 254, 354.

In yet other embodiments of the present invention, the earthen appearance or aesthetic design may be achieved by utilizing a solid surface coating. The solid surface coating generally includes one or more natural mineral or fiber fillers, one or more polymeric binder resins and one or more initiators. The natural mineral or fiber fillers may include but are not limited to natural stone or rock filler (e.g. granite, marble, quartz, limestone, shale particles), wood fiber, hydrated alumina (e.g. aluminum trihydrate), ground silica, acrylic chips, calcium carbonate, aluminum oxide with pigmented polymer coated quartz, sand, and any other filler that would provide a natural earthen appearance.

Various embodiments of the present invention include one or more polymerizable binder resins. In one embodiment, the present invention provides a system comprising initiators and one or more of the polymerizable binder resins, each binder resin bearing one or more polymerizable groups. In accordance with this embodiment, the photoinitiator group serves to initiate polymerization of the polymerizable groups, thereby forming a polymeric coating, e.g., in the form of a layer covalently bound to the support surface (e.g. block surface or landscaping product surface) of a desired article via the one or more initiators. As used herein, "polymerizable group" shall generally refer to a group that is adapted to be polymerized by initiation via free radical generation, and more preferably by photoinitiators activated by visible or long wavelength ultraviolet radiation.

Suitable polymerizable compounds are selected from monomeric polymerizable molecules (e.g., organic monomers), and macromeric polymerizable molecules (e.g., organic macromers). As used herein, "macromer" shall refer to a macromolecular monomer having a molecular weight of about 250 to about 25,000, and preferably from about 1,000 to about 5,000. For purposes of the present invention, and unless specified otherwise, the term "monomer" when used in this respect shall generally refer to monomeric and/or macromolecular polymerizable molecules.

In yet another embodiment, the polymerizable monomer compounds of the present invention comprise macromeric polymerizable molecules. Suitable macromers can be synthesized from monomers such as those illustrated above. According to the present invention, polymerizable functional components (e.g., vinyl groups) of the macromer can be located at either terminus of the polymer chain, or at one or more points along the polymer chain, in a random or nonrandom structural manner.

Examples of some polymerizable binder resins that may be utilized in the present invention include, but are not limited to, polyurethanes, polyepoxides, epoxy-acrylates, epoxide and epoxy resins, urethane acrylates, methacrylates, unsaturated polyesters, polyols, acrylics and monomers and oligomers having similar backbone structures of these resins.

The coatings also include one or more initiators. Generally the initiators are polybifunctional reagents of the invention carry one or more pendent latent reactive (e.g. photoreactive or thermoreactive) moieties covalently bonded to the resin. Various embodiments of the coatings of the present invention include one or more photoreactive moieties that are sufficiently stable to be stored under conditions in which they retain such properties. Latent reactive moieties can be chosen that are responsive to various portions of the electromagnetic spectrum, with those responsive to ultraviolet and visible portions of the spectrum (referred to herein as "photoreactive") being particularly preferred.

Photoreactive moieties respond to specific applied external stimuli to undergo active specie generation with resultant covalent boding to an adjacent chemical structure, e.g., as provided by the same or a different molecule. Photoreactive moieties are those groups of atoms in a molecule that retain their covalent bonds unchanged under conditions of storage but that, upon activation by an external energy source, form covalent bonds with other molecules.

The photoreactive moieties generate active species such as free radicals and particularly nitrenes, carbenes, and excited states of ketones upon absorption of external electric, electromagnetic or kinetic (thermal) energy. Photoreactive moieties may be chosen to be responsive to various portions of the electromagnetic spectrum, and photoreactive moieties that are responsive to e.g., ultraviolet and visible portions of the spectrum are preferred and are referred to herein occasionally as "photochemical" moiety.

Photoreactive aryl ketones, such as acetophenone, benzophenone, anthraquinone, anthrone, and anthrone-like heterocycles (i.e., heterocyclic analogues of anthrone such as those having N, O, or S in the 10-position), or their substituted (e.g., ring substituted) derivatives are utilized in some embodiments of the present invention. The functional groups of such ketones are preferred since they are readily capable of undergoing the activation/inactivation/reactivation cycle described herein. Benzophenone is one photoreactive moiety that may be utilized, since it is capable of photochemical excitation with the initial formation of an excited singlet state that undergoes intersystem crossing to the triplet state. The excited triplet state can insert into carbon-hydrogen bonds by abstraction of a hydrogen atom (from a support surface, for example), thus creating a radical pair. Subsequent collapse of the radical pair leads to formation of a new carbon-carbon bond. If a reactive bond (e.g., carbon-hydrogen) is not available for bonding, the ultraviolet light-induced excitation of the benzophenone group is reversible and the molecule returns to ground state energy level upon removal of the energy source. Photoactivatable aryl ketones such as benzophenone, thioxanthone, camphorpyinone and acetophenone are of particular importance inasmuch as these groups are subject to multiple reactivation in water and hence provide increased coating efficiency.

Other initiators may include one or more photointiated reagents including four or more reactive groups. Examples of such initiators include tetrakis (4-benzoylbenzyl ether), the tetrakis (4-benzoylbenzoate ester) of pentaerythritol, and an acylated derivative of tetraphenylmethane.

The azides constitute another class of latent reactive moieties and include arylazides ($C_6R_5N_3$) such as phenyl azide and particularly 4-fluoro-3-nitrophenyl azide, acyl azides (—CO—$N_3$) such as benzoyl azide and p-methylbenzoyl azide, azido formates (—O—CO—$N_3$) such as ethyl azidoformate, phenyl azidoformate, sulfonyl azides (—$SO_2$—$N_3$) such as benzenesulfonyl azide, and phosphoryl azides $(RO)_2PON_3$ such as diphenyl phosphoryl azide and diethyl phosphoryl azide. Diazo compounds constitute another class of photoreactive moieties and include diazoalkanes (—$CHN_2$) such as diazomethane and diphenyldiazomethane, diazoketones (—CO—$CHN_2$) such as diazoacetophenone and 1-trifluoromethyl-1-diazo-2-pentanone, diazoacetates (—O—CO—$CHN_2$) such as t-butyl diazoacetate and phenyl diazoacetate, and beta-keto-alpha-diazoacetates (—CO—$CN_2$—CO—O—) such as t-butyl alpha diazoacetoacetate. Other photoreactive moieties include the aliphatic azo compounds such as azobisisobutyronitrile, the diazirines (—$CHN_2$) such as 3-trifluoromethyl-3-phenyldiazirine, the ketenes (—CH═C═O) such as ketene and diphenylketene.

The solid surface coating may be applied to the surface of the landscaping product of the present invention by any type of process that would provide substantial coverage of the product surface and secure attachment of the coating, such as spray coating, dip coating and the like. In various embodiments of the present invention, the solid surface coating may be administered to the product surface in a one step or two step process. For example, in a one step process, a substantially homogenous mixture of the filler, polymerizable resin and initiators are administered to the surface of the product and the initiators then subsequently activated to polymerize the resin and attach the coating to the surface.

Alternatively, a two step or grafting process may be utilized to administer the solid surface coating. In such a process, the initiator is first administered to the surface and activated to attach the initiator to the surface. Once the initiator is attached, a substantially homogenous mixture of the filler and polymerizable resin is administered to the surface and the initiator is again activated to polymerize the resin and attach the mixture to the surface. It is noted that in various embodiments of the present invention, a tie-in layer may be applied to the surface to facilitate better attachment of the solid surface coating. For example, one or more layers, such as a silane, Plexar, Binel, siloxane and/or Parylene layer(s) may be applied to the surface prior to administration of the solid surface coating.

In other embodiments of the present invention, the landscaping products, including the exposed components of the mass confinement cells (e.g. front panel, fascia, end cap, cell cap), may be colored and further textured utilizing a painting process. One such painting process that may be used with various embodiments of the present invention is a polymer adhesion painting process wherein a polymeric paint is adhered to the surface of the mass confinement cell 10, 210 after the surface of the cell, such as the front panel 24, 224, 324, the fascia 64, 264, 364, the end cap 364 or the cell cap 114, has been flame treated or plasma treated. In one polymer adhesion painting method, the mass confinement cell is manufactured utilizing a process, such as injection molding, structural foam molding (e.g. low pressure multi-nozzle structural foam), rotomolding, thermofonning, extrusion or any other process. Next, all surfaces of the mass confinement cell intended to be painted are flame treated or plasma treated with an ion gun prior to applying paint. The flame treating may be performed with any gas torch system, such as propane, acetylene and the like. Plasma treatment may also be performed by any device that forms a gas plasma that can be directed to the polymeric surface. The flame or plasma treated surface should be painted within 24 hours, optionally within 8 hours and further optionally within 5 hours. Once the surface has been flame or plasma treated, a polymeric paint, such as a polyurethane paint, is mixed with a crosslinker and applied to the surface or surfaces of the mass confinement cell 10, 210, 310. It is noted that the thermal paint mixture should be applied shortly after mixing; in some embodiments almost immediately. One example of the types of polymeric paints that may be utilized with embodiments of the present invention is a two-component polyurethane that generally includes a mix ratio of five parts colored paint with one part crosslinker (e.g. XL-003 crosslinker or an isocynate). Two examples of two such polyurethane based paints are as follows:

EXAMPLE 1

| HIGH SOLIDS ALLPHATIC POLYURETHANE<br>120 Series | |
|---|---|
| DESCRIPTION | |
| High Solids 3.5 V.O.C. two component polyurethane for metal, plastic, and interior wood. It is used for industrial and automotive applications. This system has excellent chemical and stain resistance. It has shown excellent adhesion to many substrates with good mar and abrasion resistance and it has 2-3 H hardness. | |
| CHARACTERISTICS | |
| Density - lbs/gal: | 7.95-13.0 |
| Solids, wt. %: | 51-70 |
| Solids, volume: | 42.9-60 |
| Viscosity: | 35-42 Sec. |
| Flash Point ° F. | 80 |
| Application Method: | Conventional of HVLP |
| Reduction for Application: | 5-base; 1-XL009; 1-acetone<br>6-base; 1-XL003; 1-20LT161 |
| Pot Life: | 3-HRS @ 70° F. |
| Cure Schedule: | 30 min @ 180° F. |
| Gloss 60°: | Flat to 96 |
| VOC as supplied - lbs/gallon: | 3.0-3.6 |
| VOC as applied - lbs/gallon: | 2.9-3.5 |

EXAMPLE 2

| MEDIUM SOLIDS ALLPHATIC POLYURETHANE<br>121 Series | |
|---|---|
| DESCRIPTION | |
| The 121 Series is a medium solids, low temperature cure two component polyurethane for use on metal and plastic. It is used for industrial and automotive applications. This system has excellent chemical, stain, and water soak resistance. It has good adhesion to many substrates with good mar and abrasion resistance and it has 2 H hardness. | |
| CHARACTERISTICS | |
| Density - lbs/gal: | 7.92-11.0 |
| Solids, wt. %: | 45-67 |
| Solids, volume: | 37-48 |
| Viscosity: | 45 sec Zahn#2 |
| Flash Point ° F. | 78 |
| Application Method: | HVLP; Conv. |
| Reduction for Application: | 4-base; 1-XL009<br>5-base; 1-XL003 |
| Pot Life: | 2 hrs @ 70° F. |
| Cure Schedule: | 35 min @ 160° F., Air Dry<br>tack free 40 min |
| Gloss 60°: | Flat to 96 |
| VOC as supplied - lbs/gallon: | 3.6-4.3 |
| VOC as applied - lbs/gallon: | 3.37-4.0 |

Both polymer adhesion paints of Examples 1 and 2 are manufactured and distributed by:
PRIME COATINGS
1002 Hickory Street Pewaukee, Wis. 53072
www.primecoatings.net
Telephone: (262) 691-1930

The polymer adhesion paints may be applied in any manner known in the art including, but not limited to, spraying, dipping, brushing, sponging and any other paint application method. In various embodiments polymer adhesion paint is applied by spraying. Generally, less than 40 mils of paint are applied to the surface intended to be painted. In other embodiments less than 20 mils of paint is applied and in other embodiments less than 10 mils of paint is applied to the surface intended to be painted. In one example, approximately 0.2 to 1.5 mils dry film thickness of base color was applied to the entire surface of a fascia. Once the base paint has been applied, secondary colors may optionally be applied to the wet or dry base coat as desired. Such secondary colors may be applied in similar ways as the base paint, such as spraying, dipping, brushing, sponging and any other spray technique known in the art. It is also noted that a primer layer may be applied to the substrate surface prior to applying the paints described herein. For example, a coating of binel, parylene or another primer coat may be applied to the surface prior to applying the paint to promote optimum adhesion.

Once the paint has been applied to the desired surface of the mass confinement cells, the product is then cured. In various embodiments of the present invention, the product is oven cured following painting at a temperature of 220° F. and less (e.g. 175° F. to 220° F.); in other embodiments 185° F. and less (e.g. 150° F. to 185° F.); and in still other embodiments 160° F. and less (e.g. 100° F. to 150° F.). In various embodiments the paint, is cured at the above mentioned temperatures for a period of 2 minutes to 4 hours; in other embodiments 5 minutes to 2 hours and in still other embodiments 10 minutes to 30 minutes. The product is then allowed to air dry. Once air dried, the mass confinement cell is ready for installation. It is noted that the curing process may be performed at room temperatures, but the curing time usually will be lengthened accordingly.

As previously indicated the mass confinement cells 10 of the present invention generally include a frame 12, 212, 312 that has one or more side panels 16, 216, 316 that engage and extend from the front panel 24, 224, 324 back to engage with a back panel 14, 214, 314. As depicted generally in a number of the FIGS., various embodiments of the present invention include side panels 16, 216, 316 engaging the front panel 24, 224, 324 at angles to provide for a tapering of the confinement cell as it moves back in width. The angle formed between the front panel 24, 224, 324 and side panel 16, 216, 316 is generally less that 90° when the front panel 24, 224, 324 is substantially straight and less than 150° when the front panel 24, 224, 324 is rounded or beveled. In other embodiments, the angle is between about 45° and 85° for substantially straight front panels 24, 224, 324 and between 60° and 110° for beveled and rounded front panels 24, 224, 324. In various embodiments the side panels 16, 216, 316 may extend from the front panel 24, 224, 324 at angles that would allow them to engage each other at the back of the confinement cell, thereby forming the back panel 14, 214, 314 and chamber 20, 220, 320 by their engagement (e.g. a triangle or diamond configuration). Finally, in various embodiments, the top edge of the side panels 16, 216, 316 may slightly slope down from front to back, thereby providing a back end of the confinement cell that is slightly lower than the front of the confinement cell (e.g. 0.5-10 mm).

Figure 32:
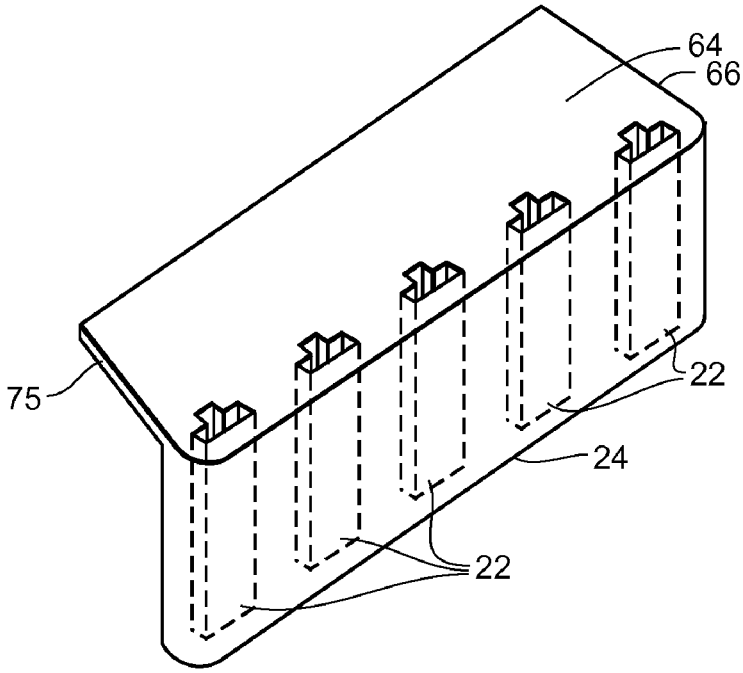
FIG. 32 is a perspective view of one embodiment of a front panel including a partial top panel having a plurality of securing mechanisms.

In various embodiments of the present invention, the mass confinement cell 10, 210, 310 further includes a partial top panel that extends from the front panel 24, 224, 324 or fascia 54, 254, 354 that is exposed when a retaining wall is constructed. The partial top panel assists to close or partially close the top front portion of the confinement cell 10, 210, 310 that may be exposed to the outer environment. In various embodiments, the mass confinement cells 10, 210, 310 include a partial top panel that extends from the front panel 24, 224, 324 or fascia 54, 254, 354 back to no more than 80% of the depth of the confinement cell 10, 210, 310. It is noted that cell depth is measured from the front panel 24, 224, 324 or fascia 54, 254, 354 to the back panel 14, 214, 314 of the confinement cell 10, 210, 3 10. In other embodiments of the present invention, such a partial top panel extends from the front panel 24, 224, 324 or fascia 54, 254, 354 no more than 50% of the depth of the confinement cell. In yet other embodiments the partial top panel extends from the front panel 24, 224, 324 or fascia 54, 254, 354 no more than 35% of the depth of the confinement cell (e.g. 5% to 30%). Such a partial top panel provides for at least a partial sealing of the confinement cell at the top front portion, of which may be exposed when the retaining wall is constructed in a configuration wherein the wall inclines back toward the surface or slope intended to be protected. It is noted that in various embodiments the top panel may further include one or more planting apertures (not shown) that may allow plant growth from the top surface of the confinement cell 10, 210, 310. As previously suggested, the open top and bottom of each mass confinement cell 10, 210, 310 allows for the receiving and commingling of fill material that may flow from and through the confinement cell 10, 210, 310 to one or more adjacent cells 10, 210, 310 below or above. FIG. 32 depicts one embodiment of a front panel 24, 224 that includes a partial top panel 64.

The partial top panel 64 may further include optional top side panels 66 that extend downward from the partial top panel 64 and may extend over or within the side panels (not shown) of the confinement cell (not shown). The partial top panel 64 may also include one or more planting apertures (not shown) that allow for the growth of plants from the top of the mass confinement cells 10, 210, 324.

Also, various embodiments, as depicted in may also include a front panel 24, 224, 324 and/or enclosing member 18, 218, 318 that has more than two securing mechanisms 22, 222 positioned at various positions on the front panel 24, 224, 324 and/or enclosing member 18, 218, 318. FIG. 32 depicts a front panel 24 that includes more than two securing mechanisms 22. This is advantageous if partial cells are required. For example, the confinement cell 10, 210, 310 may be cut and a peg of the side panel 16, 216, 316 may be secured into the additional socket of the securing mechanism 22, 222 to secure the front panel 24, 224, 324 or enclosing member 18, 218, 318 to the rest of the confinement cell 10, 210, 310. By providing additional securing mechanisms 22, 222, the cutting of the front panel 24, 224, 324 or enclosing member 18, 218, 318 still allows for the remaining portion to have two outer securing mechanisms 22, 222 for securing a side panel 16, 216, 316 to the cut front panel 24, 224, 324. Partial confinement cells 10, 210, 310 may further include one or more shorter stabilizing partitions to assist in securing the two halves of the cell together and further stabilizing the confinement cell 10, 210, 310 after cutting.

It is noted that in some embodiments, the partial top panel 64, as depicted in FIG. 32, may extend back from the top edge of the front panel 24, 224, 324 to the top edge of a partition 44. Therefore, an example of such an embodiment would provide for a partial top panel 64 extending from the front panel 24 to the partition 44 on the mass confinement cell of FIG. 13. In some embodiments, ribbing or inner stability ridges (not shown) may be positioned between the front panel 24 and partition 44 to provide additional stability to the structure.

Figure 33:
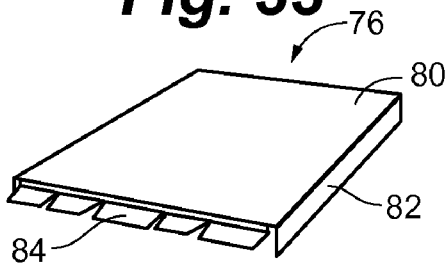
FIG. 33 is a perspective view of a top cover embodiment used to cap a deterioration resistant mass confinement cell.
Figure 34:
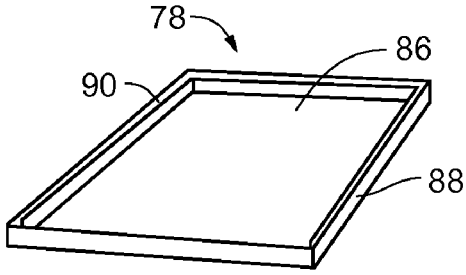
FIG. 34 is a perspective view of bottom cover embodiment used to seal a deterioration resistant mass confinement cell.

FIGS. 33 and 34 depict various embodiments of top covers 76 and bottom covers 78, which are configured and adapted to securely fit over or under embodiments of the mass confinement cell 10, 210, 310 of the present invention. Generally, in some embodiments, the top covers 76 and bottom covers 78 utilized in constructing some of the retaining walls of the present invention are at the very top of the wall and very bottom of the wall to at least partially seal the continuous chamber channels. However, the use of such covers 76, 78 at intermediate locations through the wall may also be performed. In various embodiments of the present invention, the top cover 76 generally includes a continuous top panel 80 that includes optional overlapping edges 82, which overlap securely over the outside side and back panels 14, 16. In some embodiments of the invention, the overlapping edges 82 may be present around the entire perimeter of the top panel 80. Alternately, a forward extending apron 84 may be positioned at the front of the top cover 76 and utilized to secure the cover 76 to the adjacent confinement cell 10, 210, 310 below by inserting the apron 84 under the top panel of the cell 10, 210, 310 below.

Embodiments of the bottom covers 78 of the present invention, as depicted in FIG. 34, may include a bottom panel 86 with attached bottom side walls 88 extending around the perimeter of the bottom panel 86. The side walls 88 may be configured to overlap the front, back and side panels 24, 14, 16 or configured to nest within the front, back and side panels 24, 14 and 16. In other embodiments, as depicted in FIG. 34, the overlapping sides may include an optional channel 90 for receiving and retaining the front, side and back panels 12, 14, and 16 of the adjacent confinement cell 10 above. Alternatively, the top covers 76 and/or bottom covers 78 may include only a top panel 80 or bottom panel 86 that nest and optionally secure into place just within the front panel 24, back panel 14 and side panels 14 of the confinement cell 10. Additionally, the top cover 76 may include one or more planting apertures (not shown) for allowing the growth of vegetation from the mass confinement cell.

Figure 35:
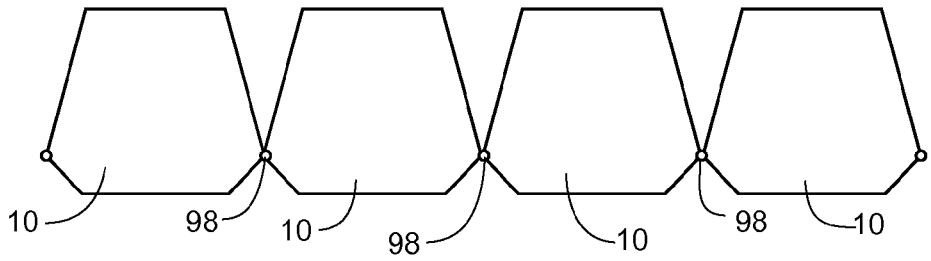
FIG. 35 depicts a top view of a deterioration resistant retaining wall row that includes a plurality of cells that have interlocking pegs and hinges.

FIGS. 35-38 depict other embodiments of the present invention wherein the mass confinement cells 10, 210, 310 include an interconnecting device 98. It is noted that in the mass confinement cell 10, 210, 310 embodiments, the interconnecting device 98 may be a securing mechanism as described above or a variation thereof. In various embodiments, as depicted in FIG. 35 the interconnecting device 98 includes a peg and socket system having one or more insertable pegs 92 to adjoin two or more confinement cells by inserting the pegs 94 into threads 94 that form a socket. The sockets are generally positioned on an edge or just inside the edge of the front, side and/or back panels 24, 16, 14. The sockets may be integral to the front or back panels 24, 14 or may be secured to the panels 12, 16, 14 in any manner known in the art. The pegs 92 are configured to be securely receivable in the sockets and may be configured to swivel the confinement cell 10, 210. The insertable pegs 92 can be made of any shape and size, which can be securely fit into the sockets.

Figure 36:
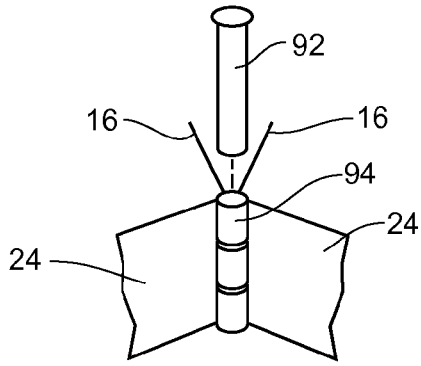
FIG. 36 depicts an exploded perspective view of an embodiment of an interlocking mechanism used with the deterioration resistant mass confinement cell that includes pegs and hinges.

Alternatively, in one embodiment of the present invention side by side adjacent confinement cells 10, 210, 310 may be adjoined with a clipping device 108. In one embodiment as depicted in FIG. 36, the clipping device 108 may be configured in a U shape and sized to snuggly fit over the side panels 16 of two adjacent confinement cells.

Figure 37:
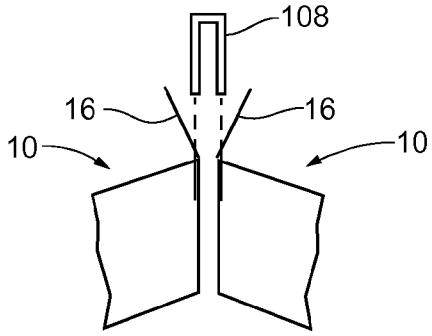
FIG. 37 depicts a perspective view of an embodiment of an interlocking mechanism use with the deterioration resistant mass confinement cell of the present invention that is a clipping device.
Figure 38:
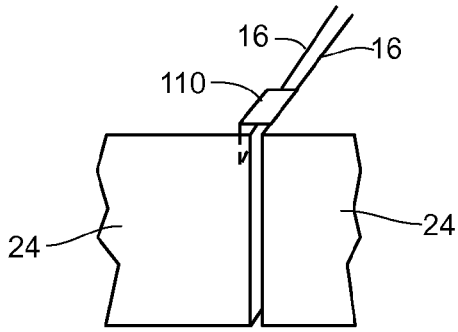
FIG. 38 depicts a perspective view of an embodiment of an interlocking mechanism use with the deterioration resistant mass confinement cell of the present invention of the present invention that is an integral hook.

FIG. 37 depicts an additional embodiment of the present invention, similar to hook attachments, wherein the mass confinement cell 10, 210, 310 includes an interlocking feature that comprises a hook or peg 110. An optional pocket (not shown) may also be placed in the confinement cell 10, 210 for receiving the hook 110 from adjacent confinement cells 10, 210, 310. In such an embodiment one or more hooks or pegs 110 extend from one side panel 16, 216, 316 of a mass confinement cell 10, 210, 310 and may be inserted over the opposite side panel 16, 216, 316 of an adjacent cell 10, 210, 310. Such interlocking mechanisms provides for a overall secure retaining wall structure by reducing the amount of movement that may occur during filling with unsecured individual cells.

Another advantage of certain embodiments of the mass confinement cells of the present invention is that they also allow for easy storage and transport due to the stackable capabilities present. For example, mass confinement cell are easily transported and stored by positioning the front panel 24, 224, 324 back panels 14, 214, 314 and/or side panels 16, 216, 316 in a flat configuration and stacking and/or nesting the respective panels when in transport or storage. Additionally, the load cells of the embodiments previously disclosed may be transported or stored in a nested position. Other nesting positions or stacked positions may also be utilized with various embodiments of the present invention.

Figure 39:
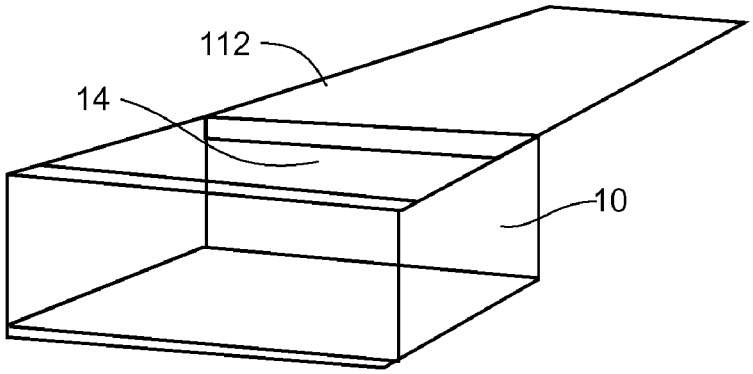
FIG. 39 depicts a perspective view of an embodiment of a deterioration resistant mass confinement cell including a structural stabilization grid.

As previously suggested, the mass confinement cell 10, 210, 310 of the present invention may also be utilized with other wall stabilizing products to secure and stabilize a structure constructed of such cells 10, 210, 310. For example, as depicted in FIG. 39, embodiments of the mass confinement cell 10, 210, 310 of the present invention may include a structural grid 112 that is attached to a confinement cell 10, 210, 310 (e.g. attachment to the upper front panel 12, back panel 14, bottom panel). The grid is generally buried behind the wall constructed of the confinement cells of the present invention and acts to support and stabilize the wall from moving forward away from the embankment it is protecting and also stabilizes the soil or fill material positioned behind the wall.

In various embodiments of the present invention, a plurality of confinement cells 10, 210, 310 and/or multiunit confinement cells or partial components of the cells 10, 210, 310 may be positioned upon a base system such as poured concrete, laid cinder block or a base of polymeric block confinement systems, such as Geo-block® or similar to Geo-block®. The intermingling of the confinement cells 10, 210, 310 of the present invention with the base systems provides further stability to a retaining wall structure, as well as allows for the construction of an aesthetically pleasing wall.

As previously mentioned, in various embodiments of the present invention, at least the front panel or fascia of the mass confinement cells include a deterioration resistant, substantially rigid composite or polymeric material including, but not limited to, plastic (e.g. recycled or virgin), a rubber composition, fiberglass, or any other similar material or a combination thereof. However, in many embodiments of the present invention, all of the components of the mass confinement cell comprise a deterioration resistant, substantially rigid composite or polymeric material. In various embodiments of the present invention materials comprise light-weight and slightly flexible polymers, such as high and low density polyethylene. However, other plastics may also be used. Examples of other plastics include, but are not limited to polypropylene, acrylonitrile-butadiene-styrene (ABS), Polyethylene terephthalate (PET), polycarbonate, poly(butylene terephthalate) (PBT), poly(cyclohexanedimethylene terephthalate) (PCT), styrene-acrylonitrile copolymers (SAN), polyesters, polystyrene, polyvinyl chloride (PVC), polyurethane, copolymers including one or more of the previously mentioned polymers and combinations thereof. It is also noted that the deterioration polymeric materials may also be utilized with filler materials or recycled filler materials, such as titanium, carbon fibers, nylon, talc, glass, saw dust or paper byproducts, plastic and the like. Generally, the embodiments of the present invention may comprise any type of material that would have the similar characteristics to plastic, vinyl, silicone, fiberglass, rubber or a combination of these materials. However, in some embodiments one or more components, such as the frame may be manufactured from rigid materials such as metals and alloys (e.g. steel, aluminum), wood, ceramics and the like. It is noted that the material utilized in the present invention should be rigid enough to hold its form upon addition of filling material and also when placed in contact with other objects. Also the panels of the mass confinement cells should be substantially non-collapsible when in a filled and stacked state. Another material that may be utilized to form the components of the present invention may comprise a material similar to that utilized in the production of some types of garbage cans or the utilization of recycled rubber from objects such as tires. Such materials would be capable of holding rigidity and still offer flexibility when placed in contact with other objects, such as ice. Also, such materials have the ability to regain its original form when the object or material has been removed.

Embodiments of the present invention may also vary in appearance. Since embodiments of the present invention may be manufactured by a process such as injection molding, structural foam molding, extrusion, thermo-forming, compression molding, roto-molding and the like, the molds may include any type of design or shape. Furthermore, the mass confinement cells may be manufactured in a multitude of different sizes, shapes and configurations. For example, an embankment or steep shoreline could support a retaining wall configured in a step like arrangement or design. Such a structure may be utilized as a retaining wall and/or a stairway down to a beach or to the water. In another embodiment, multiple mass confinement cells 10, 210, 310 could be molded to include designs that, when positioned on a retaining wall, would complete a larger single design, such as the spelling of a company or school name in large letters or the completion of a large image. Also, since the present invention may be manufactured from and/or include a number of different products, such as plastic, a rubber composition or fiberglass, and may include any color or a multitude of colors. For example, a retaining wall installed in a beach setting may be manufactured of a plastic or rubber product and be colored in so that organic matter wash up on it would not show up as readily or may take on the appearance of sand.

Additionally, in various embodiments of the present invention, one or more lighting devices may be incorporated into the mass confinement cells of the present invention. For example, lighting devices (e.g. Light Emitting Diodes (LEDs), halogen lights, fluorescent lights, incandescent lights) may be attached to the frame, pass through the frame or attached to the front or back surface of the fascia. Such lighting devices, when lit, will illuminate the front panel of the frame and/or the fascia. Any power source may be utilized to power the lighting devices. Examples of power sources that may be utilized with the mass confinement cells of the present invention include, but are not limited to, batteries, conventional electrical circuits and wiring, solar, wind or any other source that would provide the requisite power to light the lighting device. In some embodiments, solar panel lighting fixtures are affixed or pass through the front panel of the frame, thereby positioning such lighting fixtures between the frame and fascia. In other embodiments one or more lighting devices may be position on the perimeter of the front panel and fascia to thereby illuminate the front surface of the mass confinement cell.

As previously suggested the environment resistant mass confinement cell is utilized in the construction of any type of wall or border. In application, the confinement cells 10, 210, 310 are provided in a desired and assembled form. For various embodiments of the confinement cells 10, 210, 310 some assembly may be required, such as securing the snaps on the frame and attaching the load cell 204 and fascia 354 to a frame 212 or attaching the enclosing member 18, 318 to the frame 12, 312. Next, a foundation is prepared in the area that the wall or border is to be constructed. The foundation preferably is flat, compacted and level and can accommodate one or more mass confinement cell 10, 210, 310 and optionally one or more base systems. In various embodiments, one or more courses of confinement cells 10, 210, 310 may be partially submerged or totally submerged below the earth surface to provide wall stability. Once a foundation is completed, a first row is laid by positioning the confinement cells 10, 210, 310 in their proper position side by side and filling each individual confinement cell 10, 210, 310 with a fill material while back filling behind the row until the row is completed. A fill material compacting device may be utilized while or after filling to ensure stability of the fill material as the wall is constructed. For example, a packing device may be utilized to pack the fill material after filling each row of confinement cells 10, 210, 310. The chamber 20, 220, 320 is normally filled with materials such as sand, crushed rock, pea rock, gravel, dirt, cement, concrete or other like materials to provide weight and structure stability to the mass confinement cell 10, 210, 310 and the entire retaining wall. The filling of each mass confinement cell 10, 210, 310 gives it the added weight that it needs to retain its structure and hold it in place. A funneling device (not shown) may be utilized, which fits securely into the openings or apertures of the mass confinement cell 10, 210, 310 to guide fill into the chamber 20, 220, 320 of the cell 10, 210, 310. The first row and subsequent rows may be straight or curved. Upon completion of the first row, additional rows are constructed by placing the mass confinement cells 10, 210, 310 in the proper position and performing the same filling and back filling process until a continuous chamber retaining wall is completed. It is noted that with the continuous chamber system of the present invention, multiple rows can be secured in place before filling and/or packing. However, it is recommended that filling and packing be done regularly (e.g. row by row) to ensure proper packing of the fill material.

Generally, a continuous chamber system retaining wall includes stacked rows wherein individual confinement cells 10, 210, 310 are placed adjacent to one another thereby eliminating or minimizing cracks or gaps in the wall. Rows of mass confinement cells 10, 210, 310 may be positioned directly over other rows of mass confinement cells 10, 210, 310 wherein the cells 10, 210, 310 are positioned directly over other cells 10, 210, 310. However, many embodiments of the present invention provide a constructed wall wherein the mass confinement cells 10, 210, 310 are staggered in alternating rows. It is also noted, that the constructed wall may further be secured to the slope by positioning geogrid between rows of mass confinement cells 10, 210, 310 and extending the geogrid back into the slope. Such action may be performed between each row or alternated every row, every 2-10 rows, and optionally every 3-5 rows.

Each mass confinement cell 10, 210, 310 placed in the retaining wall is configured to retain and seal the contents of the fill material back towards the slope when the wall has been properly constructed. This may be further accomplished by applying top covers 76 and/or bottom covers 78 that at least partially seal the continuous chamber system. Alternatively, vegetation may be planted on the top row of the retaining wall to assist in sealing in the contents.

Furthermore, in various embodiments, the mass confinement cells 10, 210, 310 of the upper rows may be further positioned into place by an overlap of the back of confinement cells 10, 210, 310 of lower rows if a retaining flange or peg extensions 52 are included on the confinement cell 10, 210, 310. In the alternative or additionally, each individual confinement cell 10, 210, 310 may be locked into position with adjacent cells if reinforcing members and apertures, clipping devices 108 or hooks 110 are present with the confinement cell 10, 210.

Figure 40:
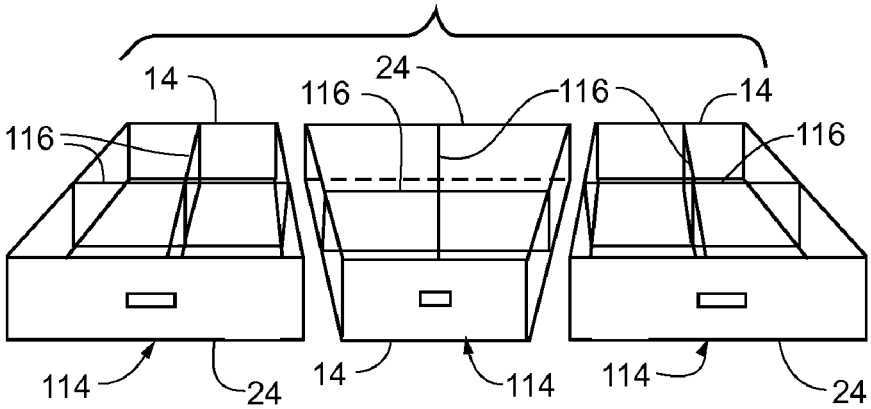
FIG. 40 depicts a front perspective view of one embodiment of a polygonal cell cap that may be utilized with various embodiments of the present invention.

As previously mentioned, upon completion of the top row of the retaining wall, a cover, aesthetic top border or cell cap 114 may be placed on or over the top row to close and seal the continuous chamber system or to provide an aesthetic finishing border to the top of the retaining wall or earth retention system. One embodiment of a cell cap 114, as depicted in FIG. 40, may be polygonal in shape and include textured and designed faces on both the front panels 24, back panels 14 and top of the cell cap 114. The cell caps 114 may further include setting pegs (not shown), similar to those depicted in the previous confinement cell embodiments, that may be utilized to secure the cell cap 114 to the mass confinement cells 10, 210, 310 positioned below. Alternatively, the cell caps 114 may be secured to the mass confinement cells 10, 210, 310 below by any means known in the art, such as clips, tacks, screws, rivets, adhesives or the like. The cell caps 114 may be filled with a fill material, similar to the other embodiments of the present invention, or may be a thinner cap 114 that includes a plurality of reinforcing partitions or ribs 116.

Figure 41:
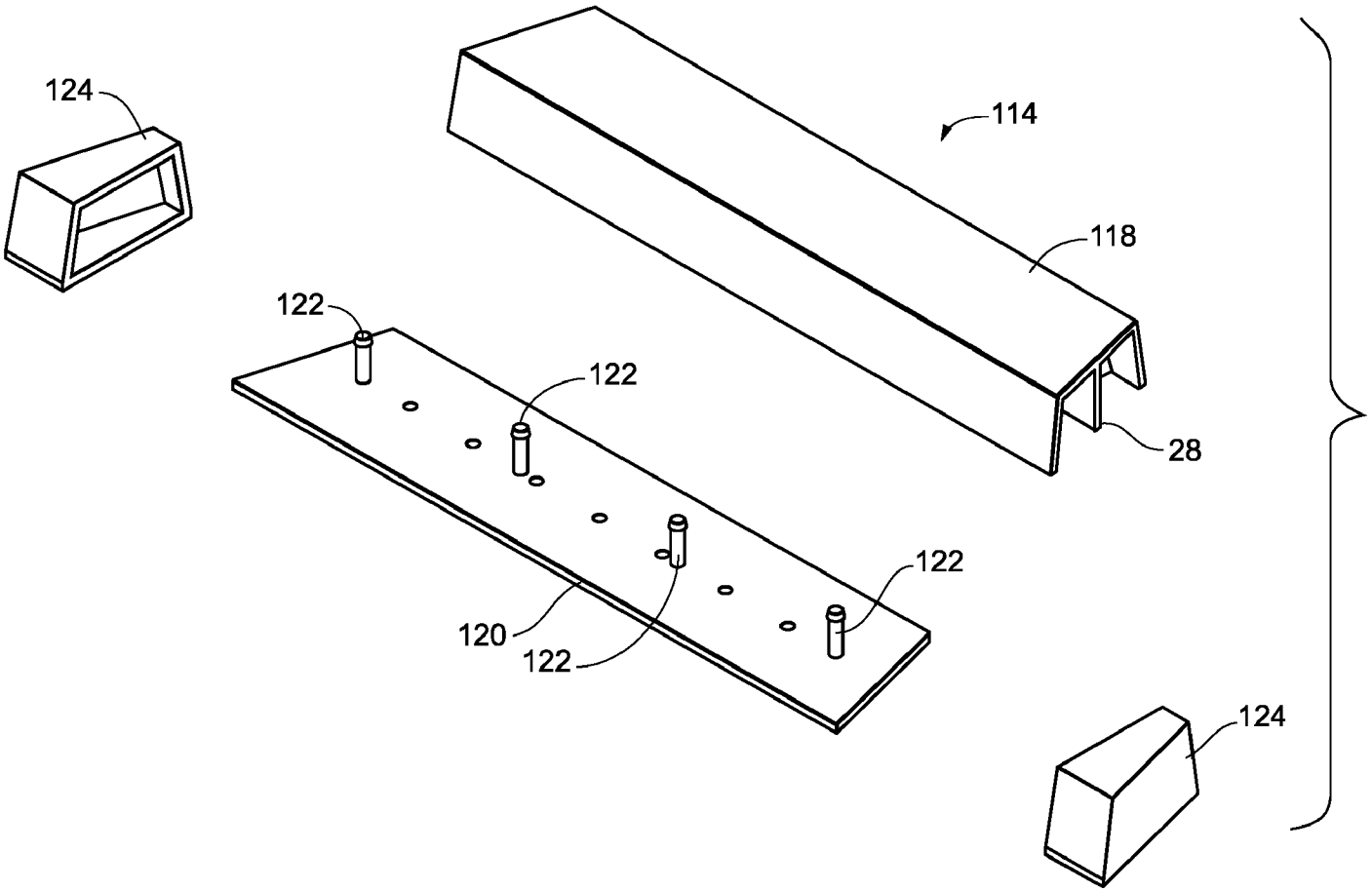
FIG. 41 depicts an exploded view of one embodiment of a cell cap that may be utilized with various embodiments of the present invention.

FIG. 41 depicts an exploded view of another embodiment of a cell cap 114 that may be utilized with the mass confinement cell systems of the present invention. The cell cap 114 of the this embodiment is intended to wholly or partially cover the confinement cells 10, 210, 310 positioned below when finishing the top course of a retaining wall or edges of a revetment. The cell cap 114 of this embodiment may extend a distance from the front edge, or slightly overhanging the front edge of the mass confinement cell 10, 210, 310 back over the top of the top course of confinement cells 10, 210, 310. In various embodiments, the cell cap 114 may extend back a distance of approximately between 5% to 110% of the confinement cell 10, 210, 310. In various embodiments, this distance may translate to approximately 5 cm to 125 cm.

Figure 41A:
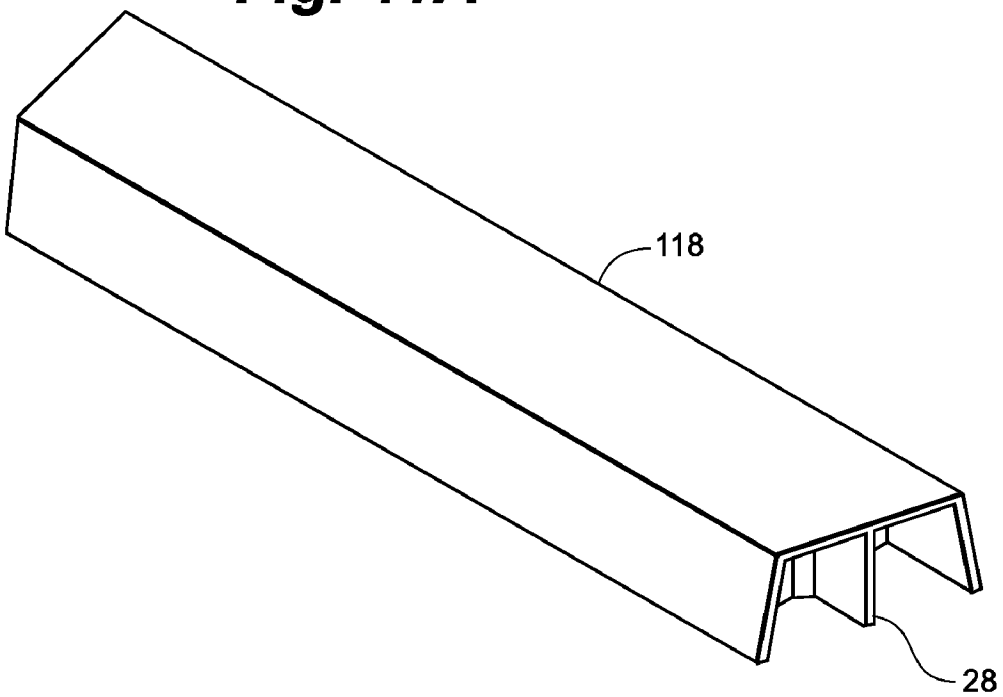
FIG. 41A is a perspective view of one top cap embodiment of the cell cap of FIG. 41.
Figure 41B:
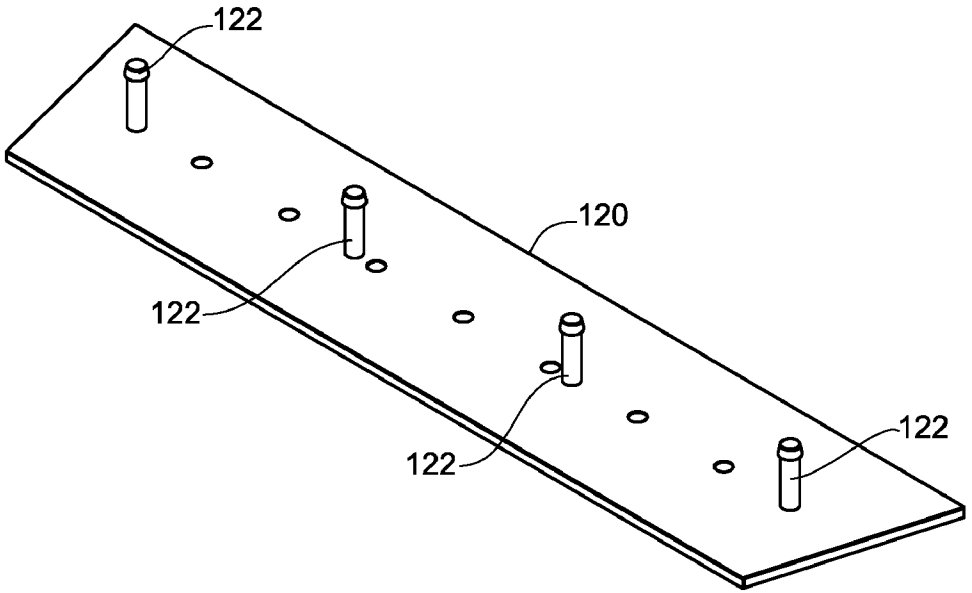
FIG. 41B is a perspective view of one top cover embodiment of the cell cap of FIG. 41.
Figure 41C:
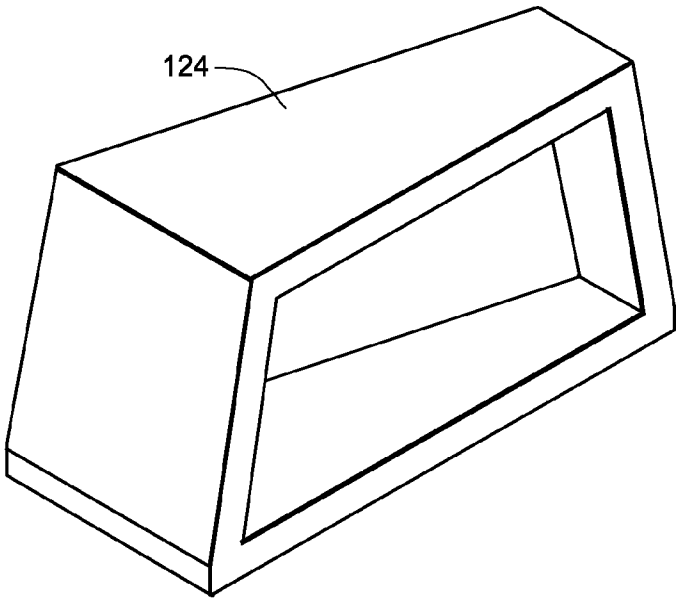
FIG. 41C is a back perspective view of an end cap embodiment of the cell cap of FIG. 41.
Figure 41D:
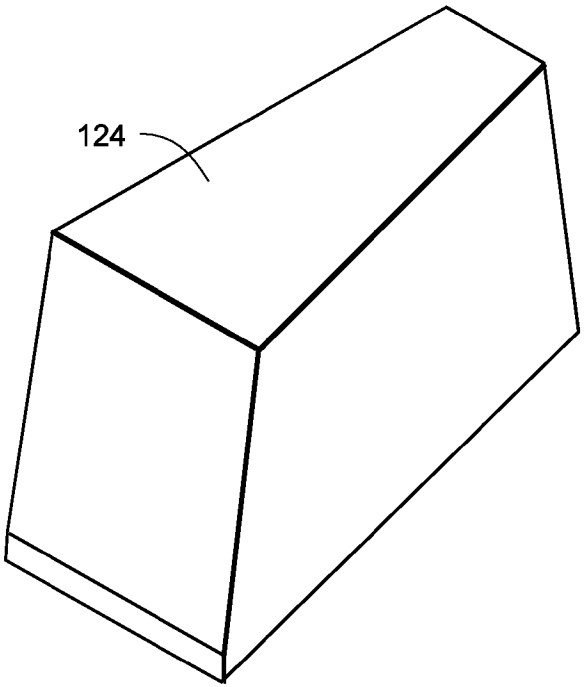
FIG. 41D is a front perspective view of an end cap embodiment of the cell cap of FIG. 41.

The cell cap 114 of the embodiment depicted in FIG. 41A generally includes a top cap 118 that is engageable with a confinement cell cover 120 as depicted in FIG. 41B. The cell cover 120 generally engages the confinement cell 10, 210, 310 positioned below and thereby is intended to lock the cell cap 114 into position on the wall or revetment. The cell cover 120 can engage the mass confinement cell 10, 210, 310 positioned below utilizing one or more cover fasteners 122 that may engage the confinement cell at any applicable surface (e.g. the front panel, side panels, partitions). The cover fasteners 122 may be any type of fastening device, such as pegs, rivets, screws, adhesives, hooks, snaps, tabs and any other means that will secure the cell cap 114 to the cell confinement cells 10, 210, 310. The top cap 118 of this embodiment engages the cell cover 120 by any means to adequately secure the top cap 118 to the cell cover 120. For example, snaps, pegs, tabs, adhesives and any other means to fasten and secure the top cap may be utilized. Additionally, the top cap 118 may further include one or more ribs 28 to provide additional structural support to the top cap 118. The cell cap 114 may further include one or more cell cap end caps 124 that may be secured to the ends of the cell cap 114 to close the outer edges. See FIGS. 41C-D for a back and front view of the end cap 146.

Figure 42:
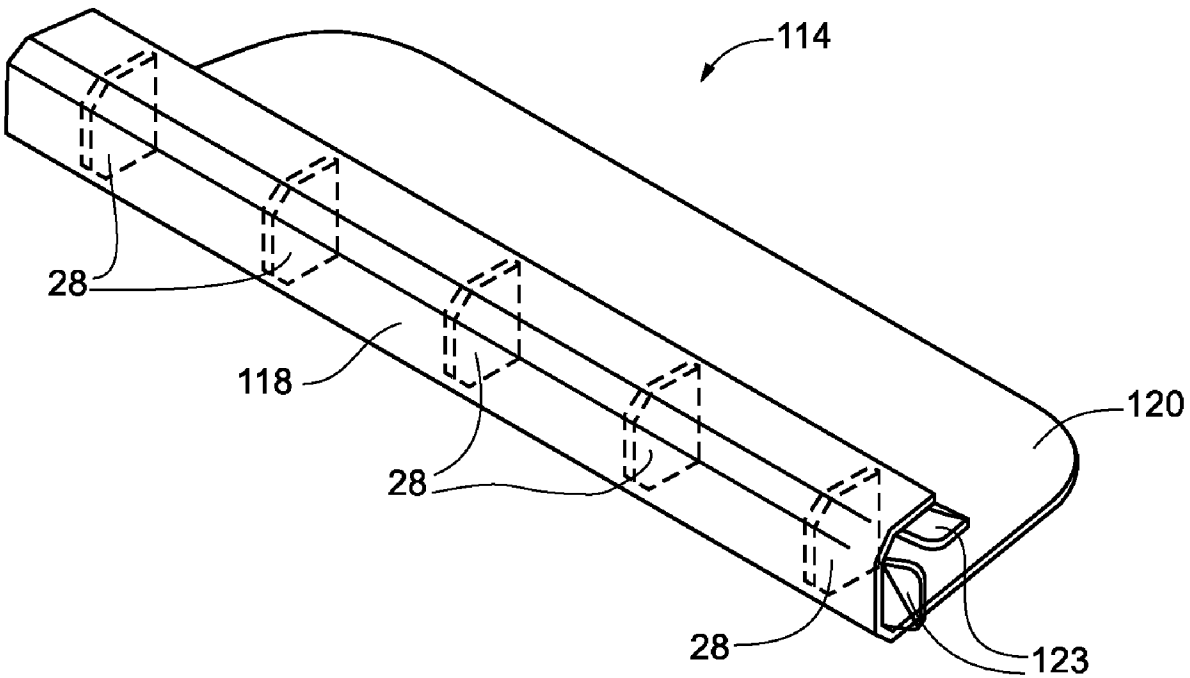
FIG. 42 depicts a perspective view of one embodiment of a cell cap that may be utilized with various embodiments of the present invention.

FIG. 42 depicts another embodiment of a cell cap 114 that may be utilized with the mass confinement cells 10, 210, 310 of the present invention. The cell cap 114 of this embodiment generally includes a top cap 118 adjoined to a cell cover 120. The top cap 118 may be integrally adjoined to the cell cover 120 or may be a separate component attachable to the cell cover 120. The top cap 118 may further include a plurality of ribs 28 to provide additional stability and structure. Similar to the previous embodiment, the cell cover 120 can engage the mass confinement cell 10, 210, 310 positioned below utilizing one or more cover fasteners 122 that may engage the confinement cell at any applicable surface (e.g. the front panel, side panels, partitions). The cover fasteners 122 may be any type of fastening device, such as pegs, rivets, screws, adhesives, hooks, snaps, tabs and any other means that will secure the cell cap 114 to the cell confinement cells 10, 210, 310. Additionally, the cell cap of various embodiments may further include one or more extension flaps 123 that bridge the gaps between adjacent cell caps 114. The extension flaps 123 may be stationary and integrally attached or may be moveable to retract or extend, thereby providing less or more length to each flap 123. In various embodiments, the extension flaps may be placed on a track that allows for the extension or retraction of the flaps 123.

Figure 43:
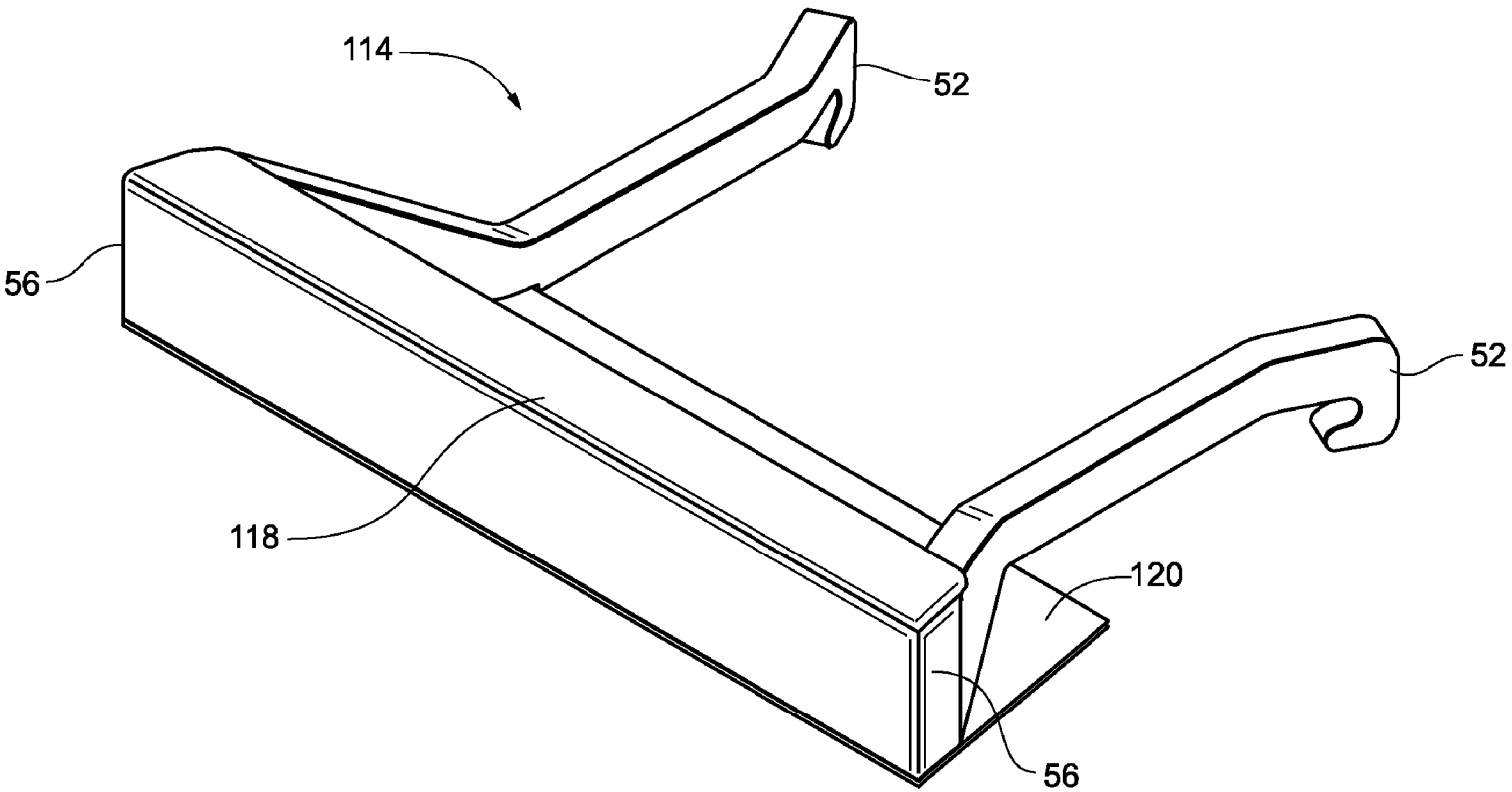
FIG. 43 depicts a perspective view of one embodiment of a cell cap that may be utilized with various embodiments of the present invention.

FIG. 43 depicts yet another embodiment of a cell cap 114 that may be utilized with the mass confinement cells 10, 210, 310 of the present invention. The cell cap 114 of this embodiment generally includes a top cap 118 adjoined to a cell cover 120 and one or more anchoring devices. The anchoring devices in this embodiment may include one or more arms 126 that are operably adjoined to one or more setting extensions 52. The setting extensions 52 may further be locking setting extensions that are configured to secure under an anchoring ridge or slot positioned in the back panel or load cell of the mass confinement cells positioned below. Additionally, the arms 126 may be integrally adjoined to the top cap 118 or adjoined with living hinges 56 and securing snaps, which would allow for the cell cap 114 to be transported and/or stored in a flat or nested configuration. Similar to the previous embodiments, the cell cover 120 can engage the mass confinement cell 10, 210, 310 positioned below utilizing one or more cover fasteners 122 that may engage the confinement cell at any applicable surface (e.g. the front panel, side panels, partitions). The cover fasteners 122 may be any type of fastening device, such as pegs, rivets, screws, adhesives, hooks, snaps, tabs and any other means that will secure the cell cap 114 to the cell confinement cells 10, 210, 310.

The top cap 118 of many embodiments will include the texture and color of all the surfaces intended to be exposed on the front panel 24, 224, 324 or fascia 54, 254, 354 of the cell confinement systems 10, 210, 310 to provide a natural earthen appearance and/or desired design. The top cap 118 may further include a plurality of ribs 28 to stabilize the top cap 118 and prevent crushing or damaging. The top cap 118 and top cover 120 in a number of embodiments may be polygonal in shape, thereby allowing for a continuous cell cap 114 alignment over the length of a wall or revetment. The polygonal shape also allows for a continuous coverage when curving a wall structure.

Embodiments of the present invention may also be used in conjunction with regular dry cement process blocks, bricks or stones, such as those produced by Keystone®, Anchor® Wall Systems or Allan Block®. A retaining wall constructed in water or along a waterfront property may utilize the mass confinement cells of the present invention at water level and below and then the conventional retaining wall materials can be used on top of the mass confinement cells of the present invention. The utilization of the mass confinement cells of the present invention would allow ease in matching colors with the conventional retaining wall building materials because the materials utilized to manufacture the present invention can be colored and designed to match virtually any type of retaining wall construction material.

Figure 44A:
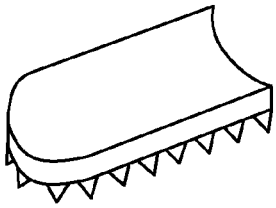
FIG. 44*a* is a perspective top view of one embodiment of an edger that may include the surface coating or lamination of the present invention.
Figure 44B:
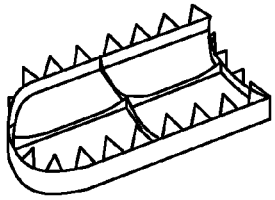
FIG. 44*b* is a perspective bottom view of one embodiment of an edger that may include the surface coating or lamination of the present invention.
Figure 45A:
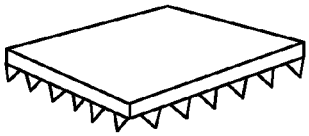
FIG. 45*a* is a perspective top view of one embodiment of a paving stone that may include the surface coating or lamination of the present invention.
Figure 45B:
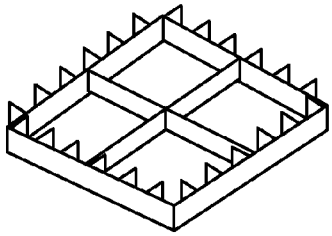
FIG. 45*b* is a perspective bottom view of one embodiment of a paving stone that may include the surface coating or lamination of the present invention.

Finally, the various molding and fabrication processes may be utilized with other landscaping products. For example, the solid surface coating, a polymeric sheet or polymer adhesion paint may be administered or laminated to any landscaping product comprised of a deterioration resistant material (e.g. plastic, fiberglass, etc.), such as landscaping edgers, stepping or patio stones, artificial rocks and boulders, mass confinement cell front panels and fascia and lawn furniture. In such embodiments, the solid surface coating, polymeric sheet or polymer adhesion paint is applied to one or more surfaces of the landscaping products. FIGS. 44*a-b* and 45*a-b* depict two embodiments of the landscaping products that may provide surfaces coated with the solid surface coating, polymeric sheet or thermal paint of the present invention. FIGS. 44*a* and 44*b* depict a top view and bottom view of an edger and FIGS. 45*a* and 45*b* depict a top view and bottom view of a stepping stone. In both of these embodiments, the surface exposed to the outside environment is coated with the solid surface coating or polymeric sheet.

While the invention has been illustrated and described in detail in the drawings and foregoing description, such an illustration and description is to be considered as exemplary and not restrictive in character, it being understood that only the preferred embodiments have been shown and described and that all changes and modifications that come within the spirit of the invention are desired to be protected.

What is claimed is:

1. A mass confinement cell comprising:

a frame including a panel operably adjoined to two or more side panels, the side panels extending back from a front panel of the cell at an angle of less than 90°, a front surface adjoined to or formed into the front panel or a fascia and having a molded and/or fabricated natural appearance that is produced by imaging an actual natural surface and applying one or more laminates, surface coatings or paints to the front surface;

an enclosing member that is operably adjoined to the frame with one or more securing mechanisms to form a chamber;

one or more anchoring devices selected from a group consisting of a retaining flange, peg extensions, lockable peg extensions and securing pins; and an open top surface including no top panel or a partial top panel.

2. The mass confinement cell of claim 1, wherein the front surface is positioned on the enclosing member.

3. The mass confinement cell of claim 1 wherein the cell further includes one or more fill materials placed into the chamber of the mass confinement cell.

4. The mass confinement cell of claim 1 wherein the frame, front surface and enclosing member comprise one or more deterioration resistant composite or polymeric materials.

5. The mass confinement cell of claim 4 wherein the deterioration resistant composite or polymeric materials selected from the group consisting of polyethylene, polypropylene, polyurethane, Acrylonitrile-butadiene-styrene (ABS), Polyethylene terephthalate (PET), polycarbonate, Poly(butylene terephthalate) (PBT), Polyethylene terephthalate (PET), polycarbonate, Poly(cyclohexanedimethylene terephthalate) (PCT), polyester, styrene-acrylonitrile copolymers (SAN), polystyrene, and combinations thereof.

6. The mass confinement cell of claim 4, wherein the composite or polymeric material includes one or more colors, filler materials, and/or additives.

7. The mass confinement cell of claim 1, wherein the panels of the frame are adjoined and adapted to unfold into a flat configuration.

8. The mass confinement cell of claim 1, wherein the cell includes one or more partitions.

9. The mass confinement cell of claim 1, wherein the enclosing member includes one or more load cells.

10. The mass confinement cell of claim 1, wherein the enclosing member includes one or more enclosing bars.

11. The mass confinement cell of claim 1, wherein the enclosing member includes a back panel.

12. The mass confinement cell of claim 1, wherein the cell further includes one or more lighting devices.

13. The mass confinement cell of claim 1, wherein the partial top panel extends from a front edge of the front panel back a length no more than 40% of the width of the cell.

14. The mass confinement cell of claim 1 wherein the panel of the frame includes the front panel and the enclosing member includes a back panel.

15. The mass confinement cell of claim 1 wherein the enclosing member includes the front panel.

16. The mass confinement cell of claim 1, wherein the mass confinement cell includes one or more securing mechanisms.

17. The mass confinement cell of claim 16, wherein the one or more securing mechanisms are selected from the group consisting of peg and socket systems, living hinges, T-slot systems and snap and snap aperture systems.

18. A mass confinement cell comprising:

a frame including a front panel and two side panels operably adjoined to the front panel, the front panel either including a front surface or supporting a fascia that has been molded and/or fabricated to provide texture and color to form an earthen appearance or other aesthetic design;

a load cell operably adjoined to the frame with one or more cell fasteners to form a chamber; and an open top surface including no top panel or a partial top panel extending from a front edge of the front panel back a length no more than 75% of the width of the cell.

19. The mass confinement cell of claim 18 wherein the cell further includes one or more fill materials placed into the chamber of the mass confinement cell.

20. The mass confinement cell of claim 18 wherein the frame, load cell and fascia include one or more deterioration resistant composite or polymeric materials.

21. The mass confinement cell of claim 20 wherein composite or polymeric materials are selected from the group consisting of polyethylene, polypropylene, polyurethane, Acrylonitrile-butadiene-styrene (ABS), Polyethylene terephthalate (PET), polycarbonate, Poly(butylene terephthalate) (PBT), Poly(cyclohexanedimethylene terephthalate) (PCT), styrene-acrylonitrile copolymers (SAN), polystyrene and combinations thereof.

22. The mass confinement cell of claim 20, wherein the composite or polymeric materials includes one or more colors, filler materials and/or additives.

23. The mass confinement cell of claim 18 wherein the frame and/or load cell include one or more cell fasteners positioned at different locations to accommodate more than one set-back position.

24. The mass confinement cell of claim 18, wherein the mass confinement cell further includes one or more anchoring devices selected from a group consisting of a retaining flange, peg extensions and securing pins.

25. The mass confinement cell of claim 18, wherein the front panel and side panels are adjoined and adapted to unfold into a flat configuration.

26. The mass confinement cell of claim 25, wherein the front panel and side panels are adjoined with living hinges.

27. The mass confinement cell of claim 18, wherein the cell further includes one or more lighting devices.

28. A deterioration resistant retaining wall comprising a one or more rows including plurality of mass confinement cells comprising:

a frame including a panel adjoined to two or more side panels;

a front surface adjoined to or formed into the front panel or a fascia and having a molded and/or fabricated texture and color to form an earthen appearance or other aesthetic design;

an enclosing member including a load cell comprising a deterioration resistant composite or polymeric material that is operably adjoined to the frame with one or more cell fasteners to form a chamber; and an open top surface including no top panel or a partial top panel.

29. The deterioration resistant retaining wall of claim 28, wherein the deterioration resistant retaining wall further includes a row of cell caps positioned and secured on the top row of mass confinement cells.

30. A method of building a deterioration resistant retaining wall comprising;

a) placing a plurality of mass confinement cells in one or more stacked rows, the mass confinement cells comprising:

i) a frame including a front panel and two side panels operably adjoined to the front panel, the front panel either including a front surface or supporting a fascia that has been molded and/or fabricated to provide texture and color to form an earthen appearance;

ii) a load cell operably adjoined to the frame with one or more cell fasteners to form a chamber; and iii) an open top surface including no top panel or a partial top panel extending back from a front edge of the front panel;

b) filling the chamber of each confinement cell in the row(s) with one or more fill materials;

c) positioning a second set of one or more rows of mass confinement cells above the first row(s) of mass confinement cells;

d) filling the second set of row(s) of mass confinement cells with a fill material; and e) continuing the previously described steps until the desired number of rows is achieved.

31. The method of building a deterioration resistant retaining wall of claim 30, wherein the cells of adjacent rows are staggered.

32. The method of building a deterioration resistant retaining wall of claim 30, wherein the one or more securing mechanisms are selected from the group consisting of peg and socket systems, living hinges, T-slot systems and snap and snap aperture systems.

33. The method of building a deterioration resistant retaining wall of claim 30, wherein the front surface is positioned on the enclosing member.

34. The method of building a deterioration resistant retaining wall of claim 30, wherein the cell further includes one or more fill materials placed into the chamber of the mass confinement cell.

35. The method of building a deterioration resistant retaining wall of claim 30, wherein the frame, enclosing member, a fascia or a combination thereof include one or more deterioration resistant composite or polymeric materials.

36. The method of building a deterioration resistant retaining wall of claim 35, wherein the one or more deterioration resistant composite or polymeric materials selected from the group consisting of polyethylene, polypropylene, polyurethane, Acrylonitrile-butadiene-styrene (ABS), Polyethylene terephthalate (PET), polycarbonate, Poly(butylene terephthalate) (PBT), Polyethylene terephthalate (PET), polycarbonate, Poly(cyclohexanedimethylene terephthalate) (PCT), polyester, styrene-acrylonitrile copolymers (SAN), polystyrene, and combinations thereof.

37. The method of building a deterioration resistant retaining wall of claim 35, wherein the one or more composite or polymeric materials includes one or more colors, filler materials, and/or additives.

38. The method of building a deterioration resistant retaining wall of claim 30, wherein the molded or fabricated front surface is molded or fabricated into the frame.

39. The method of building a deterioration resistant retaining wall of claim 30, wherein the molded or fabricated front surface is positioned on a fascia.

40. The method of building a deterioration resistant retaining wall of claim 30, wherein the cell further includes one or more anchoring devices selected from a group consisting of a retaining flange, peg extensions and securing pins.

41. The method of building a deterioration resistant retaining wall of claim 30, wherein the panels of the frame are adjoined and adapted to unfold into a flat configuration.

42. The method of building a deterioration resistant retaining wall of claim 30, wherein the cell includes one or more partitions.

43. The method of building a deterioration resistant retaining wall of claim 30, wherein the enclosing member includes one or more load cells.

44. The method of building a deterioration resistant retaining wall of claim 30, wherein the enclosing member includes one or more enclosing bars.

45. The method of building a deterioration resistant retaining wall of claim 30, wherein the enclosing member includes a back panel.

46. The method of building a deterioration resistant retaining wall of claim 30, wherein the cell further includes one or more lighting devices.

47. The method of building a deterioration resistant retaining wall of claim 30, further comprising the step of positioning a securing a plurality of cell caps on the top row of mass confinement cells.

* * * * *